US008651336B2

(12) United States Patent
Gadini et al.

(10) Patent No.: US 8,651,336 B2
(45) Date of Patent: Feb. 18, 2014

(54) DISPENSING DEVICE, PARTICULARLY FOR DOMESTIC APPLIANCES

(75) Inventors: Costanzo Gadini, Casale Monferrato (IT); Renato Gaj, Casale Monferrato (IT); Marco Moro, Casale Monferrato (IT); Chris Efstathios Housmekerides, Ludwigshafen (DE)

(73) Assignee: Eltek S.p.A., Casale Monferrato (Alessandria) (IT)

( * ) Notice: Subject to any disclaimer, the term of this patent is extended or adjusted under 35 U.S.C. 154(b) by 852 days.

(21) Appl. No.: 12/673,462

(22) PCT Filed: Aug. 8, 2008

(86) PCT No.: PCT/IB2008/002131

§ 371 (c)(1),
(2), (4) Date: Jun. 7, 2010

(87) PCT Pub. No.: WO2009/022223

PCT Pub. Date: Feb. 19, 2009

(65) Prior Publication Data

US 2011/0247663 A1 Oct. 13, 2011

(30) Foreign Application Priority Data

Aug. 10, 2007 (IT) ..... TO2007A0598

(51) Int. Cl.

| | |
|---|---|
| ***A24F 15/04*** | (2006.01) |
| ***B08B 3/00*** | (2006.01) |
| ***B65H 1/00*** | (2006.01) |
| ***B67D 7/84*** | (2010.01) |
| ***D06F 3/02*** | (2006.01) |
| ***D06F 29/00*** | (2006.01) |
| ***D06F 35/00*** | (2006.01) |
| ***G07F 11/46*** | (2006.01) |

(52) U.S. Cl.
USPC ..... 222/168.5; 68/17 R; 68/224; 134/93; 134/99.2; 134/115 R; 221/186; 221/197; 222/160; 222/162; 222/167; 222/168

(58) Field of Classification Search
USPC ..... 134/115 R
See application file for complete search history.

(56) References Cited

U.S. PATENT DOCUMENTS

| | | | | |
|---|---|---|---|---|
| 4,875,607 | A * | 10/1989 | Torita et al. | 222/643 |
| 5,186,912 | A * | 2/1993 | Steindorf et al. | 422/263 |
| 2005/0236420 | A1 * | 10/2005 | Jowett et al. | 221/248 |
| 2005/0269346 | A1 | 12/2005 | Limback et al. | |
| 2006/0157086 | A1 * | 7/2006 | Kappler et al. | 134/34 |

FOREIGN PATENT DOCUMENTS

| | | |
|---|---|---|
| DE | 101 58 604 | 6/2003 |
| EP | 1 236 430 | 9/2002 |
| EP | 1 493 375 | 1/2005 |
| GB | 2 386 129 | 9/2003 |
| WO | WO 2008/053178 | 5/2008 |

OTHER PUBLICATIONS

International Search Report for PCT/IB2008/002131, mailed Mar. 10, 2009.
Written Opinion of the International Searching Authority for PCT/IB2008/002131, mailed Mar. 10, 2009.

* cited by examiner

*Primary Examiner* — Michael Barr
*Assistant Examiner* — Levon J Shahinian
(74) *Attorney, Agent, or Firm* — Nixon & Vanderhey P.C.

(57) ABSTRACT

A long-life substance dispensing device for a washing machine, particularly a dishwasher, comprises: —a body (20', 30') designed to be sealingly fixed to a structure of the washing machine, —a support means (40) adapted to contain a total amount of a substance sufficient for performing a plurality of washing cycles, —an actuation system (47', 50", 61") which is electrically controllable for causing delivery of at least one dose of the substance contained in the support means (40). The actuation system (47', 50", 61") comprises at least one drive element and one driven element (47') capable of cooperating to obtain the delivery. The actuation system (47', 50", 61") is arranged for being able to take on an operative condition, wherein the drive element (61") is operatively coupled with the driven element (47'), and an inoperative condition, wherein the drive element (61") is decoupled from the driven element (47').

21 Claims, 46 Drawing Sheets

Fig. 17
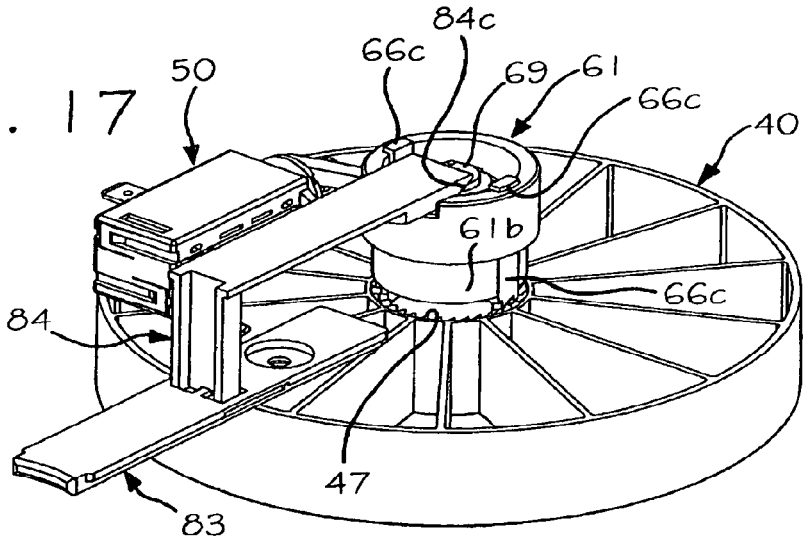
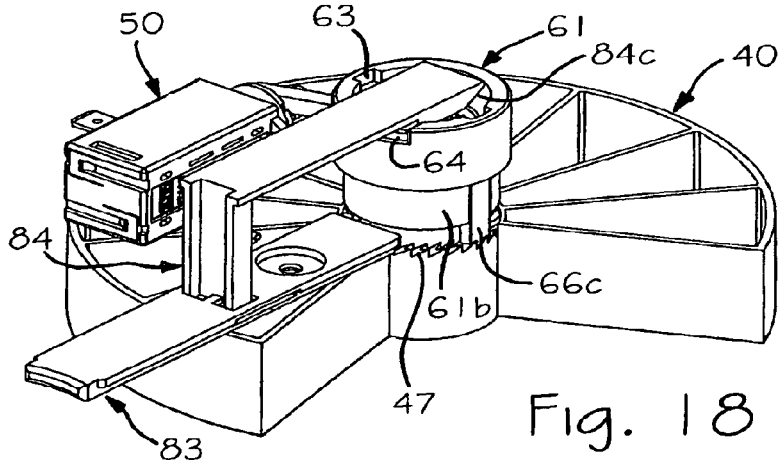
Fig. 18
Fig. 19
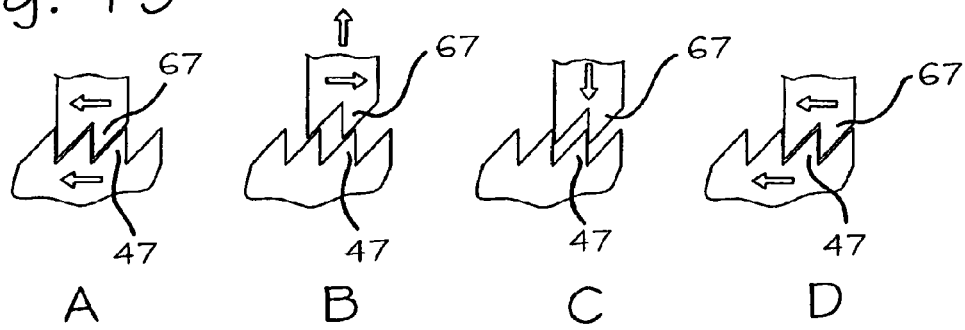

Fig. 27
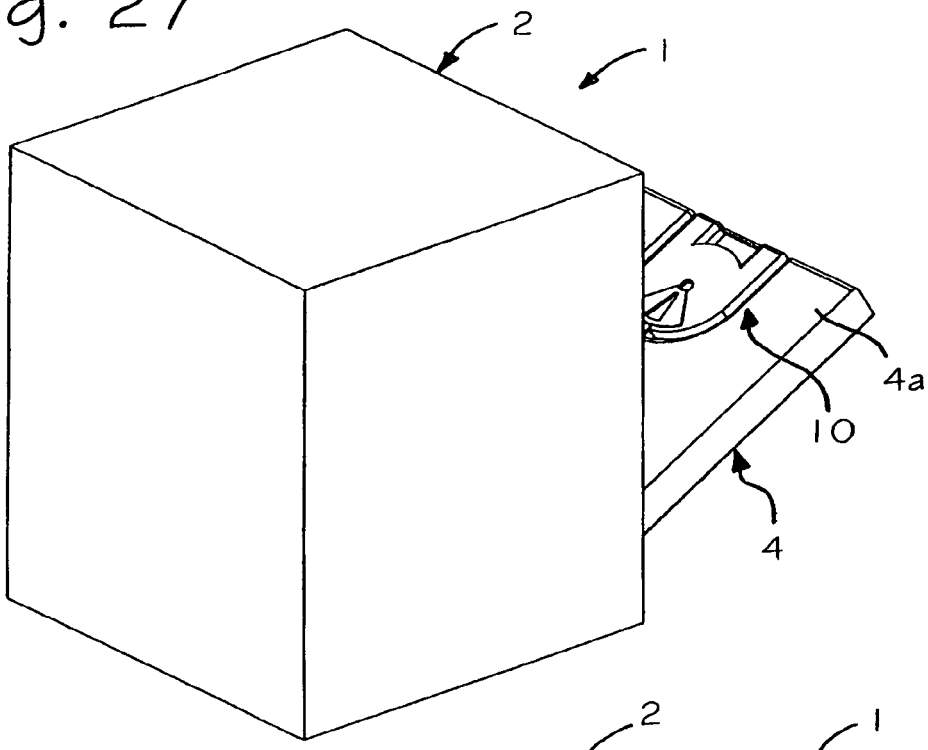
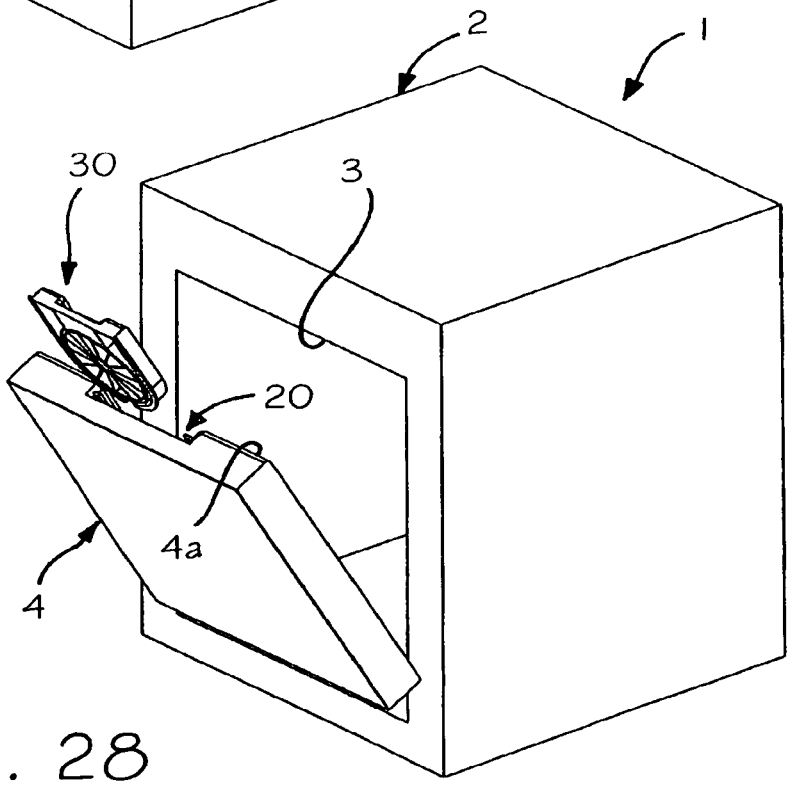
Fig. 28

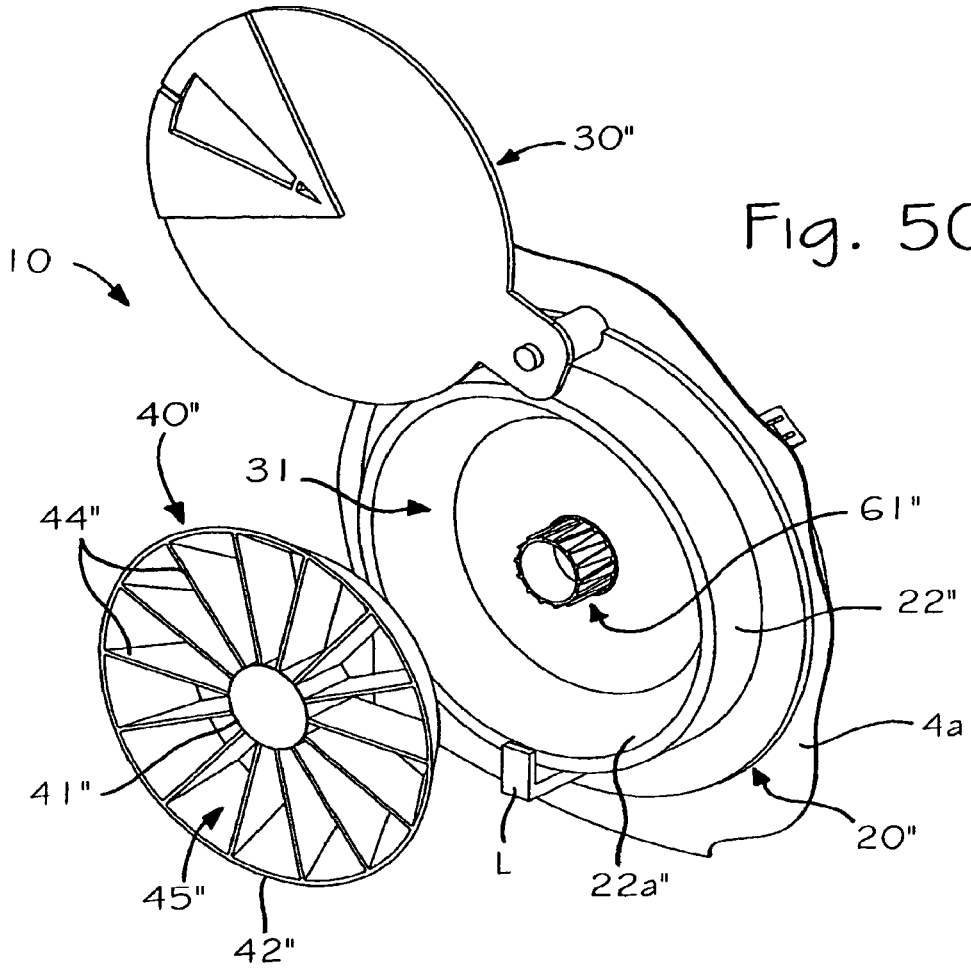
Fig. 50
Fig. 52
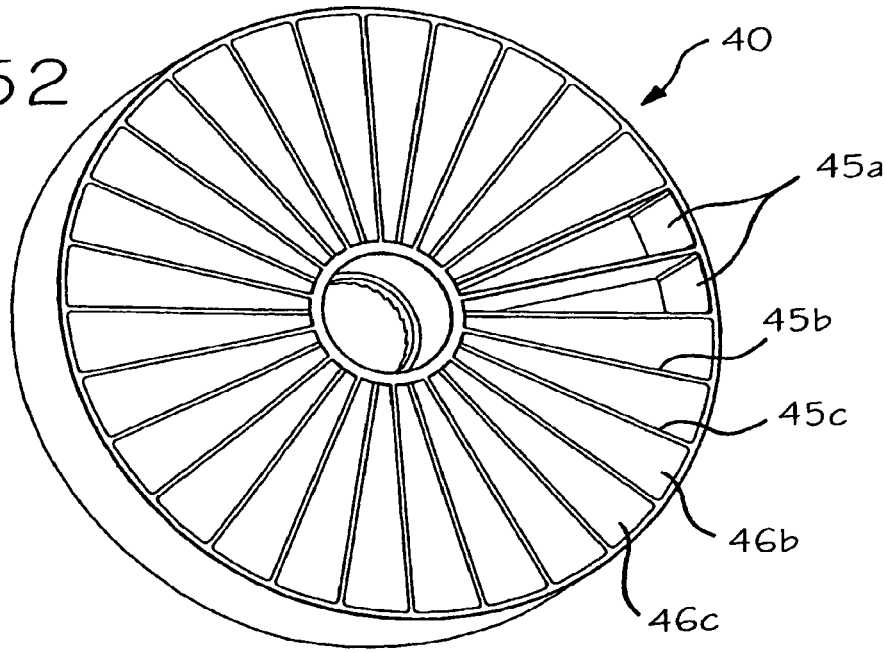

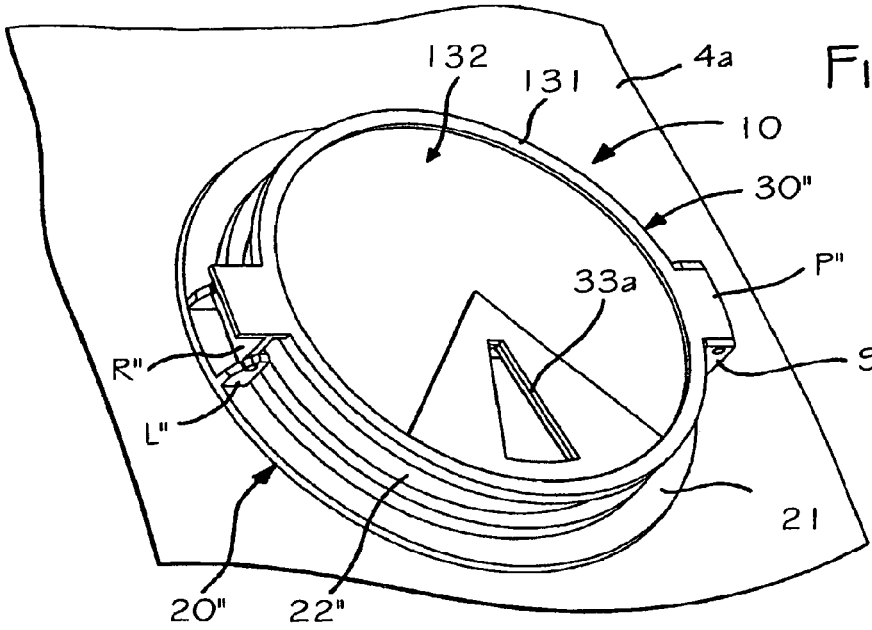
Fig. 53
Fig. 54
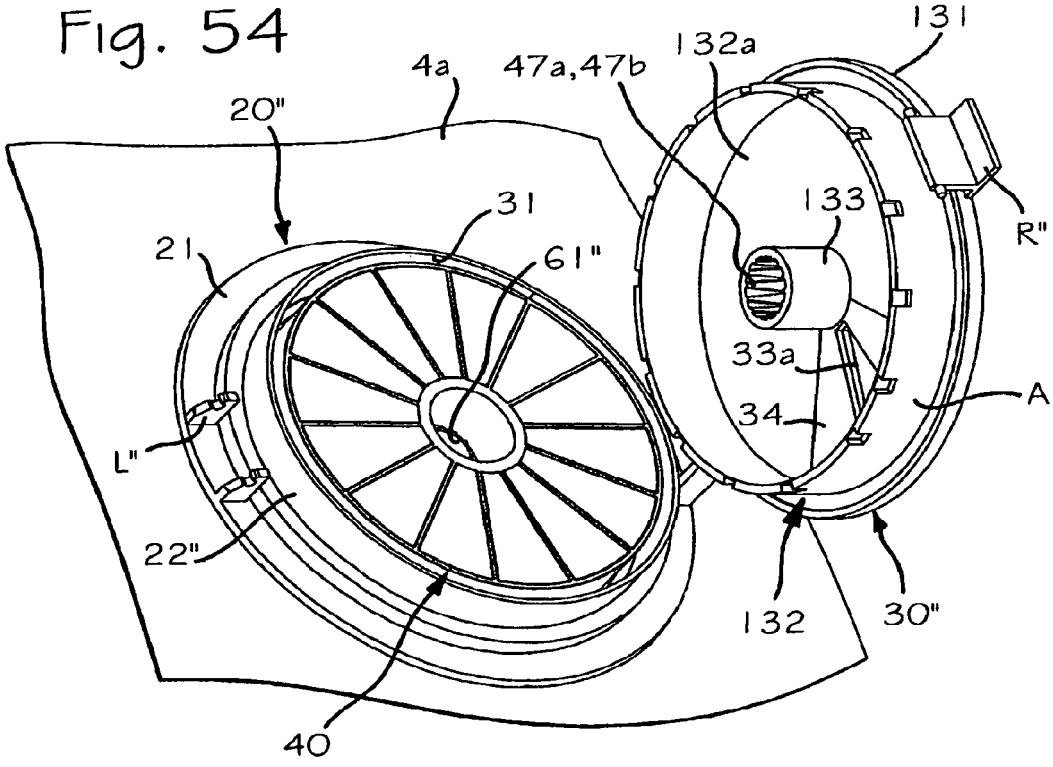

Fig. 56
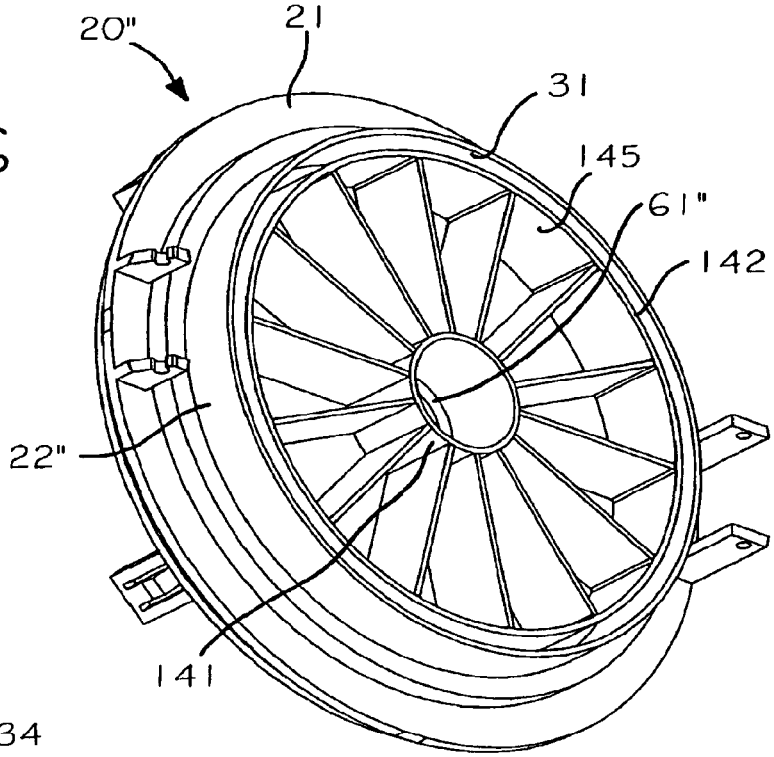
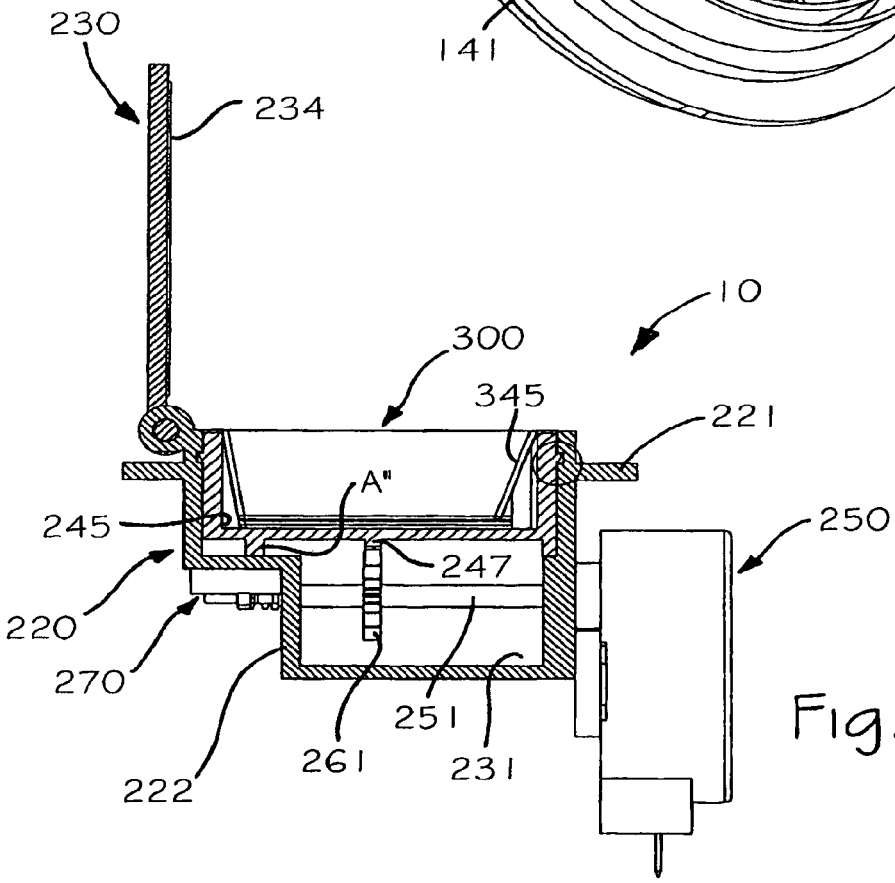
Fig. 60

DISPENSING DEVICE, PARTICULARLY FOR DOMESTIC APPLIANCES

This application is the U.S. national phase of International Application No. PCT/IB2008/002131 filed 8 Aug. 2008, which designated the U.S. and claims priority to Italy Application No. TO2007A000598 filed 10 Aug. 2007, the entire contents of each of which are hereby incorporated by reference.

FIELD OF THE INVENTION

The present invention refers to dispensing devices arranged to contain and deliver a plurality of doses of at least one substance or product. The preferred application of the invention is in the field of long-life dispensers for domestic washing machines, i.e., dispensers arranged for retaining and delivering an amount of a washing agent sufficient for carrying out several operating cycles of the respective washing machine. The invention also has an advantageous application in the case of appliances for domestic use other than washing machines, and in hydraulic appliances in general, in which there is a need for selectively delivering individual doses of a total amount of a generic substance or product.

BACKGROUND ART

Long-life washing agent dispenser are known, especially in the field of dishwashing machines. In the majority of known solutions, the dispenser comprises a body sealingly mounted on one of the walls delimiting the washing chamber of the machine and defining a container capable of retaining a bulk mass of a powder detergent. A metering and delivery system is associated to the main body, which can be actuated by electrical actuating means under the control of the dishwasher's control system; in some solutions the container is configured as a part being removable from the above-mentioned body, in order to ease operations of loading the detergent.

The container is usually hopper-shaped, with the above-mentioned metering and delivery system being operative at the outlet thereof; this system typically comprises a rotatable member, forming one or more receptacles which are open in a radial direction; the angular movement of the above said member is controlled to firstly bring a receptacle into alignment with the lower outlet of the hopper-shaped container, so as to receive a predetermined amount of detergent by gravity; subsequently the member is moved further, to bring the receptacle containing the metered amount of detergent at a delivery port; the detergent can then fall towards the inside of the washing chamber, its flushing being possibly improved by the action of jets of washing liquid coming from a rotating sprinkler usually provided the chamber of the dishwasher. Examples of this prior art are described, for example, in WO-A-8200482 and DE-A-41 34 786.

The known devices of the type indicated—besides being generally cumbersome—are subject to malfunctions due essentially to the inherent characteristics of powdered detergents; these detergents are negatively affected by the moisture which develops inside the dishwasher during each washing cycle, with lumps consequently forming over time; also the vibrations caused by the dishwasher's operation, however slight, can give rise to stratification in the mass of the powdered detergent, which fact has negative effects on the quality of washing (in practice, vibrations cause some components of the detergent to tend to accumulate at the bottom of the hopper-shaped container, and others at the top thereof).

In the attempt to reduce these disadvantages, dispensers have been proposed which are provided with compressed air generators, arranged for keeping the mass of powdered detergent, and at least part of the metering and delivery system, constantly under pneumatic pressure (see for example WO-A-93/18701 and GB-A-2296488). Devices of this type are even more complicated, bulky and expensive.

From EP-A-1 493 375 a long-life dispenser is also known, having a body designed for fixing to one of the walls delimiting the washing chamber of a dishwasher, the body having a stationary container, being hollow and axially extended, only one portion of which is protected by a fixed cover. The dispenser has an actuating system with a driving part, comprising an electrically-controlled actuator, and a driven part, which comprises a metering member; this member is linearly translatable within the stationary container and is configured so as to divide the inside of the container itself into a plurality of compartments arranged side by side, for individual doses of liquid or powdered detergent. With the metering member in the portion of the container not protected by the above-mentioned cover, the user can fill the various compartments with detergent. Later, before the delivery of the first dose of detergent, the actuator draws the metering member in the protected portion of the container; for the purposes of successive deliveries, the actuator causes a stepwise movement of the metering member, so as to bring the various compartments in succession outside the protected portion, exposing them to the washing chamber, into which the relative contents can thus fall or flow by gravity.

This solution is constructionally complicated and lacking in long-term reliability, also in view of the need to provide the movable metering member with a plurality of gaskets, which have the function of operating a seal onto the surface of the stationary container, and which are therefore subject to deterioration over time, but cannot be easily replaced. The actuating system, which is permanently in engagement, must be capable of overcoming the friction caused by the above-mentioned plurality of gaskets on the movable member. Filling and cleaning the compartments is relatively inconvenient to perform; any incrustations in the protected zone can cause operating problems for the device, which has no removable or replaceable parts.

SUMMARY OF THE INVENTION

The present invention proposes to indicate a new long-life dispensing device for substances or products to be delivered in doses having a simple and relatively compact structure, and being precise and reliable in operation and easy for a user to use.

These and other aims, which will become clear later, are achieved, according to the present invention, by a dispensing device for a domestic appliance for domestic use, preferably a hydraulic appliance or a domestic washing machine, such as a dishwasher or a laundry washing machine, having the characteristics indicated in the claims. The claims form an integral part of the technical teaching provided herein in relation to the invention.

BRIEF DESCRIPTION OF THE DRAWINGS

Further aims, characteristics and advantages of the invention will become clear from the detailed description which follows and from the attached drawings, provided purely by way of non-limiting example in relation to a preferential field of use of the invention, wherein:

FIGS. 17 and 18 are two perspective views of some components of the dispenser of the machine of FIG. 1, respectively in an inoperative and an operative condition;

FIG. 19 is a schematic representation of the operating principle of a transmission system of the dispenser of the machine of FIG. 1;

FIGS. 27 and 28 are two schematic perspective views of a washing machine equipped with a dispenser of washing substances, made in accordance with a third inventive embodiment;

FIG. 50 is a perspective view, partially exploded, of the dispenser of FIG. 49, with the above-mentioned movable body in an open position;

FIG. 52 is a perspective view of a further possible variant embodiment of a magazine for a dispenser according to the invention;

FIG. 53 is a perspective view of a dispenser of washing substances made in accordance with a ninth inventive embodiment, with a respective movable body in a closed position;

FIG. 54 is a perspective view of the dispenser of FIG. 53, with the above-mentioned movable body in an open position;

FIG. 56 is a perspective view of a fixed body of a dispenser according to the above-mentioned ninth embodiment, in a possible variant;

FIG. 60 is a cross-section of a variant of the dispenser of FIGS. 57-59;

DESCRIPTION OF PREFERRED EMBODIMENTS OF THE INVENTION

In the examples which follow, for practical reasons, a dispensing device according to the invention is described with reference to one of its preferred applications, i.e. for the purposes of delivering a detergent, an additive or other substance in washing machines; the term "detergent", used occasionally later on in the present description should however be understood to indicate any substance or product capable of being dispensed by means of a device according to the invention.

Figure 1:
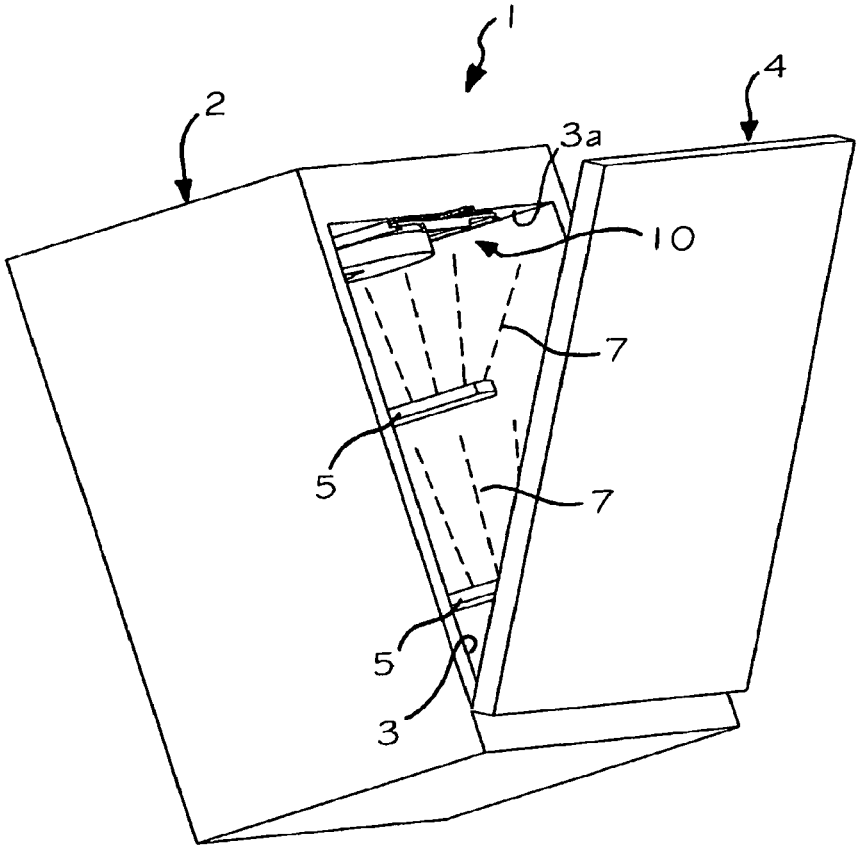
FIG. 1 is a schematic perspective view of a washing machine equipped with a dispenser of washing substances, made in accordance with a first inventive embodiment.

FIG. 1 represents in schematic way a dishwashing machine, designated by 1 as a whole 1, having a fixed structure 2, or cabinet, inside which there is a washing chamber 3; cabinet 2 has a door or a front door 4, which in the case exemplified is forward-tilting door, i.e. hinged at the lower end thereof to the cabinet 2, so that it can rotate around a substantially horizontal axis. Within the chamber 3, sprinkling members are rotatably mounted, one of which is indicated by 5; these sprinklers, being of a conception and operation known per se, are designed to be fed with a washing liquid under pressure, for the purpose of directing a plurality of jets 7 of this liquid onto the dishes contained in suitable baskets of the dishwasher, which are not represented.

Chamber 3 comprises an upper wall 3*a*, to which is secured a dispenser for washing agents, indicated by 10, made in accordance with a first inventive embodiment; as will become clear later, in accordance with other possible embodiments a dispenser according to the invention can be fixed to one of the other walls delimiting the chamber 3, including the so-called door liner or inner wall of the door 4.

Figure 2:
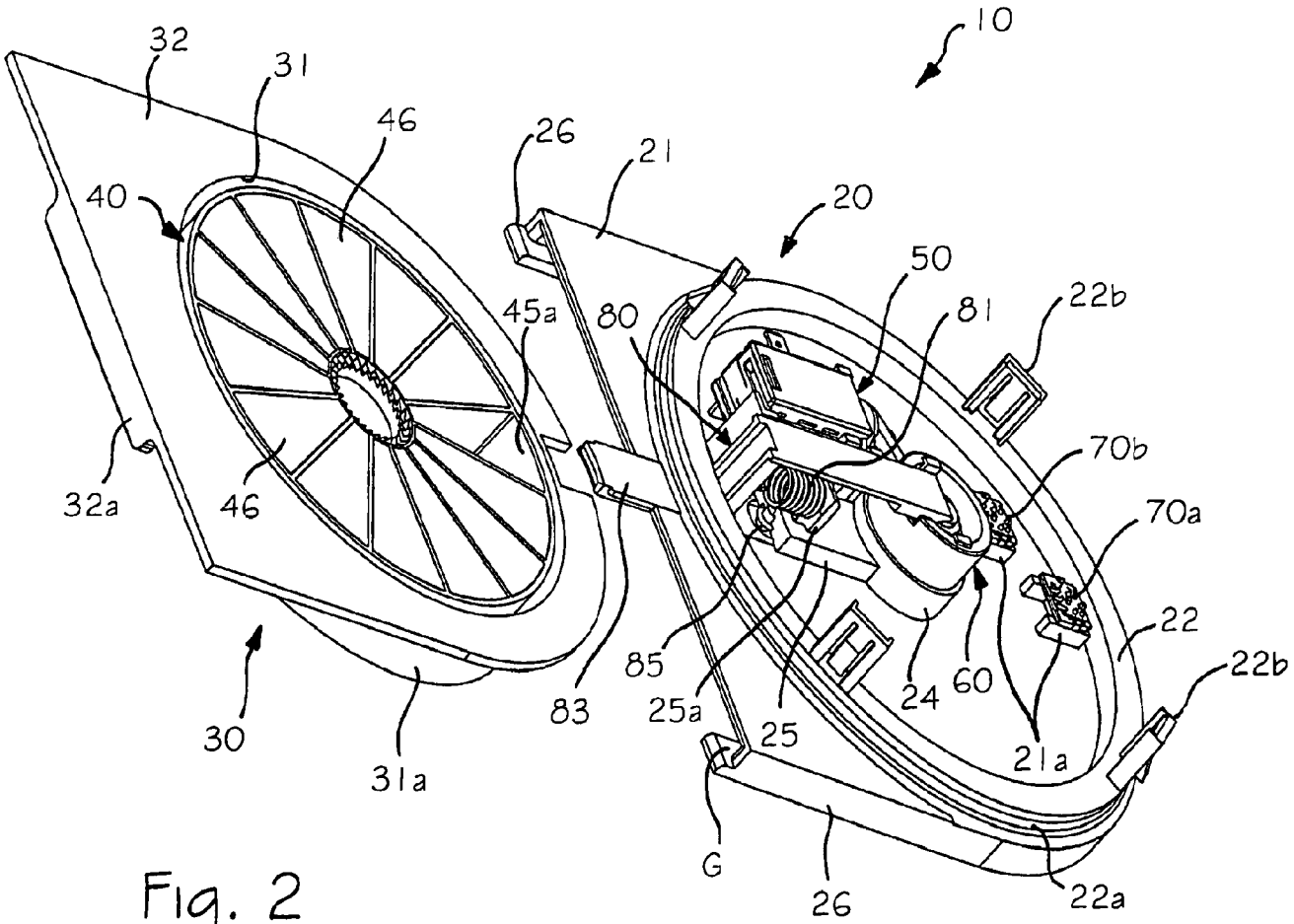
FIGS. 2 and 3 are, respectively, a perspective view and a plan view of the dispenser of the machine of FIG. 1, with a respective cover being removed.
Figure 3:
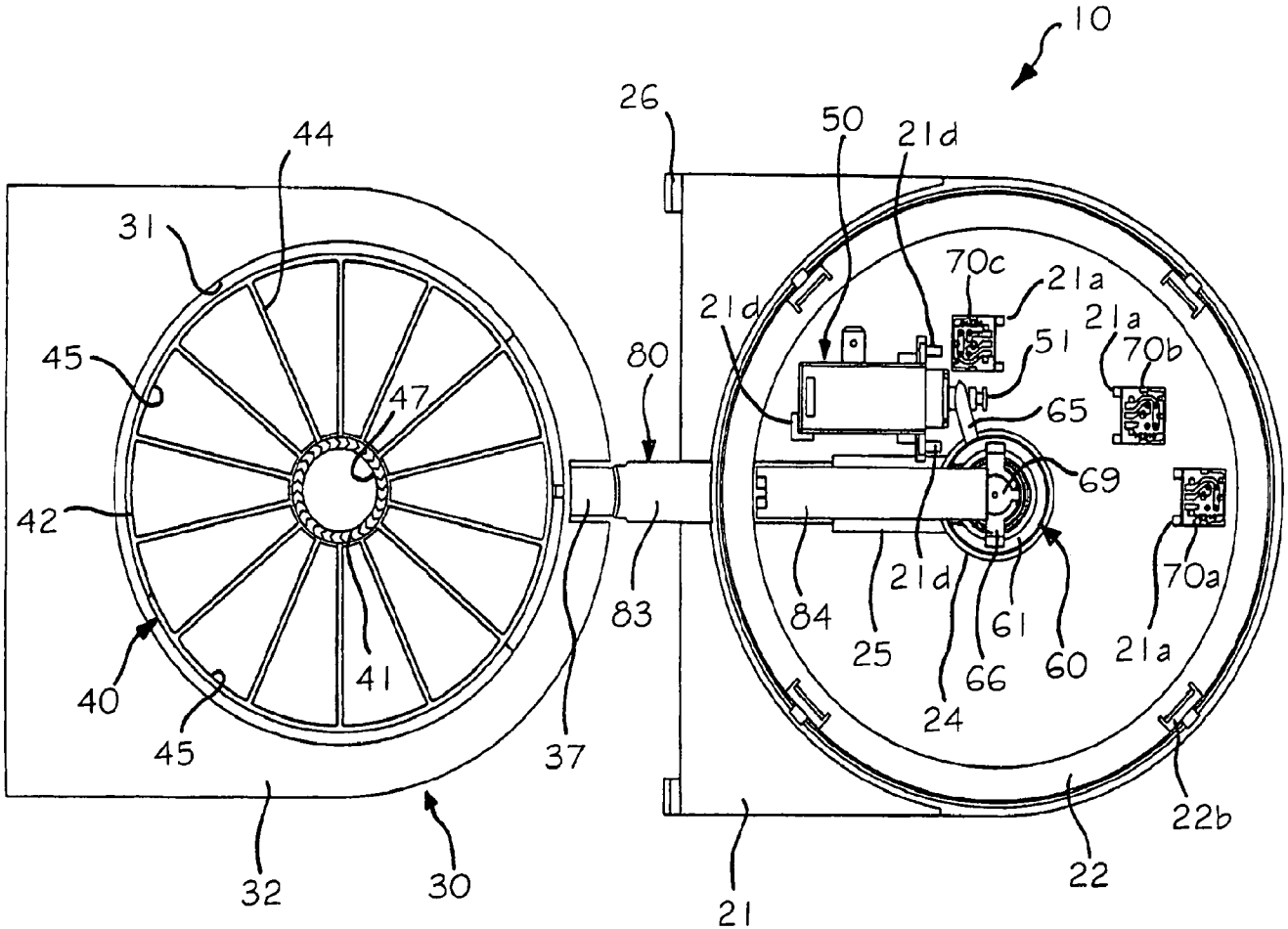

As may be seen in FIGS. 2 and 3, dispenser 10 comprises a fixed body 20 and a movable body 30, forming therebetween a substantially closed housing for a container, or reservoir, or refill, or magazine, indicated by 40 and intended for containing an amount of at least one washing agent sufficient for execution of a plurality of washing cycles performed by dishwasher 1.

Fixed body 20 has associated thereto electrical actuation means, designed to be connected or interfaced with a respective control system, for the purpose of managing operation thereof; in the first embodiment these means consist of a thermoelectric actuator 50, whose type and operation are known per se, having a linearly movable shaft 51. The above-mentioned control system preferably consists of the same control system of the machine 1, but in possible alternative implementations the device according to the invention can be equipped with its own dedicated electronic control and/or detection circuit.

A transmission system 60 is associated to the body 20, arranged for transferring an actuating force generated in a controlled manner by means of actuator 50 to the magazine 40, in order to cause a movement thereof; as will become clear later, this movement is provided in order to make possible delivery of at least one dose of a substance or product, such as a detergent, contained in magazine 40, in the course of a washing cycle performed by machine 1.

Sensing means are also associate to body 20, designed to be connected or interfaced with the above-mentioned control system or circuit. According to an aspect which is in itself inventive, these sensors are arranged for detecting one or more status conditions of the device 10, or of the magazine 40; in the non-limiting case illustrated, these sensing means comprise three optical sensors, indicated by 70*a*, 70*b* and 70*c*.

The electronic detection and/or control circuit and/or the sensing means of the various examples, hereinafter also referred to only as "control circuit" or "control system", can be at least partly housed in device 10 and comprise discrete components and/or integrated circuits or "chips", such as digital and/or processing circuits, for example of the type with microcontroller and/or ASIC and/or DSP and/or with memory means. Said circuits and sensing means can also comprise telemetry means, such as for example at least one antenna for data transmission and/or reception by radio frequency (RF), or other system for wireless information exchange.

According to a solution which is inventive per se, transmission system 60 is can be switched between an operative and an inoperative condition, in which the system is operatively coupled or decoupled with respect to magazine 40; this switching can be obtained by acting on a manual control device, indicated by 80 as a whole in FIGS. 2 and 3, to which a bistable kinematic mechanism is connected, a possible embodiment of which will be described below.

A cover 90 is associated to body 20, represented only in certain figures (see for example FIGS. 4 and 7), designed to cover at least in part an area where there are positioned the actuating means 50, the sensing means 70*a*-70*c*, part of the transmission system 60 and part of the manual control device 80. Cover 90 is preferably made of moulded thermoplastic material.

Figure 4:
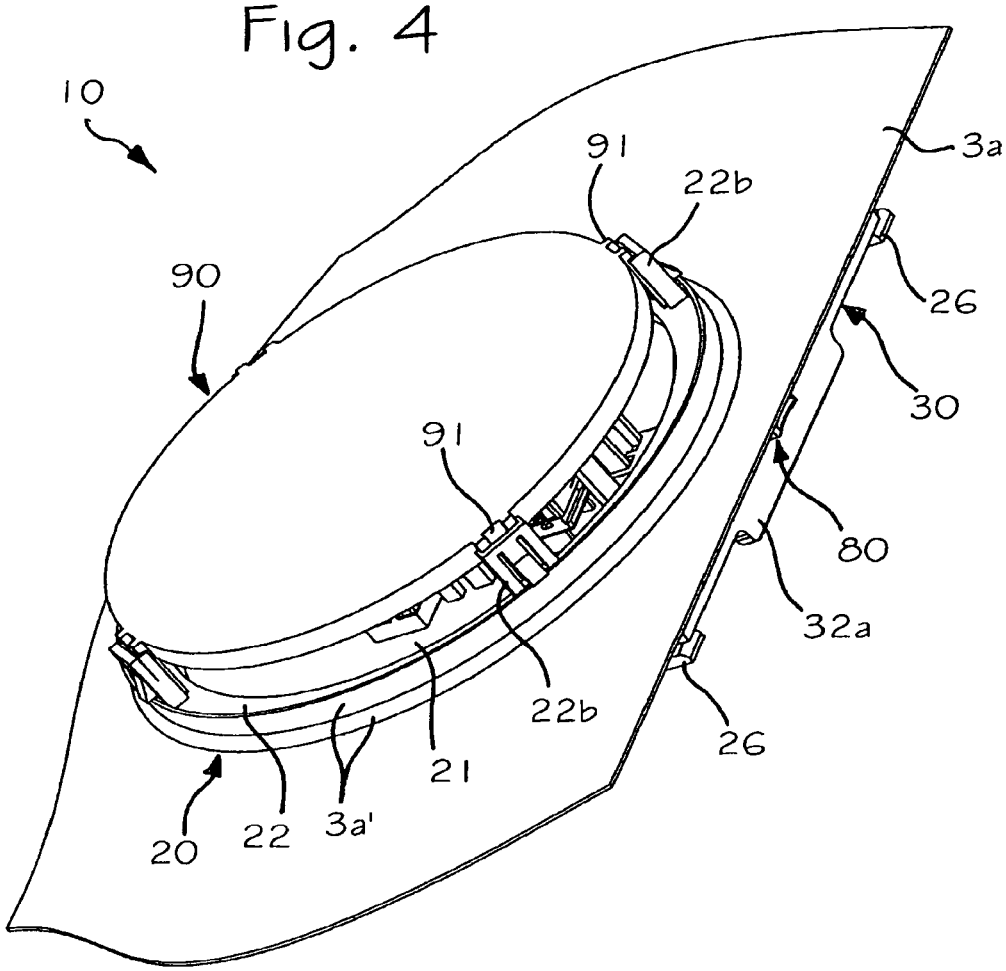
FIG. 4 is a perspective view of the dispenser of the machine shown in FIG. 1, in a condition mounted on a wall of a treatment chamber of a washing machine.

Fixed body 20, which is also preferably made of moulded thermoplastic material, is designed to be sealingly fixed at a respective aperture formed in the relevant wall of the chamber (wall 3*a*, in the example of FIG. 1); as may be imagined from FIG. 4, a first portion of body 20, protected by cover 90, is designed to extend into a hollow space formed between the cabinet 2 and the chamber 3; a second portion of body 20 is designed to extend, or to be exposed, within the inside of chamber 3, and the movable body 30 is associated to it; in the first embodiment, the above-said second portion of body 20 forms a seat for housing in a sliding way the movable body 30, which is substantially configured as a drawer.

Figure 7:
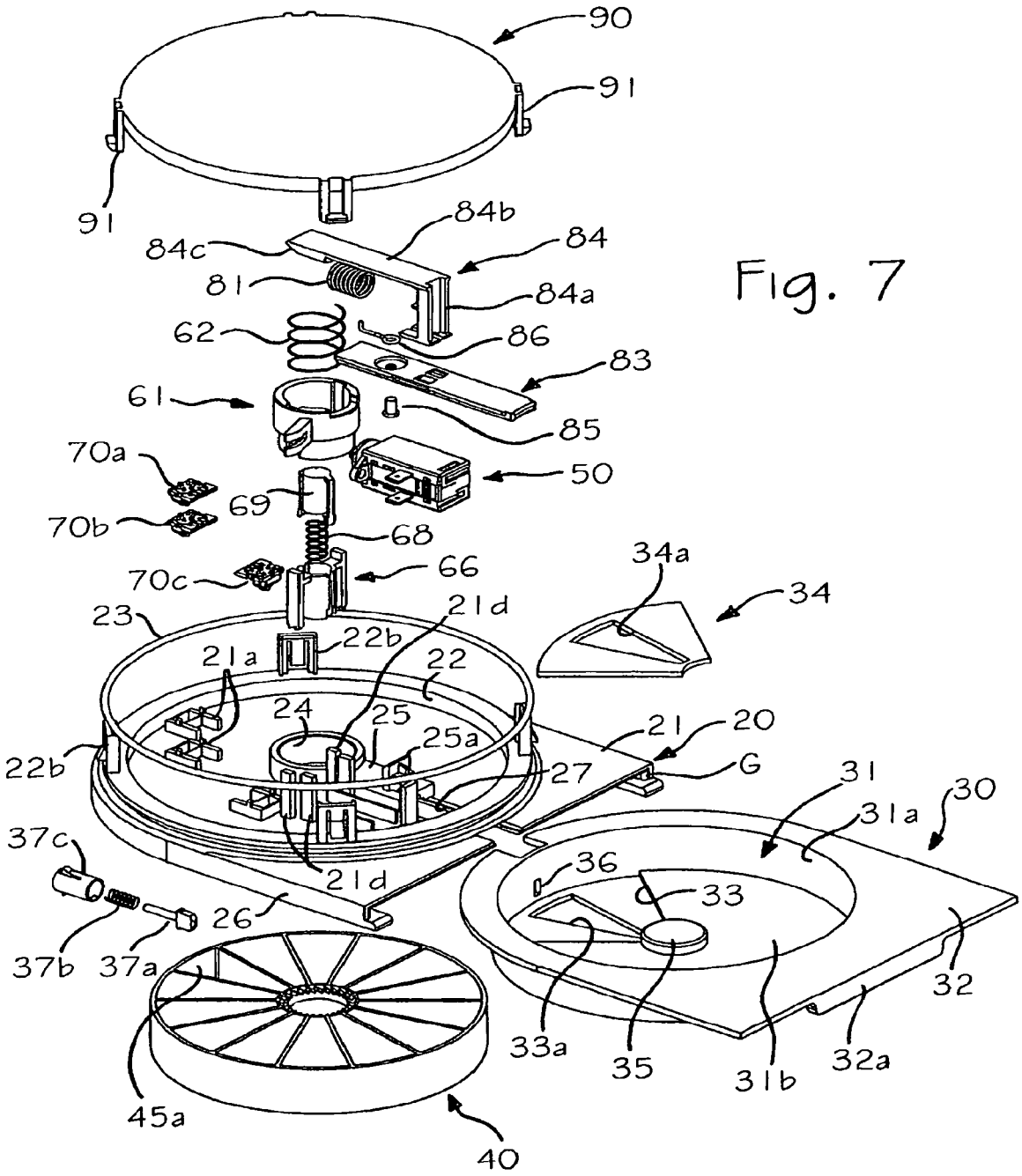
FIG. 7 is an exploded view of the dispenser of the machine of FIG. 1.

The fixed body 20 comprises a main or base wall 21, from the upper side of which an annular wall 22 rises, defining along the respective outer circumference a seat 22*a* for a sealing gasket, indicated by 23 in FIG. 7; from the top of this annular wall 22 there rise a series of couplings 22*b*, designed to cooperate with respective couplings 91 on the cover 90; couplings 22*b* also include teeth to secure body 20 to wall 3*a* of the chamber, or rather to a lip 3*a*' of the aperture of this wall, at which the device 10 is sealingly mounted, thanks to the presence of gasket 23.

Figure 5:
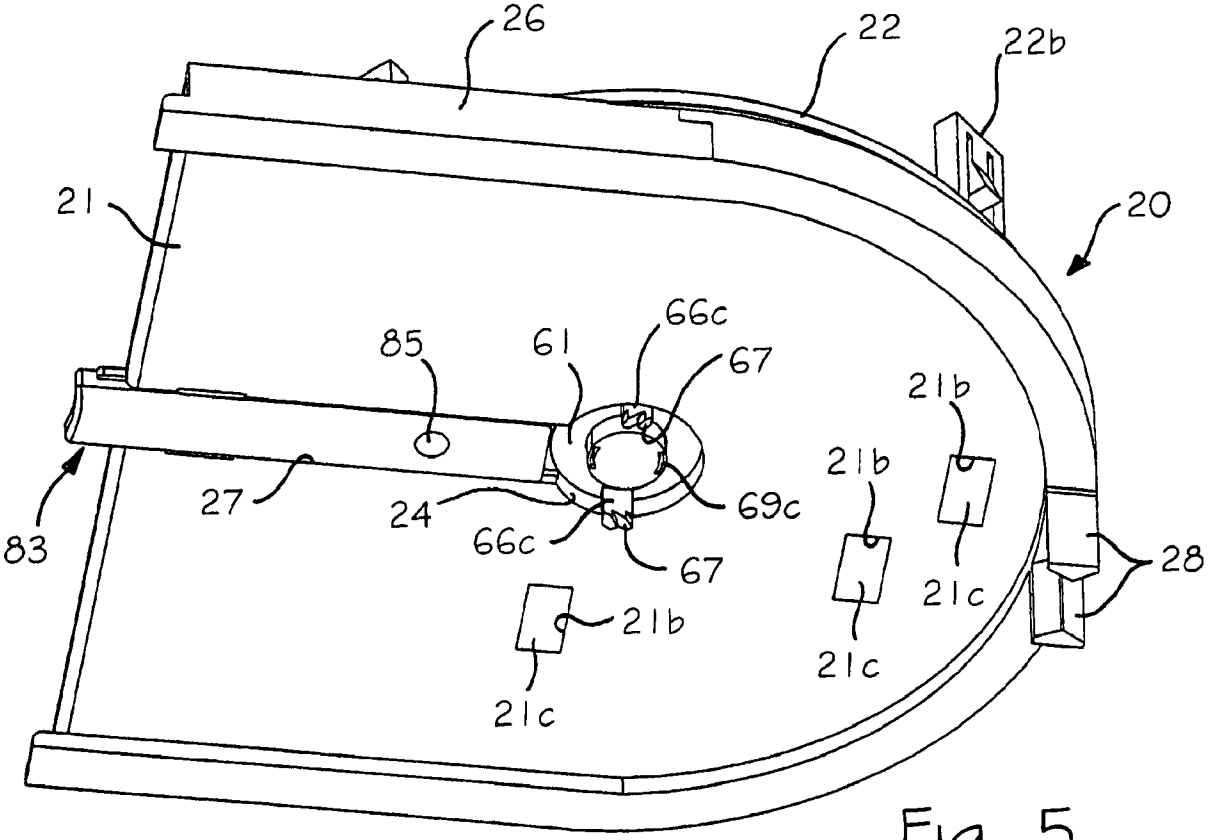
FIG. 5 is a perspective view of the lower part of a fixed body of the dispenser of the machine of FIG. 1.

From the upper part of wall 21, within the area localized by the annular wall 22, there rise first positioning lugs, indicated by 21*a*, for sensors 70*a*-70*c*;adjacent to each lug 21*a*, windows are formed in wall 21, visible in FIG. 5, preferably consisting of through openings 21*b* of wall 21; a closure element 21*c* made of transparent material is provided to fit in these apertures, for example moulded onto the material making up body 20; closure elements 21*c* could also be driven, welded or glued at opening 21*c*; another possibility again is to for body 20, or at least its wall 21, in a transparent material, without the above-mentioned through openings.

Still within the area localized by the annular wall 22, on the upper surface of wall 21 there rise a cylindrical wall, defining an axially hollow seat 24, and a projection 25, which extends radially from cylindrical the seat 24; on the upper side of projection 25 there rises a positioning lug 25*a* for one end of a spring 81 (FIG. 2). Again from the upper surface of wall 21 there rise a set of second lugs, indicated by 21*d* in FIG. 3, for positioning and securing actuator 50.

A peripheral wall or rim, indicated by 26, projects at right angles from the lower part of wall 21, extending along three of the four sides of the perimeter of wall 21 (and in particular along a rear side, which has a substantially semicircular profile, and two sides parallel to each other, substantially rectilinear); peripheral wall 26 has a substantially L-shaped section, so as to define a guide G capable of slidingly receiving, from the front side of wall 21 (i.e. the side which does not carry the rim 26), a respective peripheral portion of the movable body 30 of dispenser 10.

Figure 6:
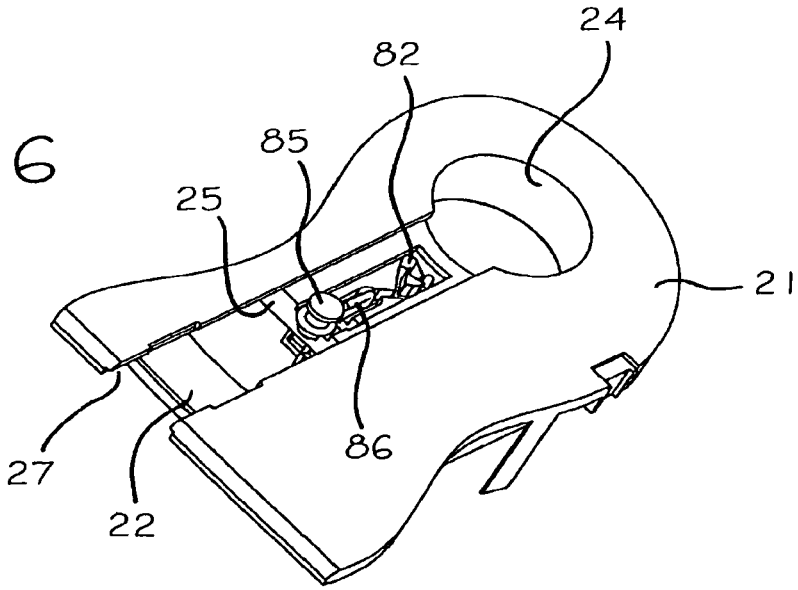
FIG. 6 is a perspective view of a portion of the fixed body of FIG. 4, with some components omitted.

In base wall 21 of body 20, a straight guide or slot is formed, indicated by 27 in FIGS. 5 and 6, which extends in a radial direction from seat 24 as far as the above-mentioned front side of wall 21; as can be seen in FIG. 6, part of slot 27 extends below the lower surface of projection 25, in which a cam-profiled recess 82 is defined, which is part of the above-mentioned bistable kinematic mechanism, described below.

As has already been mentioned, movable body 30 is substantially configured as a sliding drawer, which has a lower housing portion, indicated by 31 in FIGS. 2 and 3, being substantially cylindrical, integral with an upper flange portion 32, whose edge is capable of sliding within guide G defined by rim 26 on of the fixed body 20; preferably, a grasping element 32*a* is defined in the front area of the flange portion 32, aimed at facilitating manual operations of opening and closing the movable body part 30 by sliding.

As can be seen in FIG. 7, housing portion 31 is defined by a circumferential wall 31*a* and a bottom wall 31*b*;in the bottom wall 31*b*, a seat 33 is defined, within which a delivery through aperture 33*a* is formed which, in the exemplified case, has a section substantially shaped as a circular sector. Seat 33 is designed for positioning a seal element or gasket 34, preferably made of elastomeric material, which is provided with a respective through aperture 34*a* which has a shape corresponding to that of aperture 33*a*; gasket 34 has a thickness such that, when located in the respective seat 33, its upper surface operates a seal on at least part of magazine 40, with apertures 33*a* and 34*a* aligned to each other. From the central region of the bottom wall 31*b* there rises a cylindrical projection, indicated by 35, for centring and guiding magazine 40.

A passageway 36 is formed in the circumferential wall 31*a*, substantially at the bisector of aperture 33*a*;on the outside of wall 31*a*, a cylindrical seat 37 (FIG. 3) is formed at this passageway, for a positioning mechanism. As may be seen in FIG. 13, seat 37 accommodates a slider 37*a* and a spring 37*b*, this seat being closed by a plug 37*c*, which can be hooked to the housing; as may be imagined from FIG. 13, the arrangement is such that spring 37*b* is operative for biasing a tip point of slider 37*a* into passageway 36, so as to make it to project into housing 31 of magazine 40. As can be seen in FIG. 5, fixed body 20 has projections 28 on its lower portion, between which the above-mentioned cylindrical seat 37 is adapted to fit, when movable body 30 is fully inserted in the respective sliding guide G.

The housing portion 31 of movable body 30 is designed to house magazine 40, which is configured for containing an amount of washing agent sufficient for carrying out several washing cycles performed by the dishwasher 1, thus functioning as a removable reservoir. In the case illustrated, the above-mentioned magazine is configured as a multi-dose cartridge or magazine, having a body which is generally flattened cylindrical in shape (here with a radius greater than its height), within which a plurality of compartments or receptacles are defined for respective doses of the washing agent.

Figure 8:
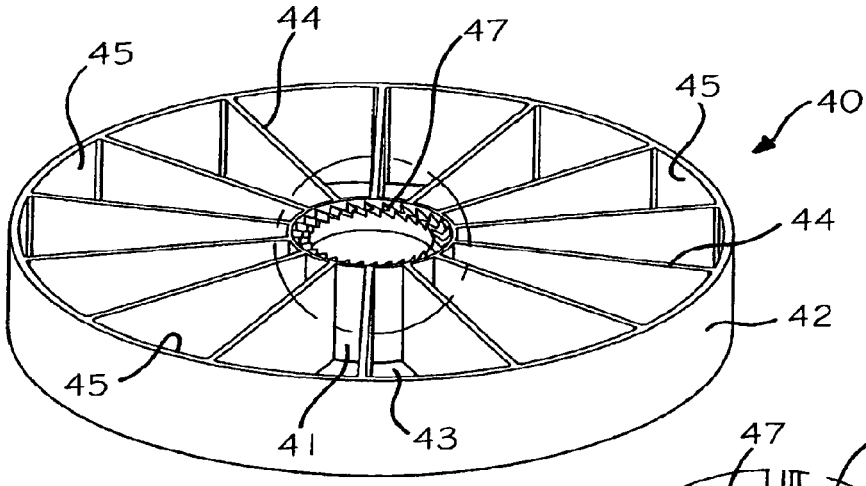
FIG. 8 is a first perspective view of a container, or reservoir, or movable support, or magazine of the dispenser of the machine of FIG. 1.

Magazine 40 constitutes a support means for a plurality of separate doses of washing substance or agent. As can also be seen in FIGS. 8 and 9, the body of magazine 40—made for example of plastic material—comprises a tubular central portion 41 and a cylindrical peripheral wall 42. In a possible variant embodiment, visible in FIG. 10, the body of magazine 40 can also include an upper closing wall, indicated by 43, whose presence is however not strictly necessary for the purposes of the operation of dispenser 10; wall 43, when present, has a thin configuration and is preferably formed of a transparent material (this wall 43 could for example consist of an additional welded element or be an integral part of magazine 40, or again be part of a protective casing). In the simplest implementation, the above-mentioned wall 43 is not present, such that the two opposed faces of magazine 40 are both open.

A plurality of radial walls or dividers 44 extend between the tubular central portion 41 and the peripheral wall 42, which delimit a series of receptacles 45, within which respective doses of a substance or product can be contained, such as a solid washing agent or a detergent, some of which indicated by 46 in FIG. 2; in the case illustrated, receptacles 45 have a section shaped as a circular sector, having a plan profile substantially corresponding or similar to that of aperture 33*a* of body 30 and of aperture 34*a* of gasket 34; the doses can be configured as tablets of a shape corresponding to that of receptacles 45, inserted into them with slight interference; alternatively, a powdered detergent can be compacted or sintered, in the course of the production of magazine 40, inside the various receptacles 45. The method of introducing the detergent into magazine 40 is in any case away from the purposes of the present invention; preferably the doses of substance or product are made integral with receptacles 45 or magazine 40, or are arranged such that they cannot exit the receptacles by gravity alone.

In the event that the two faces of magazine 40 are open, also receptacles 45 are open at both their respective axial ends. Clearly, if the upper face 43 is provided, receptacles 45 are open only on the lower face of the magazine.

Figure 9:
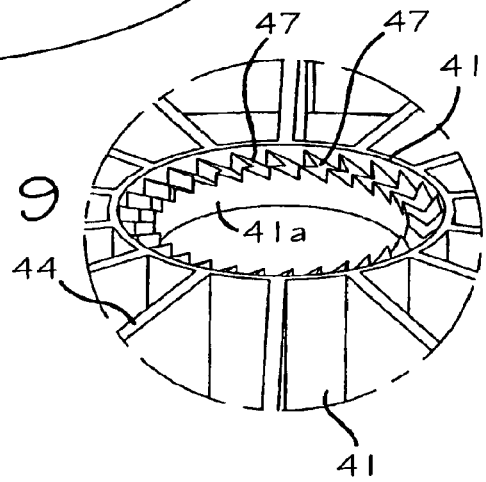
FIG. 9 is a detail of FIG. 8, on a magnified scale.
Figure 10:
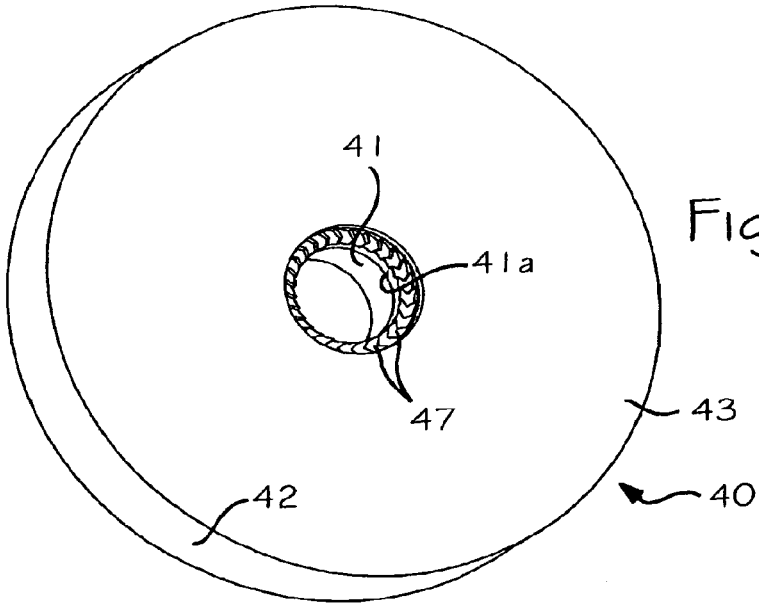
FIG. 10 is a perspective view of a magazine of the dispenser of the machine of FIG. 1, in accordance with a possible variant embodiment.

The tubular central portion 41 of magazine 40 has, in its end area near the upper face, means for coupling with respective actuating members of the dispenser 10; in the example illustrated, these coupling means consist of a toothed rim, i.e. a succession of teeth 47 arranged according to a circumference; as is clearly visible in FIG. 9, the teeth 47 lie inside the tubular portion 41, which is equipped with a circular internal flange for this purpose, indicated by 41*a*, on which the above-mentioned teeth are formed. In the embodiment illustrated, the toothed rim is substantially saw-toothed, each tooth 47 being defined by an upper surface with inclined plane and a front surface substantially vertical; in the case illustrated, furthermore, said front surface of teeth 47 is not flat but in fact—when viewed on plan—has a V-shaped profile, formed of two diverging wall sections, i.e. with the teeth having a substantially herring-bone front profile (see also FIG. 3). This configuration of teeth 47 proves advantageous for the purpose of obtaining auto-alignment or self-centring of magazine 40 with respect to the teeth—described below—of the transmission system 60, compensating for any tolerances in projection 35, which could possibly be omitted.

Figure 11:
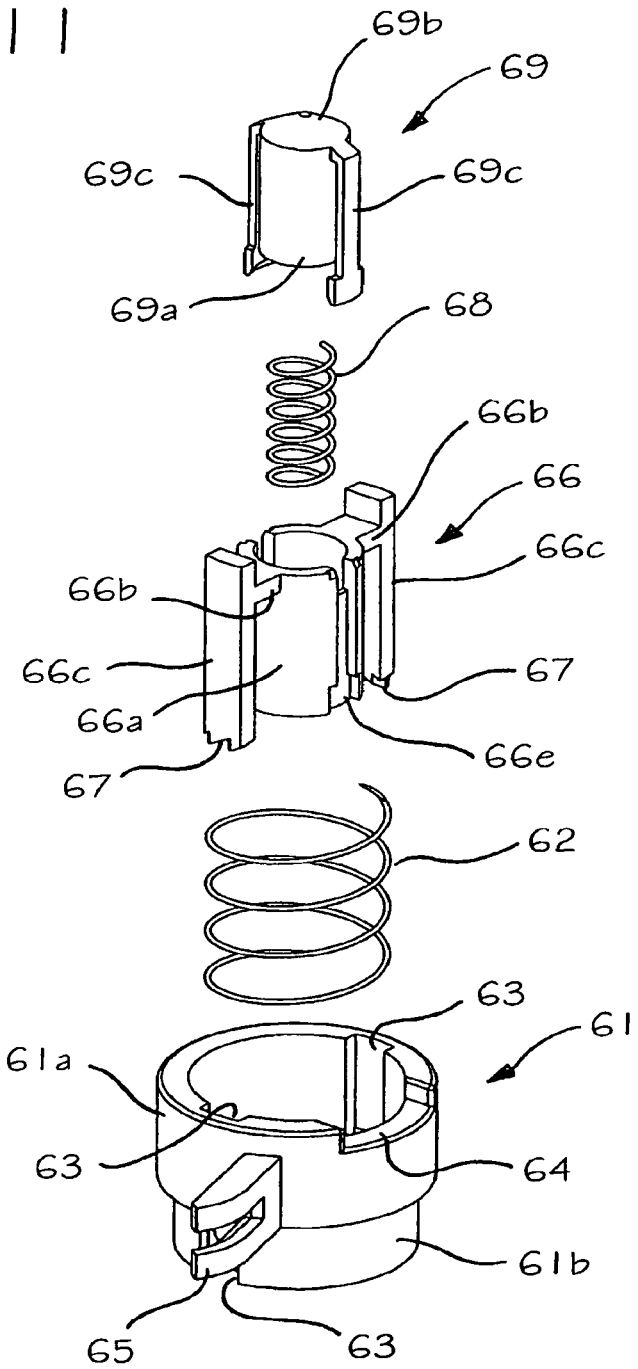
FIG. 11 is an exploded view of some components of a movement and/or transmission system of the dispenser of the machine of FIG. 1.
Figure 13:
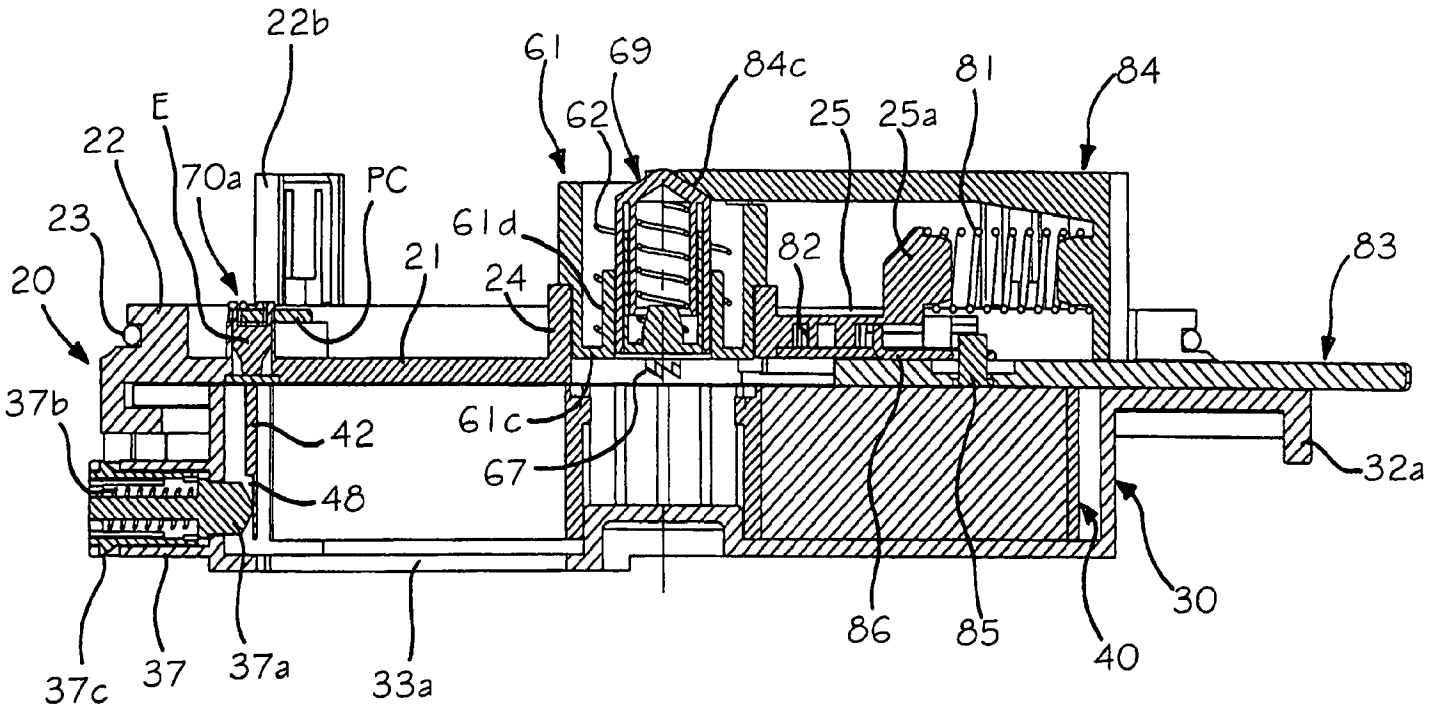
FIG. 13 is a schematic section of the dispenser of the machine of FIG. 1, without a respective cover and in an inoperative condition.

The main components of the transmission system previously indicated as a whole by 60 are visible in FIG. 11; reference 61 indicates a first member, designed to be supported in the cylindrical seat 24 of body 20 so as to be able to move angularly; member 61 has a tubular body, in which an upper portion 61*a* and a lower cylindrical portion 61*b* can be identified, the latter being of such a diameter as to be able to fit into seat 24; as can also be seen in FIG. 13, member 61 is internally hollow and has a bottom wall 61*c*, above which there rises a tubular central part 61*d*, on which a spiral spring 62 sits; on the inside of upper portion 61*a* of member 20, two axial guides or grooves 63 are formed, in diametrically opposite positions, which continue into the lower portion 61*b* of the same member 61 in the form of notches. The upper edge of portion 61*a* has a radial groove 64, designed to slidingly receive a pressing member described below. The upper portion 61*a* has furthermore a lateral projection 65, which is designed to hook onto the end of the actuation shaft 51 of actuator 50 (see FIG. 3).

Member 61 receives a movable coupling element, indicated by 66, which has a tubular central core 66*a*, from the top of which two radial fins 66*b* project, starting from diametrically opposite areas; each fin 66*b* has an engagement lug 66*c* which extends downwards, parallel to core 66*a*, as far as the bottom end of the core; at the lower end of each engagement lug 66*c*, one or more teeth 67 are formed, which, as will be seen later, are designed to cooperate with teeth 47 of magazine 40. To this end, as may be seen in FIG. 5, teeth 67 have a shape which is substantially complementary to that of teeth 47 of magazine 40; in the case illustrated, two saw-teeth 67 are provided at the lower end of lugs 66*c*, each of them characterised by an upper surface at an inclined angle and a front surface which is substantially vertical, the latter having a substantially V-shaped profile.

The above-mentioned engagement lugs 66*c* of element 66 are designed to fit into grooves 63 of member 61, with the possibility of axial sliding, while the central core 66*a* is partially received within the tubular part 61*d* of the same member 61 (see FIG. 13); as a result of this positioning, one of the ends of spring 62 rests on the lower wall 61*c* of member 61 and the other end bears on the radial fins 66*b* of the coupling element 66.

Core 66*a* of element 66 has a respective bottom wall in which a spring-guide 66*d* is formed (FIG. 14); in addition to a spring 68, the cavity of the core 66*a* also accommodates at least part of a closure element 69, having a cylindrical body 69*a*, with an end wall or head 69*b* of generally tapering or conical shape; cylindrical body 69*a* is equipped with two side fins 69*c*, which extend downwards and are designed to be elastically coupled, with the possibility of axial sliding, in respective seats 66*e* formed on the outside of core 66*a* of coupling element 66.

The manual control device previously indicated by 80 comprises a slider member indicated by 83, for example in FIGS. 2 and 7, of a generally flattened shape and arranged for being slidingly retained in the radial guide or slot 27 formed in the base wall 21 of the fixed body 20; for this purpose, the longer edges of slot 27 have a respective notch, into which a portion or side projection of each longitudinal edge of slider 83 is slidingly inserted, as may be partially seen for example in FIG. 5.

Associated to the top of slider 83, in a known way, is a pressing member indicated as a whole by 84 in FIG. 7, whose body comprises a substantially vertical part 84*a*, having at its lower end hooking means designed to cooperate with similar hooking means of the slider 83, and a substantially horizontal part 84*b*, having at the front end thereof an inclined-plane wall, indicated by 84*c*;on the vertical part 84*a* of member 84 there is a positioning lug for the second end of spring 81 (the first end of spring 81 being engaged on lug 25*a* shown in FIG. 2, as mentioned above).

Figure 16:
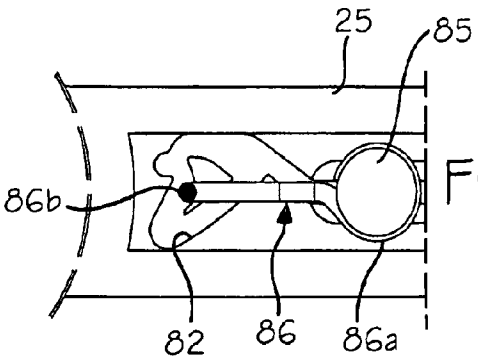
FIGS. 15 and 16 are two partial schematic views, in plan, of a cam and cam-follower arrangement forming part of a bistable kinematic mechanism (partially visible also in FIG. 6) with which the dispenser of FIG. 1 is fitted.
Figure 15:
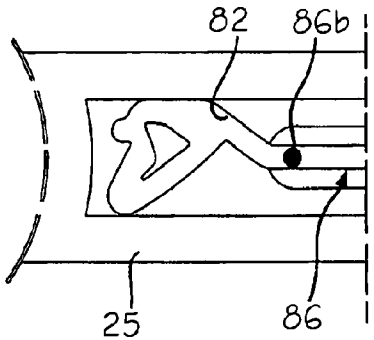

Slider 83 has a through hole in an intermediate region thereof, into which a pin 85 (which can be seen for example in FIGS. 5-7) is designed to be drawn (note that in FIG. 6, slider 83 has been omitted for reasons of clarity), for positioning a switching element 86, which is part of the above-mentioned bistable kinematic mechanism; in the example—see FIGS. 15 and 16, in which slider 83 has been omitted—this element 86 consists of a metal wire, profiled with a substantially straight intermediate portion capable of elastic flexing, a first end forming an eyelet 86*a* for coupling to pin 85 on slider 83, and a second end bent at right angles so as to create a cam follower 86*b*, designed to cooperate with recess 82.

Figure 12:
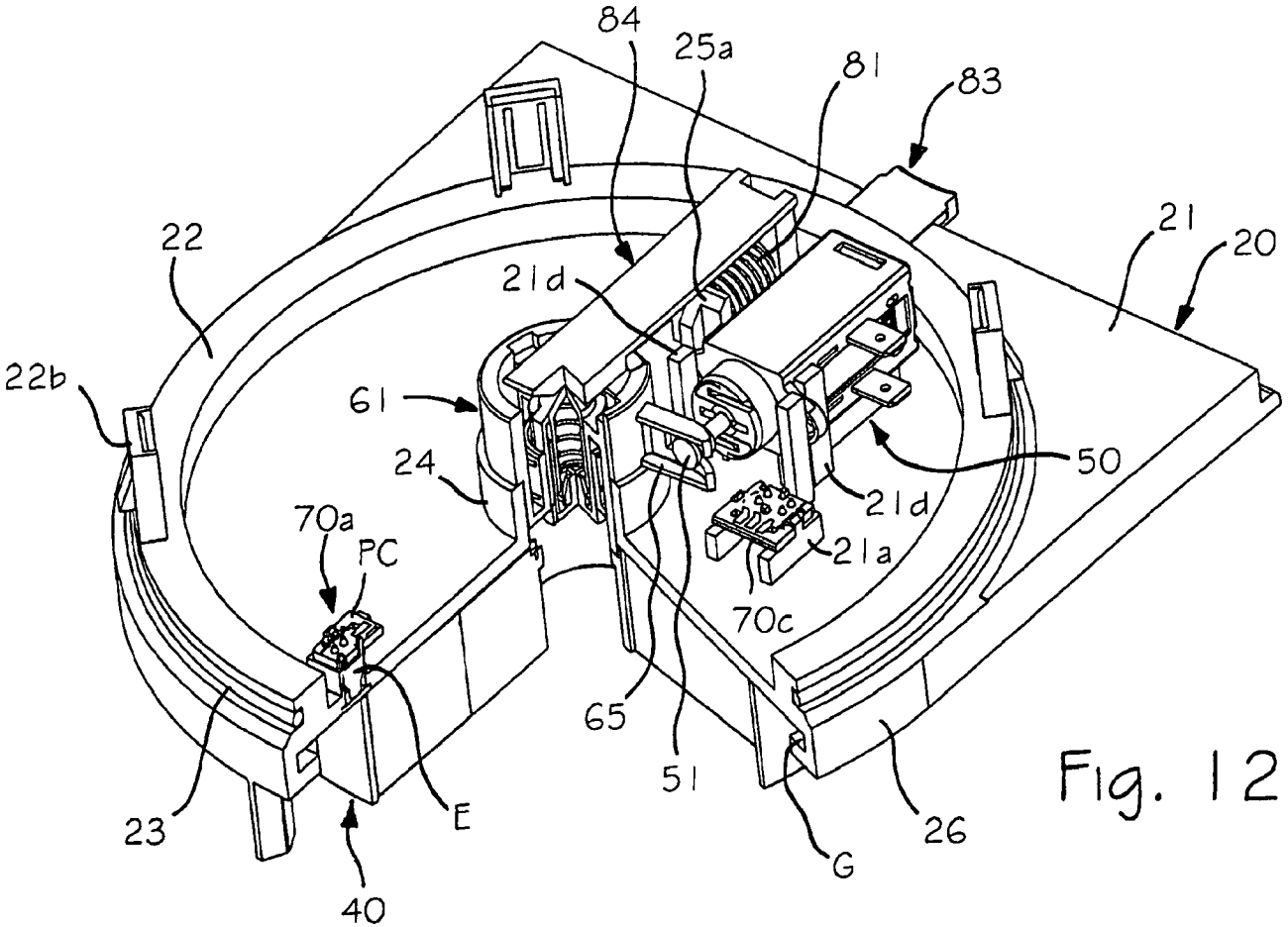
FIG. 12 is a partially-sectioned perspective view of the dispenser of the machine of FIG. 1, without a respective cover and in an operative condition.
Figure 14:
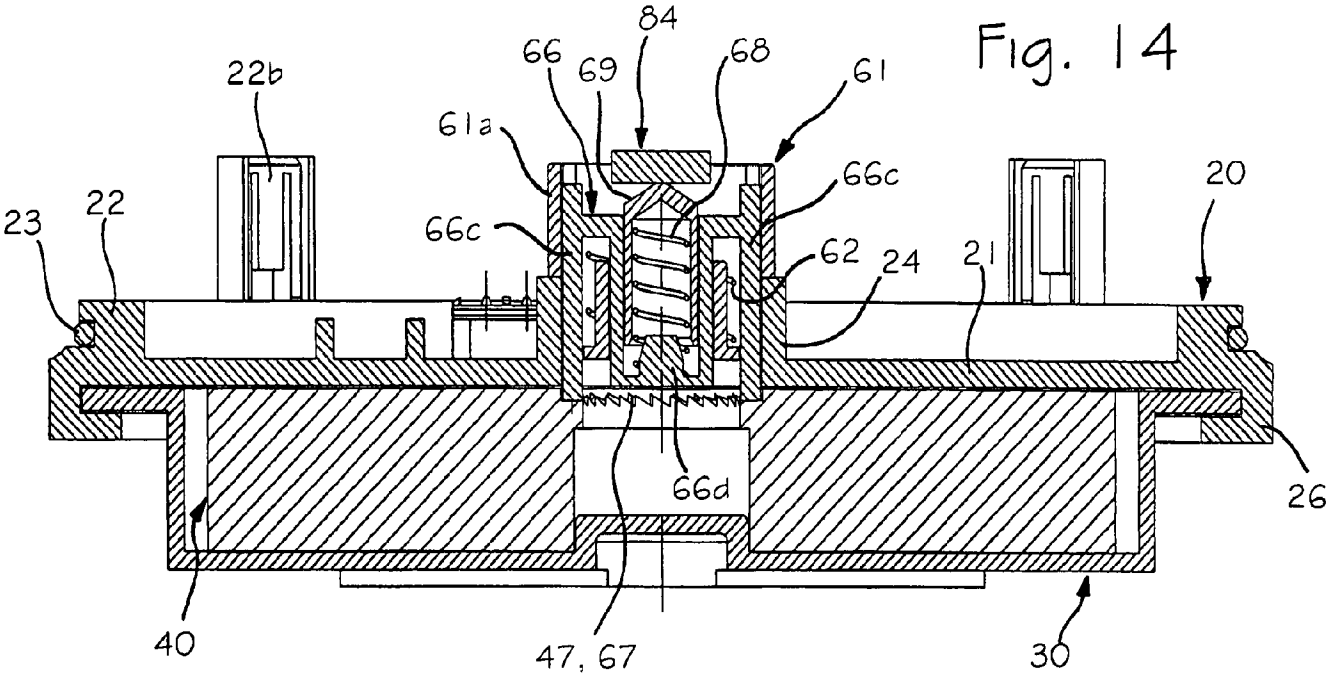
FIG. 14 is a schematic section, substantially perpendicular to the section of FIG. 13, but with the dispenser in the operative condition of FIG. 12.

In the assembled condition of device 10, as can be seen for example in FIGS. 12-14, the lower portion of member 61 is inserted into the cylindrical seat 24 of fixed body 20, with the shaft 51 of actuator 50 coupled to the projection 65; slider 83 is inserted into the respective slot 27, with the inclined-plane end 84 of the pressing member 84, which—in an inoperative condition of the manual control system—only partially overhangs the conical head 69*b* of closure element 69 (see FIG. 13). Spring 62 biases upwards the coupling element 66, with respect to member 61, with the former however being unable to come out of the latter, given the presence of the overhanging member 84; on the other hand, spring 68 biases upwards closure element 69, with respect to coupling element 66, with the former however being unable to decouple from the latter, given the engagement of fins 69*c* in the respective seats 66*e* (FIG. 11) and the presence of the overhanging member 84.

The dispensing device 10 according to the first embodiment operates in the following manner.

The drawer consisting of movable body 30 is pulled out or slid out from fixed body 20, thanks to the presence of sliding guide G formed by the peripheral rim 26; the magazine 40 is located in the housing portion 31 of body 30 such that the lower end of the tubular portion 41 of the magazine itself sits on the centring projection 35.

In the first embodiment at least one of the receptacles of magazine 40, indicated by 45*a* in FIGS. 2 and 7, is preferably empty of detergent; in line with this receptacle 45*a*, on the outer surface of the peripheral wall 31*a* of the magazine a depression or reference notch is provided, indicated by 48 in FIG. 13. In order for device 10 to function correctly, the empty receptacle 45*a* must be initially brought into line with aperture 33*a*;to this end, the user manually rotates magazine 40 within housing 31, until the tip of slider plunger 37*a* engages in the above-mentioned notch 48. At this point the movable body 30 is closed, i.e., made to slide along the guide formed by rim 26; at the end of the movement, seat 37 of the movable body 30 comes between lugs 28 (FIG. 5) of the fixed body 20.

In this phase slider 83 is kept by spring 15 in a retracted position, as can be seen for example in FIGS. 13 and 17, in which the inclined plane 84*c* of pressing member 84 is in contact with the inclined surface of the conical head of element 69. In this situation element 69, and therefore the coupling element 66 associated to it, are in a raised position, by virtue of the action of springs 62 and 68. As can be seen in FIG. 13, the teeth 67 of coupling element 66 lie within seat 24 of fixed body 20, without protruding below the main wall 21. The bistable kinematic mechanism comprising the recess 82 and the switching element 86 is in the condition visible in FIG. 15, in which cam-follower 86*b* is in a rest position with respect to a "heart-shaped" path defined by the cam recess 82.

After the closure of body 30, the user presses slider 83, overcoming the elastic reaction of spring 81, so as to cause it to slide linearly along slot 27; the movement of slider 83 brings about a corresponding advancement of pressing member 84, with its horizontal part 84*b*, which then thrusts downwards the unit formed by coupling element 66 and closure element 69, as can be seen for example in FIGS. 12, 14 and 18; this unit is allowed to reach the lowered condition thereof by the compression of spring 62, which is less rigid than spring 68.

Following the lowering of element 66, teeth 67 protrude downwards beyond the lower surface of wall 21 (see also FIG. 5) within the housing of magazine 40; teeth 67 are thus brought into engagement with teeth 47 of the underlying tubular portion 41 of the magazine, as can be seen in FIG. 14 or 18; note that, occasionally, lowering of element 66 can give rise to an engagement between teeth 66 and 47 which is not immediately exact (for example, teeth 67 might rest on the tips of teeth 47); in such situations, precise engagement is anyway achieved subsequently, as a result of the presence of springs 62 and 68 which bias element 66 downwards, once member 61 starts to rotate, causing element 66 to rotate with it, as described below.

As slider 83 advances, cam-follower 86*b* travels a first stretch of the "heart-shaped" path formed by the recess 82, such as the one represented in the upper part of FIG. 15; this is made possible by the elastic flexing of the central part of switching element 86. When the user ceases to press slider 83, the elastic reaction of spring 81 tends to cause the slider itself to retract, with cam-follower 86*b* thus reaching the position visible in FIG. 16, i.e. engaging with a seat formed in an intermediate zone of the above-mentioned path; cam-follower 86*b* remains in the attained position, thus keeping slider 83 and pressing member 84 in the respective advanced positions, as may be seen in FIGS. 12, 14 and 18.

Figure 41:
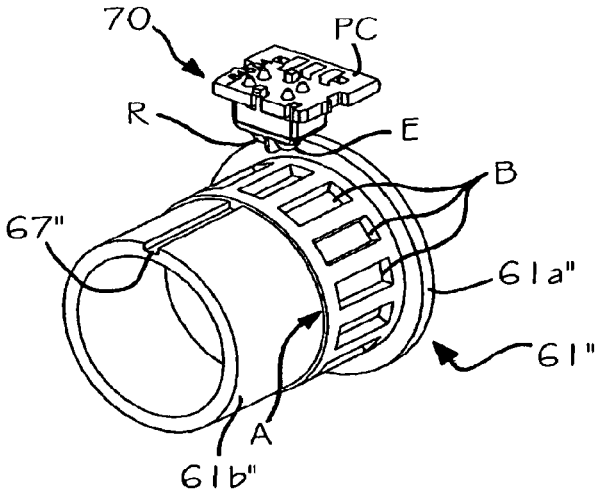
FIG. 41 is a perspective view of a transmission member and a corresponding detection system in accordance with a further possible variant embodiment of the dispenser according to the invention.

The optical sensor 70*a* shown in FIGS. 3, 12 and 13 has the function of detecting the presence or absence of the magazine 40, or whether the movable body or drawer 30 has been inserted correctly; as may be partially seen in FIG. 12 or 13, this sensor comprises an emitter of electromagnetic radiation E, such as a photoemitter or light emitting diode, and an electromagnetic radiation receiver—as may be seen in FIG. 41, where it is indicated by R—such as a photo-receiver, or light-receiving diode (or transistor); the above-mentioned emitter and receiver are both mounted on the same printed circuit board PC, fixed to the respective support lugs 21*a* of body part 21 (FIG. 2) and provided with connecting means (such as a connector or several terminals) for electrical connection to similar connection means of a wiring harness of the control system of machine 1, or of the dedicated detection and/or control circuit of device 10; the emitter and the receiver are mounted close to the upper surface of element 21*c*, made of transparent material, and are oriented at a mutual angle such that, upon presence of a sufficiently opaque surface in proximity to the opposite surface of the transparent element 21*c*, the latter functions substantially as a mirror: in this way, the radiation emitted by the emitter is reflected, in order to be detected by the receiver; conversely, in the absence of such an opaque surface, the transparent element 21*c* does not behave as a mirror and the radiation emitted by the emitter is not reflected towards the receiver, or is reflected at such an angle as not to excite the receiver. On the basis of this principle, sensor 70*a* is used to verify that magazine 40 is actually present in device 10. As may be inferred from FIG. 13, in fact, in the correct operating conditions, a section of the peripheral wall 42 of magazine 40 is positioned below the window corresponding to sensor 70*a*, so as to cause the radiation from the emitter to be reflected towards the receiver, according to the operating principle described above. On the other hand the absence of reflection, and therefore of excitation of the receiver, which occurs in the event that magazine 40 is absent, is detected by the above-mentioned control system or circuit, which then signals the irregularity to the user, for example by means of a warning lamp or a display on the control panel of the machine itself, or by giving an acoustic warning.

As previously stated, in the starting condition of use of device 10, the empty receptacle 45*a* is in line with aperture 33*a*. At the start of the washing programme performed by the dishwasher 1, the rotating sprinklers inside the washing chamber 3 begin to expel jets 7 of washing liquid; at least one of the holes or orifices in the upper sprinkler 5 of dishwasher 1 is oriented in such a way that, in the course of its rotation, the respective jet 7 cyclically strikes aperture 33*a*;in the initial phase of the washing cycle, therefore, the above-mentioned jet will be free to penetrate inside receptacle 45*a*, without this causing any delivery of detergent.

At a suitable moment of the washing cycle, the dishwasher's programmer or timer controls power supply to actuator 50, which results in a linear movement of shaft 51. The forward movement of shaft 51 brings about angular movement of member 61 and therefore of coupling element 66 which carries teeth 67 (as stated above, the side engagement lugs 66*c* of element 66 are engaged in guides 63 of member 61—see FIG. 11). Given the engagement between teeth 67 and 47, rotation of element 66 brings about an angular movement of magazine 40, according to a direction of actuation here described as "positive", aimed at bringing into line with aperture 33*a* a receptacle 45 immediately adjacent to the empty receptacle 45*a* (i.e. a receptacle full of detergent is brought to face aperture 33*a*).

The actuating force produced by actuator 50 is such as to allow notch 48 to disengage relative to the slider 37*a* (FIG. 13) and to overcome both the friction between the slider itself and magazine 40, and the friction between gasket 34 and magazine 40 (the result of the action of springs 62 and 68 being in fact to press magazine 40 onto the sealing surface of gasket 34).

In the first embodiment, the angular displacement of magazine 40 needed for a receptacle 45 to be brought completely at the aperture 33*a* is achieved through two activations of actuator 50 taking place; this non-limiting choice of implementation depends upon the type of used actuator, and in particular on the maximum stroke permitted for shaft 51.

The angular movement of magazine 40 achieved by the first actuation is such that only a first half of the full receptacle 45 concerned is made to overlap aperture 33*a*;for this reason, following said first actuation, both the second half of the preceding receptacle 45*a* (with reference to the above-mentioned positive direction of actuation), and the first half of the above-mentioned full receptacle, will be facing onto aperture 33*a*;following the second actuation, the final complete positioning of the full receptacle in line with aperture 33*a* is achieved. The operation of the transmission system for this purpose is shown in schematic form in FIG. 19.

Part A of FIG. 19 shows schematically the first activation of the actuator, with teeth 67 and 47 already engaged with each other; the angular movement of element 66, which carries teeth 67, causes the angular movement of magazine 40, which carries teeth 47. At the end of the first actuation, shaft 51 of actuator 50 returns to the initial starting position, also as a result of the presence of an elastic element inside the actuator, which is not visible in the figures; member 61, and thus element 66, perform an angular movement in a direction here defined as "negative", or opposite to the direction of movement produced during the first actuation; this movement in a negative direction does not however bring about a corresponding movement of magazine 40, both because of the direction of inclination of teeth 47 and 67, and because of the presence of slider 37*a* (see FIG. 13), which is kept by spring 37*b* against the outer surface of the peripheral face 42 of the magazine, exerting friction on it, wherein the force normally required to overcome this friction is greater than the force required to cause compression of spring 68 which is interposed between elements 66 and 69 of the transmission system: this means that during retraction of shaft 51 of actuator 50, the magazine 40, and therefore teeth 47, will remain substantially static, while element 66 will be able to move angularly in the negative direction; in the course of this movement, the inclined surfaces of teeth 67 slide over the inclined surfaces of teeth 47, with element 66 therefore moving progressively upwards, compressing spring 68; this situation is illustrated schematically in part B of FIG. 19; note that in this phase, closure element 69 remains in its axial position, given the presence on top of it of the pushing member 84: it is therefore element 66 which moves axially over element 69, as a result of the sliding coupling between fins 69*c* and seats 66*d* (FIG. 11).

At the end of the return movement of shaft 51 to the initial position, and therefore of the angular movement in the negative direction of element 66, the latter can return downwards, as a result of the action of spring 68, with teeth 67 slipping into the recesses between teeth 47, as illustrated in part C of FIG. 19. At this point the system is ready for the second activation of actuator 50, with which shaft 51 imparts angular movement to member 61 and element 66, and therefore for a further angular movement of magazine 40 in the positive direction of actuation, as illustrated in part D of FIG. 19.

When, in the above-mentioned ways, a receptacle 45 is brought partially or completely into alignment with aperture 33*a*, the respective dose of detergent is struck cyclically by the above-mentioned jet produced by the sprinkler 5; this produces a progressive dissolution of the washing agent, with relative delivery into the inside of chamber 3.

The device 10, the water circuit of machine 1 and the corresponding control system which manages the washing cycles can be arranged to suit the preferred implementation choices, in order to obtain—for example—complete delivery of a dose of detergent in a single phase of the washing cycle, or to obtain separate deliveries starting from the same dose, in respective phases of the cycle (i.e., for example, with a partial flushing of the detergent from one dose in one phase of the cycle, and a final flushing in a subsequent washing phase); another possibility again is to deliver several doses, i.e. the contents of several receptacles 45, in the course of a single washing cycle. As will become clear later, device 10 can also be managed by the control system of the washing machine in order for the delivery of the detergent to coincide with the performance of other operative phases, such as for example a phase in which the control system controls an increase in the action or the pressure of washing jets 7.

In the course of the delivery of a dose, it is preferable that the liquid which penetrates into aperture 33*a* should not be able to reach the receptacles 45 adjacent to the one from which the detergent is being delivered at the moment. According to an autonomously inventive solution, this isolation function is guaranteed at least by gasket 34, which operates close to aperture 33*a*, between magazine 40 and movable body 30.

As may be seen for example in FIG. 7, the sealing surface of gasket 34 is considerably larger than the profile of apertures 33*a* and 34*a*;in the case illustrated, gasket 34, too, has substantially the shape of a circular sector with an angular extension which is at least double—preferably at least triple—the angular extension of the circular sector which constitutes the section of apertures 33*a* and 34*a* and/or of each receptacle 45. Aperture 34*a* is located substantially in the centre of the outline (shaped like a circular sector) of gasket 34; as a result of the lateral extension of the sealing surface compared with aperture 34*a*, when the empty receptacle 45*a* is at apertures 33*a* and 34*a*, gasket 34 guarantees insulation with respect to the two receptacles 45 between which receptacles 45*a* is located, without the risk of contamination of the respective doses of detergent. When, however, only one half of a receptacle 45 containing detergent is temporarily exposed at apertures 33*a*, 34*a* (following the first activation of actuator 50), the liquid which penetrates into this receptacle cannot however reach the adjacent or previous receptacle (with reference to the direction of rotation of magazine 40) due to the part of the gasket 34 which extends angularly "upstream" of aperture 33*a*;in other words, in these conditions, a region of the receptacle concerned, not yet exposed (but into which the liquid could possibly reach by capillarity), and a region of the following receptacle are both bearing against a part of gasket 34, which thus exercises its sealing action; clearly the sealing effect is increased by the fact that the magazine 40 is pressed, as a result of the action of springs 62 and 68, onto the sealing surface of gasket 34.

As far as manufacture and principle of operation are concerned, optical sensors 70*b* and 70*c* are similar to sensor 70*a*, but are used for indicating to a user the absence or remaining number of doses of detergent present in magazine 40 mounted in device 10. To this end, windows 21*b* and 21*c* (FIG. 5) of each sensor 70*b*, 70*c* face onto a region normally occupied by a receptacle of magazine 40, with the corresponding dose of detergent functioning as an opaque body which is capable of causing the electromagnetic radiation to be reflected, according to the principle previously explained. In the course of the operating cycles of machine 1 which follow the installation of a new magazine 40, the receiver in sensor 70*b* or 70*c* is excited as long as there is not an empty receptacle 45 below it: when this circumstance does occur, the radiation from the emitter in the optical sensor is no longer detected by the corresponding receiver; the failure to excite the sensor is thus detected by the control system, which consequently proceeds to control a suitable signal, for example a visual or an acoustic signal, to be sent to the user. The windows for the two sensors 70*b* and 70*c* are in different angular positions, so that sensor 70*b* detects the status of the receptacle 45 which is immediately before, or upstream (with reference to the direction of rotation of magazine 40) of the one which is at the moment at aperture 33*a*, and sensor 70*c* detects the status of the receptacle 45 which is—for example—four positions previous to the one which is at the moment at aperture 33*a*;in this way, the failure to excite sensor 70*b* causes a signal indicating last dose or absence of detergent in the magazine for subsequent washing cycles, while failure to excite sensor 70*c* cause a signal intended to warn the user that there are still a minimum or particular number of remaining doses (three or less, in the example given) in the magazine.

In order to replace or refill an exhausted magazine 40, the user must first operate the above-mentioned manual control device, by pressing slider 83, thus causing it to move forward slightly. In this way, thanks to the elastic preload of the switching element 86, cam-follower 86*a* is released from the position shown in FIG. 16, and moves into the section of the "heart-shaped" path represented in the lower part of FIG. 15; when the user ceases to press the slider 83, the elastic reaction of spring 81 tends to cause the slider itself to retract, with cam-follower 86*b* being free to travel the above-mentioned lower section of the path, and therefore to return towards the position visible in FIG. 15. The slider 83, and therefore the pressing member 84, can retract into the position shown in FIG. 13 or 17, with elements 66 and 69 consequently moving into the respective raised position, and disengagement therefore taking place between teeth 47 and 67. Movable body 30 can thus be extracted from fixed body 20, and the exhausted magazine can be refilled or replaced with a new magazine 40, which will be positioned with the respective receptacle 45*a* at aperture 33*a*, in accordance with the procedure described earlier. This is followed by re-closure of the movable body 30 and re-switching of the manual control device.

Note that the control system previously indicated by 80 can possibly be arranged for exploiting the movement of door 4 of machine 1 for the purpose of switching the transmission system between the respective inoperative and operative conditions or positions; this solution avoids the risk of the dispenser 10 failing to operate, in the event that the user has forgotten to manually switch the control device.

It should also be underlined that provision in the magazine of a receptacle 45*a* which is empty of detergent right from the beginning is not strictly necessary for the purposes of the implementation of the invention (all the receptacles can be full if it is desired that a dose of detergent has to be delivered as early as the initial phases of a washing cycle).

FIGS. 20-26 illustrate a second inventive embodiment of a dispensing device; in these drawings—as also in the subsequent ones—the same reference numbers as in FIGS. 1-19 are in part used, to indicate elements technically equivalent to those already described.

In the case of the second embodiment, device 10 is equipped with an actuator of a different type from the previous one, and in particular a reversible electric motor, possibly with a reduction gear, and a transmission system with automatic switching from the inoperative to the operative condition, and vice versa, i.e., not requiring a manual switching device.

Figure 21:
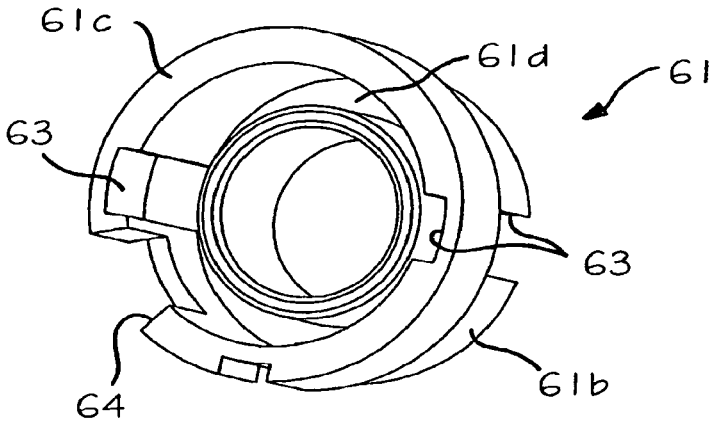
FIGS. 21-23 are perspective views of some components of a transmission system of the dispenser of FIG. 20.
Figure 22:
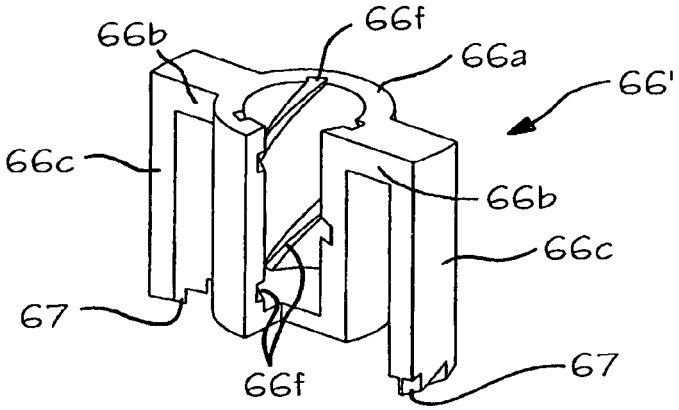

The above-mentioned motor, indicated by 50', comprises a rotating actuation shaft 51', at the distal end of which there is associated a transmission element 52, such as an endless screw, said shaft being substantially perpendicular to the axis of rotation of magazine 40. The transmission system further comprises a member 61' which, as can be seen in FIG. 21, is of substantially similar construction to member 61 of the first embodiment, and for this purpose comprises the axial grooves 63 and the upper groove 64. The coupling element also, indicated by 66', is of similar design to element 66 of the first embodiment; in this case, as can be seen in FIG. 22, one or more, preferably three, grooves, indicated by 66*f*, with a helical course, are formed in the cylindrical surface of the internal cavity of core 66*a*.

Figure 23:
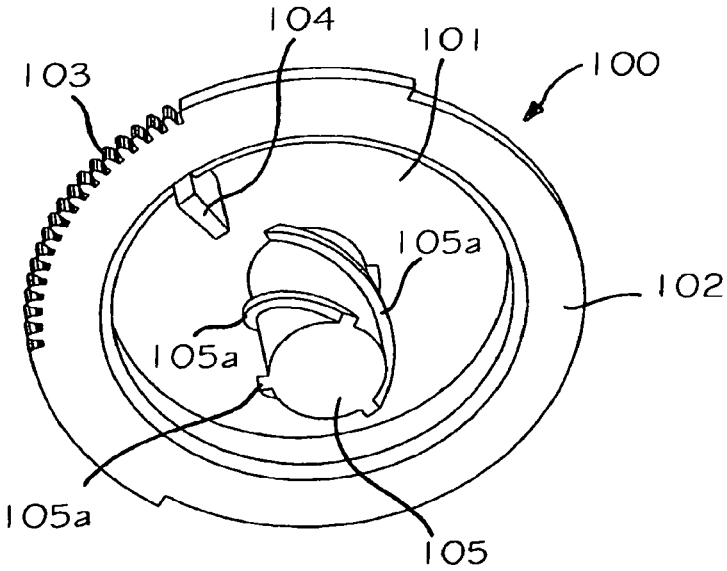

The system finally comprises an upper element 100, which, as can be seen in FIG. 23, has a head 101 with a circular flange 102, in whose peripheral surface a toothed sector 103 is formed, capable of engaging with the endless screw element 52. An appendage 104 projects from the lower surface of head 101, in a peripheral position, of dimensions which enable it to be received in the upper groove 64 of element 61'; from said lower surface, in a central position thereof, a substantially cylindrical shaft also projects, indicated by 105, on whose peripheral surface are formed projections 105*a* following a helical course, capable of being received in grooves 66*f* of element 66'.

In the assembled condition, member 61' is partially inserted into seat 24 in the fixed body part 20, with the engagement lugs 66*c* of element 66' inserted into the axial grooves 63 of member 61'; upper element 100 is mounted on the assembly thus formed, with appendage 104 engaged in the upper groove 64 of element 61', and with shaft 105 in the cavity of the core 66*a* of element 66, the helical projections 105*a* being coupled with the helical grooves 66*f*;the endless screw element 52 carried by shaft 51' of motor 50' is operatively coupled with the toothed sector 103 of upper element 100.

Figure 24:
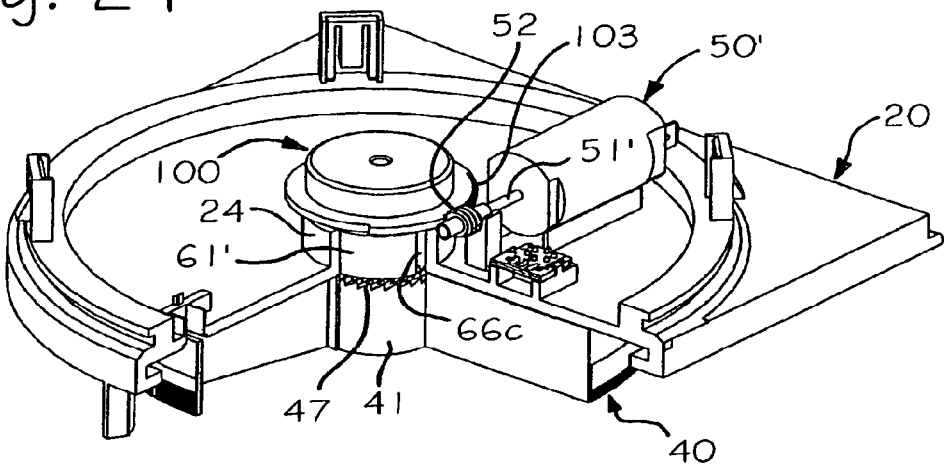
FIGS. 24-26 are partially sectioned perspective views of the dispenser of FIG. 20, without a respective cover, in three different conditions.
Figure 25:
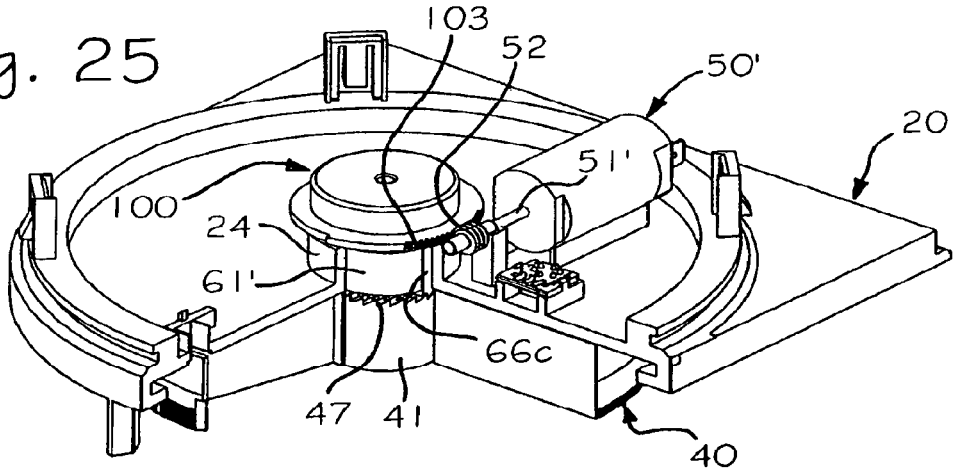

FIG. 24 represents the inoperative condition of the transmission system, in which endless screw element 52 is engaged in the initial section of toothed sector 103; in this condition, appendage 104 of element 100 is abutting against a side end of groove 64 of member 61 (FIGS. 21 and 23), while projections 105*a* are mostly engaged in grooves 66*f* (in other words, shaft 105 of element 100 is "screwed in" to the maximum extent into the cavity of element 66'). In this condition, teeth 67 of element 66' are uncoupled from teeth 47 of magazine 40, and head 101 of element 100 lies a little below the cover 90.

At the appropriate moment of a washing cycle, when the delivery of detergent becomes necessary, the control system of the machine 1 control power to be supplied to motor 50'; the rotation of shaft 51' and of endless screw element 52 causes the angular movement of upper element 100, producing as a result a progressive "unscrewing" or unthreading of the helical projections 105*a* and of their shaft 105 from the helical grooves 66*f* of element 66'; this relative movement is permitted by the fact that, in this phase, member 61' remains static due to friction (for this purpose, a suitable resilient element can be provided at the top of seat 24, made of rubber, for example) and it is thus impossible for element 66' to move angularly, given that its lateral lugs 66*c* are engaged in the axial grooves 63 of member 61. The progressive unthreading of projections 105*a* of shaft 105 with respect to the helical grooves 66*f* of element 66' brings about the lowering of the latter within member. 61' (element 100 cannot rise, due to the presence of the cover 90 and/or likely other positioning elements, not depicted): teeth 67 of element 66' therefore engage with teeth 47 of magazine 40. This intermediate condition is visible in FIG. 25; in the case illustrated, in this condition endless screw 52 is positioned about half way along the toothed sector 103.

Figure 26:
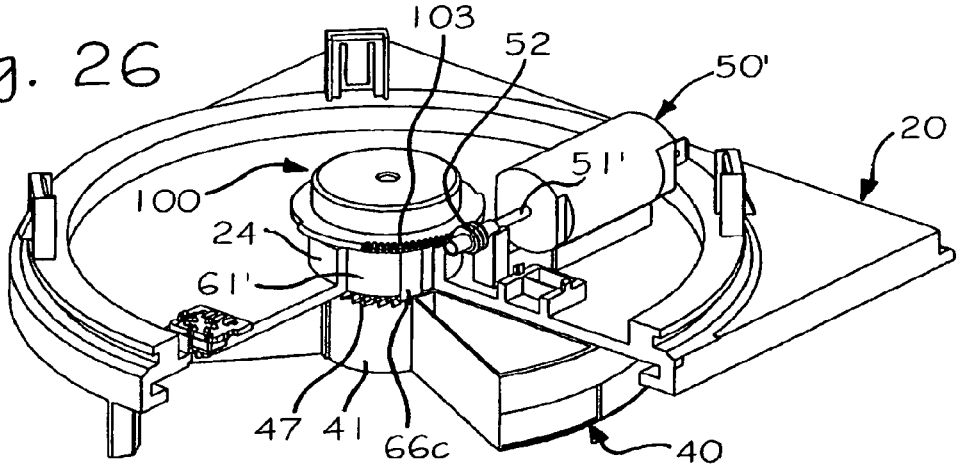

In the course of the angular movement of the upper element 100, appendage 104 moves within the upper groove 64 of member 61', until it abuts against the second longitudinal end of the groove itself, substantially coinciding with the engagement between teeth 67 and 47; thereafter, therefore, the angular movement of element 100 is transferred, through appendage 104, to member 61', which brings in rotation with it the engagement element 66'. Given the coupling between teeth 67 and 47, magazine 40 is thus made to rotate, as can be seen in FIG. 26, until the relevant receptacle 45 is brought into alignment with the delivery aperture 33*a*. When the delivery position has been reached, endless screw element 52 is in contact with the end of the toothed sector 103, i.e. in an end-of-stroke condition, and, for this reason, further rotation of shaft 51' cannot be converted into rotation of the upper element 100. This end-of-stroke condition brings about a peak of electrical absorption of motor 50', which is detected, by methods and means which are known per se, by the respective control system or circuit, which consequently controls interruption of the supply to the motor. Clearly, the fact that element 100 has reached the end-of-stroke position could also be detected in another way, for example with sensor means of a known type.

Subsequently to the delivery phase, the machine's control system controls motor 50' to cause a rotation of shaft 51' in a direction being opposite to the preceding one, in order to bring the system to the condition shown in FIG. 24; from this position, when required, a new delivery cycle can begin, or magazine 40 can be refilled or replaced when necessary.

In the course of the return to the inoperative position, the rotation of shaft 51' of motor 50', by means of the coupling between screw 52 and toothed sector 103, brings about an angular displacement of element 100, as a result of which shaft 105 is "screwed in" to element 66', causing it to lift; in this phase, element 61 does not rotate, because appendage 104 can move freely within groove 64, starting from its above-mentioned second extremity. In the second part of the angular movement of element 100, however, appendage 104 abuts against the first end of groove 64, thus being able to transfer the rotation movement to element 61, which brings element 66' into movement in its turn, and thus brings about a backwards rotation of teeth 67, with the initial position shown in FIG. 24 being restored.

As may be inferred, therefore, in the second embodiment, the commutation of the transmission system is achieved automatically, without the need for specific manual actions on the part of the user, with a sequence comprising:

a) an actuation phase in which:

a1) in a first phase of the angular movement of the transmission system in a first direction, teeth 67 descend (with axial movement), until they engage with teeth 47, and a2) in a second phase of the angular movement of the transmission system in the first direction, rotation of teeth 67 occurs, which is transferred to magazine 40, b) a reset phase in which:

b1) in a first phase of the angular movement of the transmission system in a second direction, teeth 67 return upwards (with axial movement), until they disengage from teeth 47, b2) in a second phase of the angular movement of the transmission system in the second direction, rotation of teeth 67 occurs, with the restoration of the initial position, without any movement being imparted to magazine 40.

The kinematics for automatically achieving the axial movement of the transmission system could also be of different type or configuration from that illustrated; for example, in place of reversible motor 50' a thermo-electric actuator of the type previously indicated by 50 could be used, with means for operatively coupling the shaft 51 thereof to the toothed sector 103, particularly by means of a rack with possible interposition of further kinematics capable of amplifying the useful stroke of the shaft itself.

Figure 29:
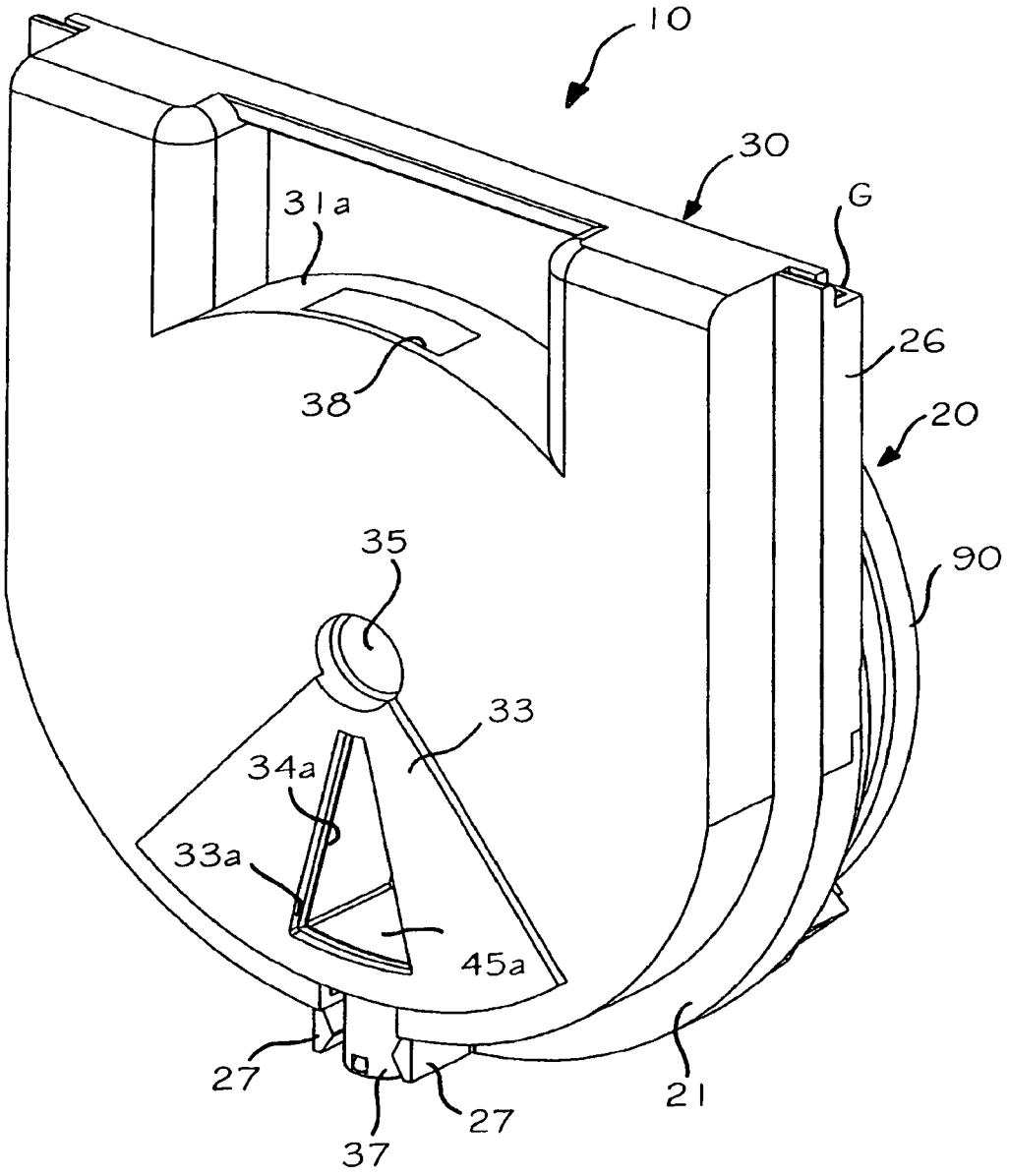
FIG. 29 is a perspective view of the dispenser of the machine shown in FIG. 27 or 28.

FIGS. 27-29 illustrate a third possible inventive embodiment, according to which device 10 is mounted adjacent to the top of the door liner of the dishwasher, indicated by 4*a*, i.e. the part which, with the door 4 closed, forms the front wall of the washing chamber 3. The device 10 illustrated in FIGS. 27-29 can be substantially structured as in the first embodiment or, as in the example provided, similarly to the second embodiment (without the need for a manual commutation device for the transmission system).

As may be inferred, particularly from FIGS. 27 and 28, door liner 4*a* preferably has a drawn area, in other words it is provided with a seat, at which the fixed body 20 of dispenser 10 is sealingly mounted, this area or seat being shaped to allow the upwards extraction of movable body 30, i.e., from the upper edge of door 4; when mounted, the dispenser is preferably flush with the front surface of door liner 4*a*, so as to reduce the bulk on the side facing the inside of the washing chamber. In this embodiment, clearly, jet 7 of liquid designed to produce dissolution and delivery of the washing agent will be oriented appropriately and differently than in the two embodiments described above.

In accordance with another autonomously inventive solution, the device according to the invention can be equipped with an indicator or signalling system, in order to visually indicate to a user that the magazine is actually present in the respective housing and/or the number of doses of detergent still in the magazine. This signalling system comprises essentially an optical indicator with suitable symbols and/or colors, which moves with magazine 40 to show the position of the latter, visible through a suitable window in body 20 or 30 of device 10. The above-mentioned optical indicator can be associated or fixed to the kinematic mechanism which actuates device 10, or directly to magazine 40. The latter case is illustrated in FIG. 29; in this figure, note that movable body 30 is equipped with a transparent window, indicated by 38, in the circumferential wall 31*a* of the housing for the magazine, in a position opposite to aperture 33*a*. Through this window 38, which in the assembled condition of device 10 is facing upwards, the user has the possibility of visually checking the remaining number of doses of detergent contained in magazine 40, reported by means of suitable indications.

Figure 20:
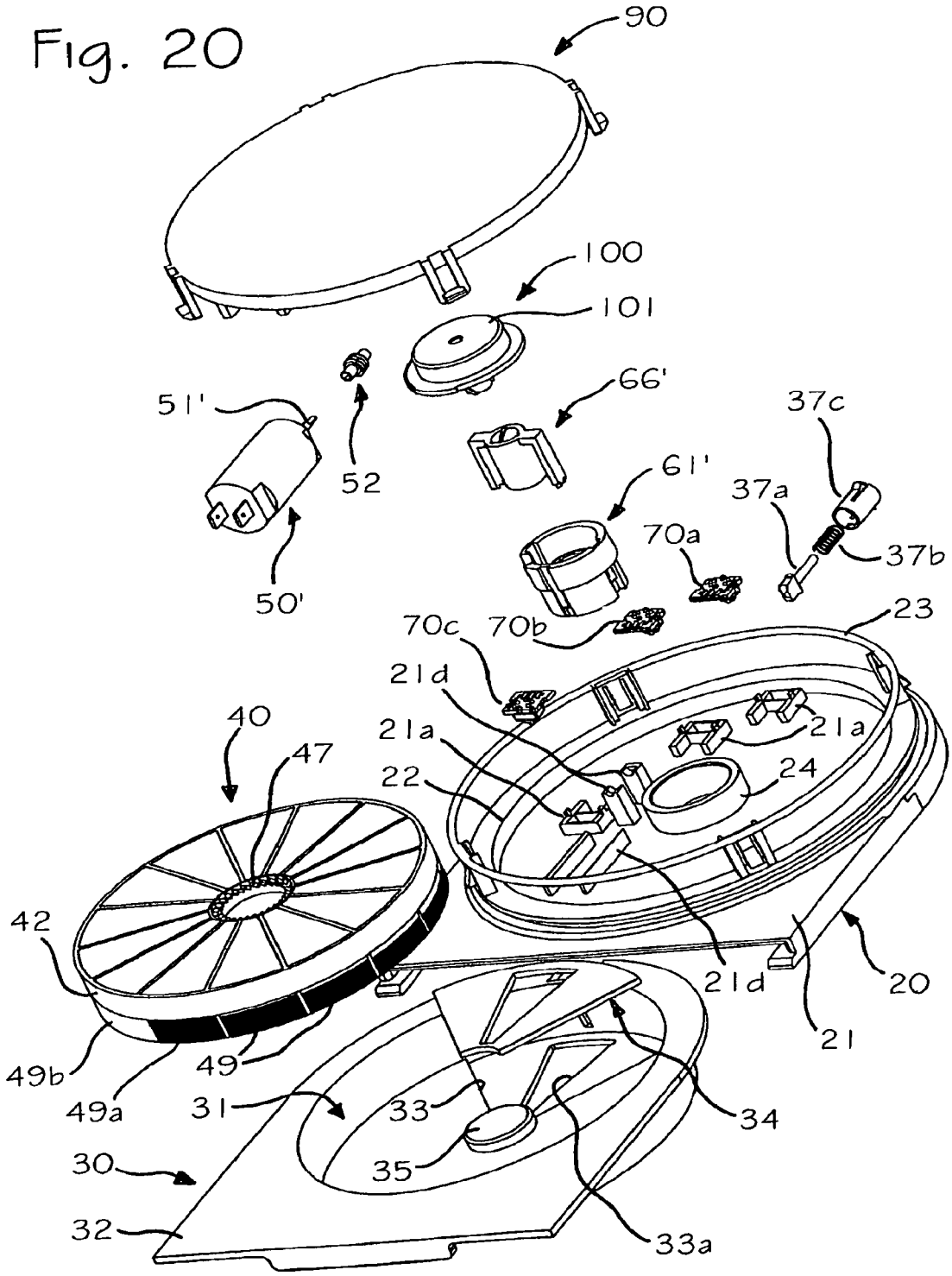
FIG. 20 is an exploded view of a dispenser made in accordance with a second inventive embodiment.

One possible example of these indications can be seen in the previous FIG. 20, where it may be noted that peripheral wall 42 of magazine 40 carries, or has imprinted on it, symbols, preferably of equal area, each of them corresponding to a respective receptacle; in the case illustrated, in which magazine 40 has fourteen receptacles, the following are provided:

twelve symbols 49, with the respective area made up of one region of a first color, for example green, and one region of a second color, for example red, which are indicative, respectively, of the number of doses available and the degree of exhaustion of the doses; in practice, in the example, the symbols 49 are each made up of two rectangles, one above the other, one green and the other red, where the heights of the two rectangles in the different symbols 49 are different;

a symbol 49*a* with the area completely of the first color (in the example, therefore, a rectangle of maximum height, completely green);

a symbol 49*b* with the area completely of the second color (in the example, therefore, a rectangle of maximum height, completely red).

In the example, the empty receptacle 45*a* is not provided, and the symbols 49*a* and 49*b* are associated with immediately adjacent receptacles; it is, however, evident that the solution is also applicable to the case of a magazine with an empty receptacle 45*a*.

At the time of loading into the relative housing of movable body 30, a new magazine 40 must be rotated manually into a predetermined position, substantially with procedures analogous to those used in the first embodiment, by means of the positioning system including seat 37, with the relevant slider 37*a* and spring 37*b* (see FIG. 13); in the above-mentioned predefined position, the window 38 will show the symbol 49*a*, green in our example, indicating the maximum number of available doses of detergent; this symbol also helps the user in the course of the operation of manually positioning the magazine 40, since it visually indicates the initial position.

Rotation of the magazine 40 will cause the symbols 49 to be displayed through window 38, with the green part becoming progressively smaller and the red part progressively larger, in order to inform the user visually, in an intuitive manner, about the progressive reduction in usable doses of washing agent; when the last receptacle 45 containing detergent is in line with aperture 33*a*, the receptacle in line with window 38 will be receptacle 49*b* (completely red), so as to warn the user about the need to replace magazine 40.

Naturally the above-mentioned symbols 49 can be of any type suitable for the purpose, graphic and/or alphabetical and/or numerical (for example in the form of decreasing numbering, so as to warn the user by means of a sort of "countdown", or by written indications of status, such as "full", "empty" etc.) and/or different colors or different shades, for example increasing and/or decreasing shades.

Note that device 10 in accordance with the embodiments described above can also possibly be installed on one of the side wall of chamber 3, preferably one provided with a respective recess, in a position intermediate between two crockery baskets.

Figure 30:
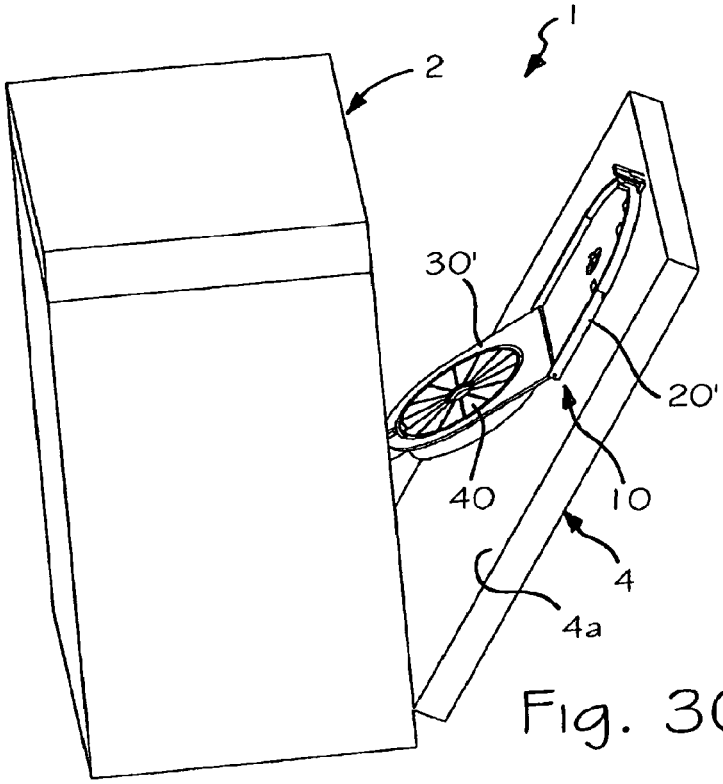
FIG. 30 is a schematic perspective view of a washing machine equipped with a dispenser of washing substances, made in accordance with a fourth inventive embodiment.
Figure 31:
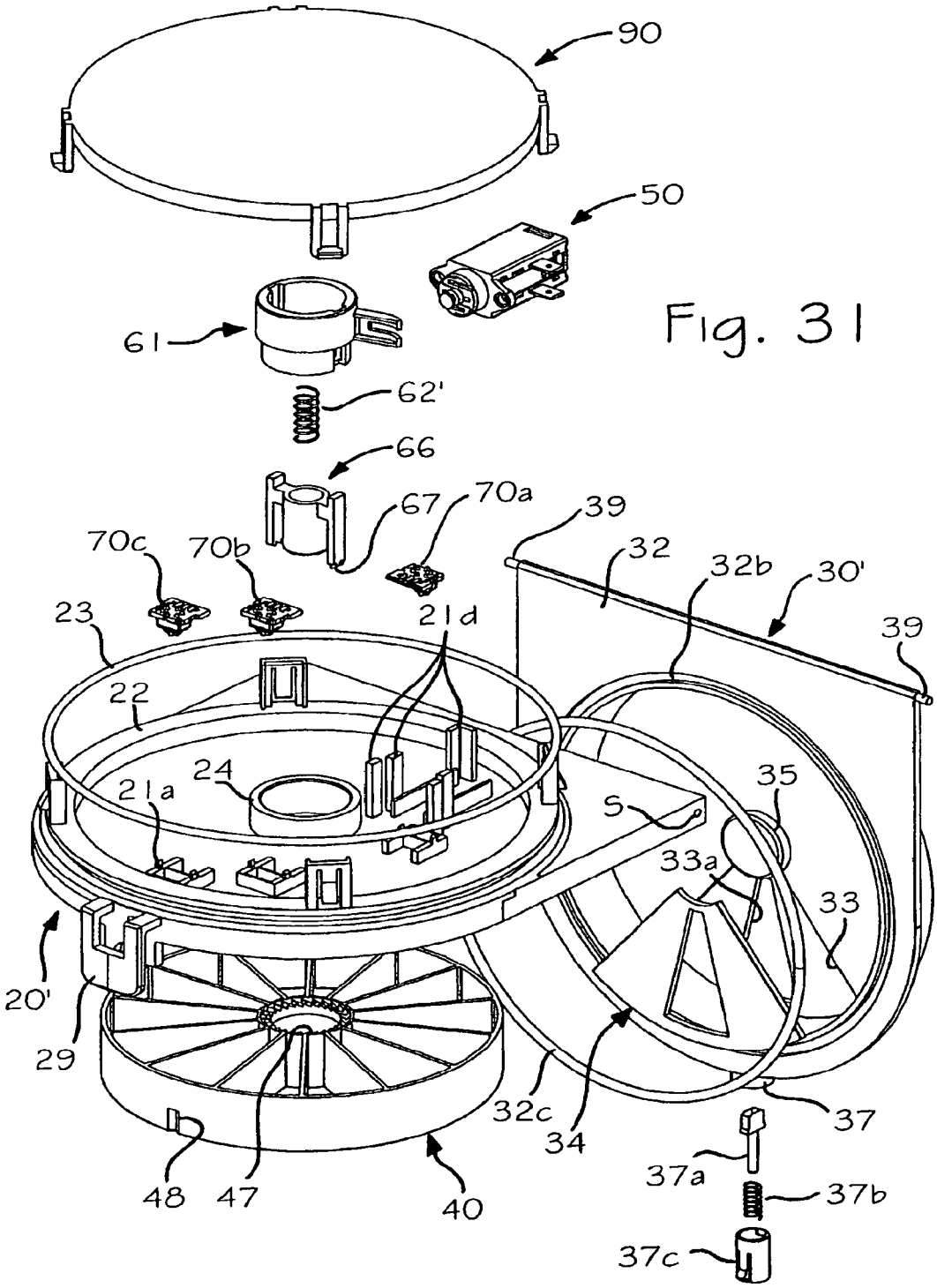
FIG. 31 is an exploded view of the dispenser of the machine of FIG. 30.

FIGS. 30 and 31 illustrate a fourth inventive embodiment, in accordance with which the movable body of the dispenser is hinged to the fixed body, so as to function as a tilting flap. This solution offers the possibility of mounting the dispenser in any position on the door liner or on a fixed wall of the machine's washing chamber, even in an area not being close to the front edge of this door or these walls; this option is particularly useful for the purpose of being able to better position the dispenser relative to the washing jets 7 and/or in a position where it does not interfere with a crockery basket or limit the basket's capacity. As may be seen in FIG. 30, in the example, device 10 is fixed to the door liner 4*a* of the dishwasher 1.

As may be seen in FIG. 31, the flanged portion 32 of the movable body, here indicated by 30', is provided with two hinge pins, indicated by 39, intended for insertion into respective seats S formed in the fixed body, here indicated by 20'. In this embodiment, on the face of the flanged portion 32 which is designed to face the fixed body 20' is also preferably provided an annular seat 32*b* for a gasket 32*c*. Fixed body 20' is equipped, on the side opposite the seat S, with a connecting wing 29, intended to cooperate elastically with seat 37, for the purpose of retaining the movable body 30' in the closed position, at the same time allowing it to be opened manually.

Also in the fourth embodiment device 10 is not equipped with the manual control device described earlier, because coupling and decoupling between the transmission system and the magazine 40 is achieved by exploiting the angular movement of opening and closing movable body 30'. As may be seen in figure 31, in this case the transmission system comprises only member 61, coupling element 66 and a spring 62', operating between a bottom of element 66 and cover 90 of device 10. Spring 62' biases constantly downwards element 66, in order to guarantee the engagement or coupling of teeth 67 with teeth 47 of the magazine 40, when movable body 30' is brought into the closed position; obviously, opening of body 30' also brings about disengagement between teeth 47 and 67. For the remainder, the operation of device 10 in accordance with the fourth embodiment follows similar procedures to those previously described. Spring 62' allows element 66 to be displaced as necessary towards cover 90, thus—when required by the operation—allowing teeth 67 to lift. In this way they can "ride over" teeth 47 by ways similar to those described earlier; spring 62' furthermore allows compensation for any tolerance of positioning of teeth 67 with respect to teeth 47 of magazine 40, particularly during the phase of closing movable body 30'.

Figure 33:
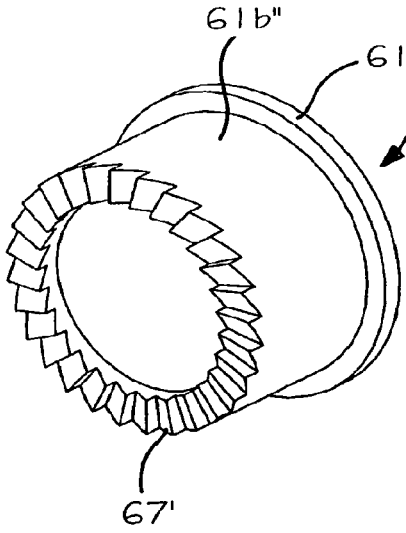
FIG. 33 is a perspective view of a component of a transmission system of the dispenser of FIG. 32.
Figure 34:
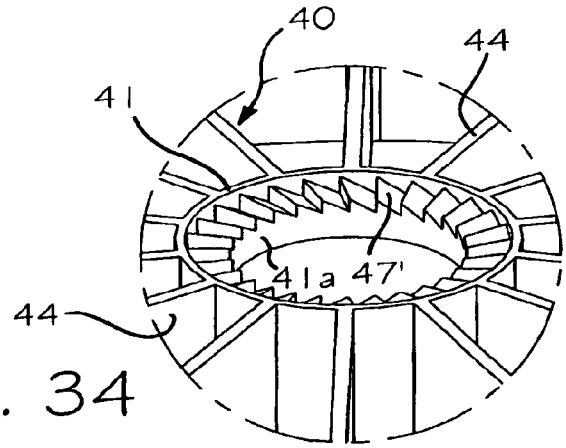
FIG. 34 is a detail of a magazine of the dispenser of FIG. 32, on a magnified scale.
Figure 32:
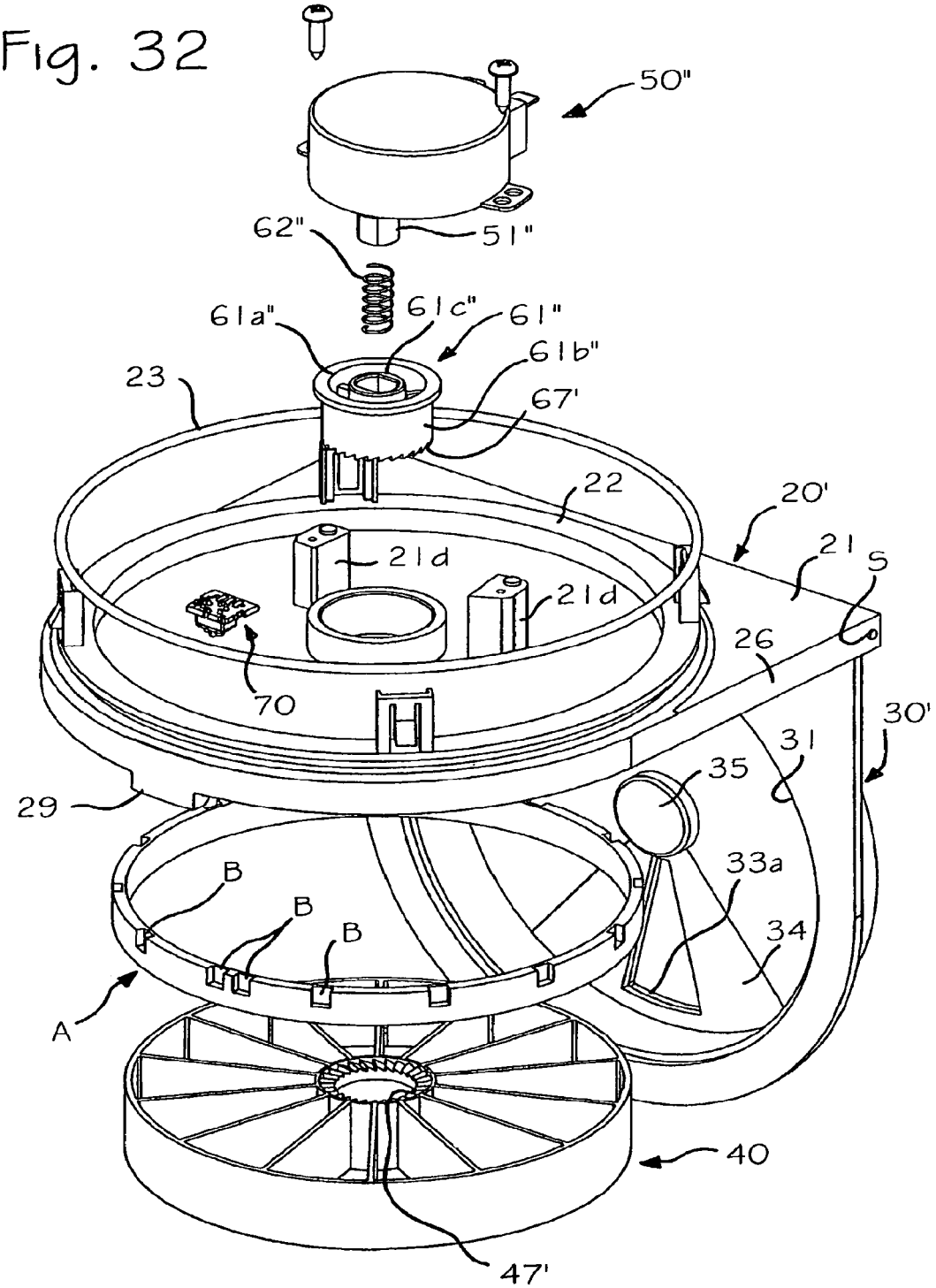
FIG. 32 is an exploded view of a dispenser of washing substances, made in accordance with a fifth inventive embodiment.

FIGS. 32-34 illustrate a fifth inventive embodiment, similar to the fourth embodiment, but using a different type of actuator and a different transmission system.

This embodiment provides for the use of an electric motor 50", possibly incorporating a reduction gear, having a shaft 51" substantially coaxial with the axis of rotation of magazine 40, and a tubular transmission member 61", whose body has an upper flanged part 61*a*", designed to rest on the upper end of seat 24 of the fixed body 20', and a lower cylindrical portion 61*b*", capable of insertion into the above-mentioned seat 24; cylindrical portion 61*b*" has at its lower edge a series of teeth 67', designed to cooperate with the teeth of the magazine, which are here indicated by 47'. Inside the cylindrical portion 61*b*" a central seat 61*c*" is formed, with a closed bottom, capable of receiving a spring 62" and an end section of shaft 51*a*" of motor 50", the seat and the shaft being of substantially complementary section and not circular; this configuration substantially allows a direct-drive connection between the motor shaft 51" and the tubular transmission member 61".

In this case the rotation of shaft 51" is transferred to the magazine by means of member 61" only, which is angularly movable and capable of slight axial movement, due to the presence of spring 62". Spring 62" constantly biases downwards member 61", in order to guarantee the engagement of teeth 67' with teeth 47' of magazine 40, when movable body 30' is brought into the closed position. Also in this embodiment, opening body 30' brings about disengagement between teeth 47' and 67'; note that member 61", sprung by elastic element 62" which is located between motor shaft 51" and the closed bottom of housing 61*c*", allows for compensating any slight positioning errors between teeth 47' and teeth 67' during insertion of the magazine; at the first actuation cycle, the position of the teeth automatically settles down, as in the previous embodiments.

Note also that the transmission system illustrated in FIGS. 32-34 lends itself to an actuation of motor 50" in a single direction of rotation, without the need for an actuation cycle with reverse rotation for repositioning member 61" (in any case, actuation of the motor with the reverse rotation to that of normal operation can be provided in case of necessity, in view of the presence of spring 62").

FIGS. 33 and 34 illustrate in greater detail teeth 47' and 67', which are of different conformation from the teeth in the earlier embodiments (i.e., with a straight front profile instead of a herring-bone profile), and different in number. In the present example also, the series of teeth 67' forms a complete ring, i.e., it extends around the entire circumference of cylindrical portion 61*b*"; note, moreover, that teeth 67' could be fewer in number and distributed differently.

Figure 35:
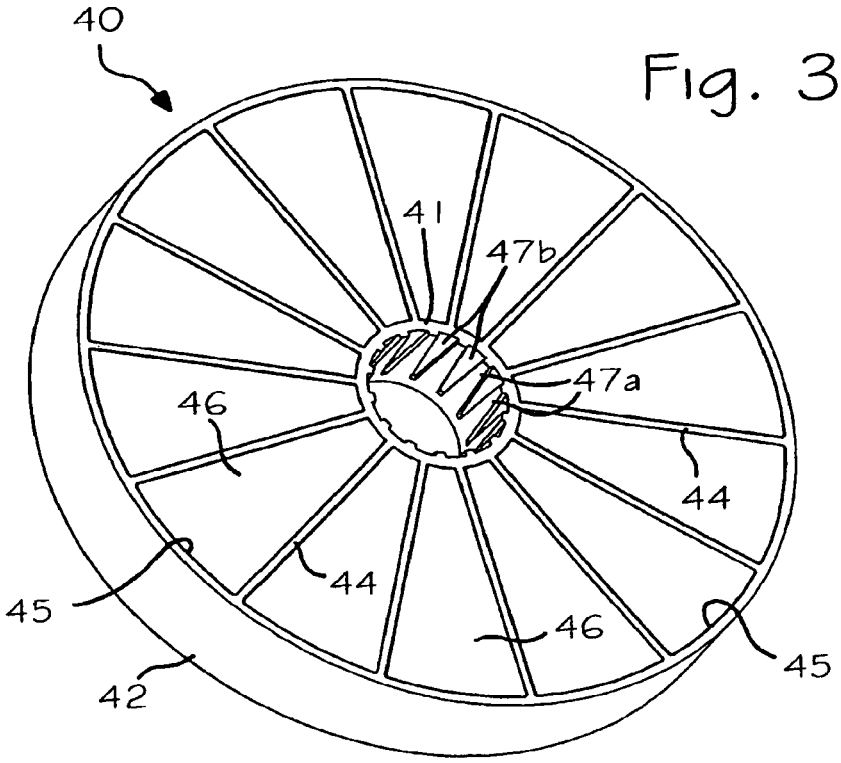
FIG. 35 is a perspective view of a possible variant embodiment of a magazine for a dispenser according to the invention.
Figure 36:
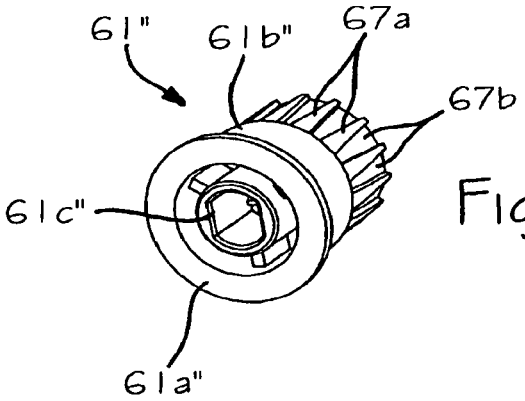
FIGS. 36 and 37 are two perspective views of a component of a transmission system in accordance with a possible variant embodiment of the dispenser according to the invention.
Figure 37:
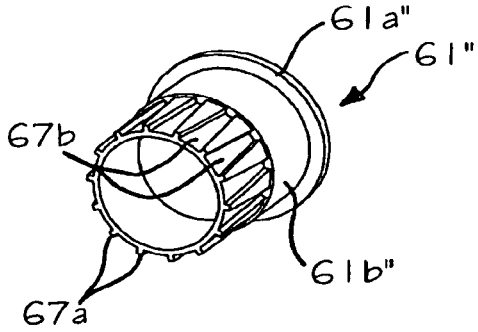

The shapes of the teeth or, more generally, of the separable coupling means between a drive member and a driven member of the various versions of the device according to the invention are interchangeable, and could possibly be of a different configuration from those illustrated here. For example, a further possible embodiment of the above-mentioned separable coupling means is illustrated in FIGS. 35-37, comprising in this case an alternate series of crests 47*a* and valleys 47*b* formed on the inner surface of the tubular central portion 41 of magazine 40, and a matching alternate series of crests 67*a* and valleys 67*b* formed on the outer surface of the lower cylindrical portion 61*b*" of member 61". Such an embodiment, in which the above-mentioned crests and valleys have preferably a profile substantially in the shape of a triangle or an isosceles trapezium, or with inclined profiles or planes, ensures an easy insertion and mutual centring between the moving parts. The example therefore shows a coupling executed in a predominantly radial direction with respect to the axis of actuation, instead of in a predominantly axial direction as in the previous versions (in practice, in this example, the coupling is of a substantially mixed type, partly of radial type and partly of axial type).

Figure 38:
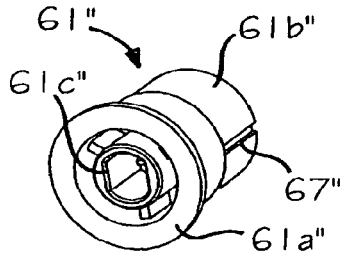
FIGS. 38 and 39 are two perspective views of a component of a transmission system in accordance with another possible variant embodiment of the dispenser according to the invention.
Figure 39:
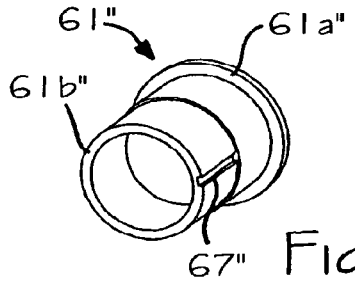
Figure 40:
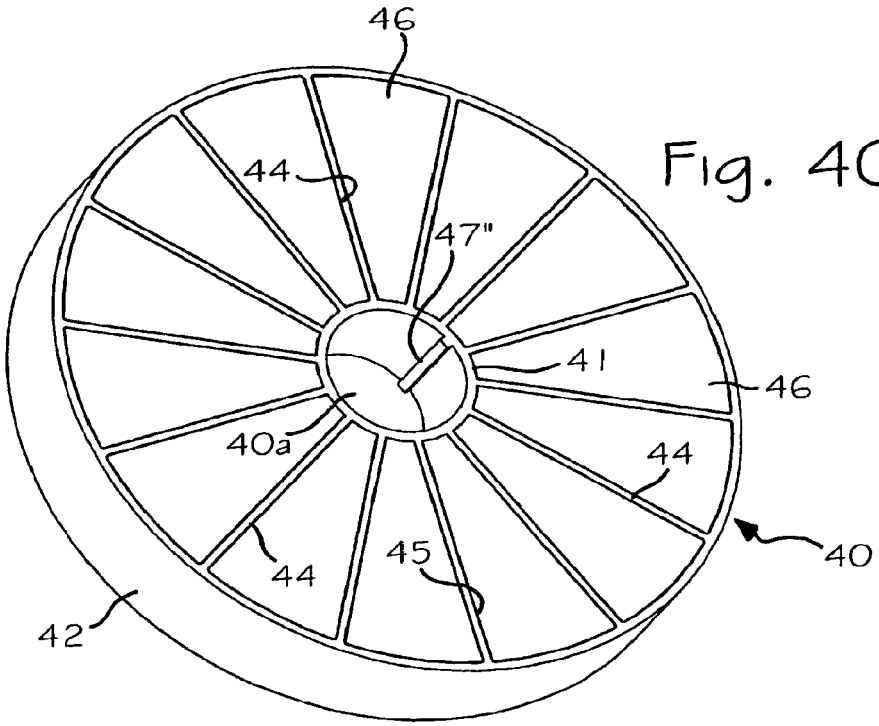
FIG. 40 is a perspective view of a magazine usable in conjunction with the component of FIGS. 38-39.

FIGS. 38-40 illustrate a further possible embodiment of the separable coupling means between the transmission member 61" and the magazine 40, of a different type from those previously illustrated. In this case, a groove or axial seat, indicated by 67", is formed in the outer surface of the lower cylindrical portion 61*b*" of member 61"; this seat 67" is capable of accommodating an axial projection 47" being of substantially complementary shape, formed on the inners surface of the tubular central portion 41 of magazine 40, as can be seen in FIG. 40. For the remainder, the operating principle of the actuating and transmission system is analogous to what has been described with reference to the fifth embodiment.

The coupling systems illustrated in FIGS. 35-37 and 38-40 are particularly indicated for cases where the dispenser according to the invention is arranged so that the magazine is manually engaged on the transmission member 61", as in the embodiment described below with reference to FIG. 43-45 or 49-51. In these implementations, the transition of the actuation or transmission system between the respective operative or inoperative conditions is therefore achieved by removing and inserting the magazine relative to housing 31, particularly through manual operations by the user.

In an advantageous embodiment, the detection system or device, particularly of the presence and/or position and/or movement of magazine 40, can be configured to cooperate with a movable member of dispenser 10 other than the magazine. One example of detecting the position of magazine 40 is shown in FIG. 41, in combination with a transmission member of a type similar to the one previously indicated by 61" in FIGS. 38 and 39.

In accordance with a solution which is in itself inventive, the above-mentioned detection system comprises a position and/or movement transducer, particularly of the "encoder" type, i.e., a device capable of coding and/or detecting status conditions of the magazine 40, such as its angular positions, translating them for example into data of digital type.

The above-mentioned detection system is preferably arranged for detecting at least one position during and/or following a movement, particularly of at least one transmission member of the dispenser and/or of a relative support for the doses of substance.

As will be seen, in the example now described, the detector comprises a single sensor but, in other possible embodiments, the encoder system can comprise a plurality of sensors or similar electronic detection components. In the example, a sensor of digital type is described, but in other possible embodiments a transducer of analog type can be used, or again a combination of analog and digital transducers.

The case illustrated in FIG. 41 refers to an optical encoder, particularly of the incremental type, and comprises a single sensor 70, operating as a detection unit, being of a construction analogous to sensors 70*a*-70*c*, and a detection or excitation ring or crown, indicated by A, mounted or formed on, or attached to, the body of member 61", particularly on its cylindrical part 61*b*"; ring A is codified by means of a series of notches or cavities B on its cylindrical wall, which open radially. These notches or cavities, which constitute excitation elements for sensor 70, can naturally be of a different type from the one illustrated, for example in terms of orientation and/or structure. Ring A can possibly have a different shape from the one represented, for example differentiated by proportional dimensional variations or variations which can be associated to the various angular positions, similarly to what will be described below with reference to examples of transducers of analog type.

Sensor 70, which is preferably mounted close to a respective transparent window (not represented), formed in body 20' or in seat 24, faces onto the region of ring A in which there are recesses B; member 61" could even be shaped or mounted in such a way that the detection ring A extends to the outside of seat 24, in the protected or inner part of the device, in which its electrical components are positioned.

In the event of a recess being in front of sensor 70, the radiation from the respective emitter will not be reflected to the receiver; conversely, in the event of a solid part being in front of sensor 70, the receiver thereof will be excited. On the basis of this operating principle, it is possible to detect the movement and angular position of member 61", and therefore of magazine 40, it being expected that member 61" and magazine 40 are associated in a univocal position, given the type of coupling between housing 67" and axial projection 47" of magazine 40 (see FIG. 40).

Clearly, in this implementation, ring A is codified, by way of schematic example, by means of recesses B, depending on the type of information which it is desired to provide to the user (rotational speed of magazine, magazine exhausted, magazine still containing "n" doses, direction of rotation, etc.); the same or a different coding can, however, be suitable for the reading of several pieces of information, even of different types.

The control system of machine 1 or the dedicated detection and/or control circuit of device 10 is on the other hand arranged for counting and interpreting the pulses or signals detected by sensor 70, for the purpose of managing the correct movement of the magazine and/or providing the necessary indications, preferably storing the information or counts, particularly in a non-volatile memory. For example, by detecting only the number of pulses, it is possible to determine which is the receptacle/dose positioned at the delivery aperture, while by detecting the point of transition of the signal from one status to another (for example from a lower-voltage electrical level to a higher-voltage electrical level) it is possible to determine also the exact angular position of the magazine. The position of the recesses B is therefore such as to allow the control system to be able—for example—to stop the motor 50" when a receptacle 45 or dose 46 is perfectly positioned or centred on the delivery aperture 33*a*.

Note that the recesses B could be replaced by reliefs on ring A, or be different in number and/or position from what is illustrated; ring A could also be codified by an alternation of opaque and transparent or reflective sectors, as well as by crests and/or valleys with an opaque surface; in this case, at least ring A, or the movable part of the dispenser which is integral or made integral with it, could be formed of transparent material, with opaque inserts at the points of interest, for the purpose of exciting the sensor 70, or it would be possible to fit or integrate an insert or ring made of a reflective material, with covered or obscured sectors.

The position and/or movement transducer or encoder system described above is of the incremental type, i.e., adapted to detect a series of pulses or signals following the rotation of member 61", where the data relating to the position of the associated magazine is the result of a sequential count of such pulses, carried out by the control system that manages operation of the dispenser. This type of detection preferably requires the storage of the position and/or movement data in a non-volatile memory means, in order for it to be possible to preserve the information when the washing machine is switched off or in the case of a momentary absence of electrical supply.

To this end, in a variant not illustrated, transmission member 61" and/or the respective excitation ring A make at least part of an encoder detector of absolute type. i.e., of the type capable of generating a univocal code for each angular position of the controlled member. In this variant, for example, ring A of member 61" can provide a number of valleys and/or crests greater than is shown in the figure, adapted to generate coded data having in particular the purpose of defining exactly the angular position of the member itself, and therefore of the corresponding magazine. In this variant, each angular sector of member 61"—preferably corresponding to a respective angular sector of the used magazine—can be associated with a unique code, for example of binary or Gray type. In this type of absolute encoder it can also be advantageous to provide a second series of valleys and/or crest on member 61" and a respective second sensor, to substantially provide a "clock" signal, in order to synchronise the reading of the above-mentioned coded data. To this end, two sensors 70 placed side by side can actually be provided, and two series of valleys and crests, these too being side by side, wherein one sensor reads the coded position data (generated by the first set of valleys/crests) and the other sensor reads the synchronisation signal (generated by the second set of valleys/crests). Note, however, that said synchronisation sensor or signal could also be omitted, only the coded data being read, for example with a check in relation to time, preferably with reference to the speed of movement or rotation of the motor and/or of the excitation means or element represented by ring A, such as for example predefined values of speed of rotation or movement.

The use of an absolute type of encoder has the advantage of not necessarily requiring the count of the pulses generated by the excitation means to be stored in a memory, as preferably occurs in the case of an incremental encoder, with a consequent saving in the electronic control circuit or system.

The solution with a detection device or system, and particularly with an incremental or absolute encoder, also avoids the need for magazine 40 to be manually brought to a particular angular position at the time of loading, because the control circuit or system can be configured—if necessary—to control motor 50" autonomously, to position magazine 40 in the predefined starting position, thanks precisely to the presence of the detection system.

In the first operating cycle following installation of a new magazine, the above-mentioned control system or circuit proceeds to control a rotation or movement of motor 50" until it detects the above-mentioned starting position, indicated, for example, by two cavities B closer together than the others, or by means of a binary or Gray code corresponding to the data of the starting position. Starting from this point, the control system provides for detecting and/or counting—with elaborations if required and with likely storing in a non-volatile memory means—the various pulses generated by sensor 70 as a result of the rotation of the motor, and therefore of the magazine, corresponding to the delivery cycles, with the consequent possibility of signalling the approach of the exhaustion of the magazine itself, or its final exhaustion; clearly, sensor 70 (or said pair or plurality of sensors 70, for example in the case of some versions of absolute encoder) is also suitable for detecting the centring of a compartment over the discharge aperture. The control system or circuit is naturally programmed and arranged for the above-mentioned purpose: in one embodiment, for example, information relating to the fact that a new full magazine has been placed in device 10 can be provided manually by the user, for example by operating a control means (such as a button). Alternatively, the dispenser can be equipped with further sensing means, for example optical, for independently detecting the replacement of an exhausted magazine.

Advantageously the appliance to which the dispenser is fitted is capable of detecting and/or indicating to the user the quantity or status of the magazine or support, particularly as a result of detection of the position or movement of the magazine or support in the dispenser.

Excitation ring A can possibly consist of an independent or removable element with respect to the part of the dispenser fixed to the domestic electrical appliance; for example, such an excitation ring A can be mounted or associated in a removable manner, to be moved directly or indirectly by a movable member of the actuation/transmission system of dispenser 10. According to another solution, it is possible to removably connect or mount ring A, or a different excitation element which replaces it, directly onto magazine 40. This last possibility, which also is itself inventive, is shown in the previous FIG. 32, in which a ring A is provided, which is designed precisely to be associated or mounted to magazine 40, codified by means of a series of notches or cavities B along its circumference, which open at the upper face of the ring itself (FIG. 32 illustrates an excitation ring for an incremental encoder, but the same concept is clearly applicable in the case of an encoder ring of absolute type, or in the case of an excitation ring of other type).

Sensor 70 in this case is mounted adjacent to a respective window (not represented) formed in wall 21 of the fixed body of the dispenser, and faces onto the area of ring A in which the notches B are located. Clearly, in this case sensor 70 is also suitable for detecting the presence of magazine 40, according to the methods explained earlier.

The detection system can be of different type from the one illustrated, and comprise for example a magnetic sensor, instead of an optical sensor, or with a position sensor which detects a magnetic field or a variation in magnetic field.

Figure 42:
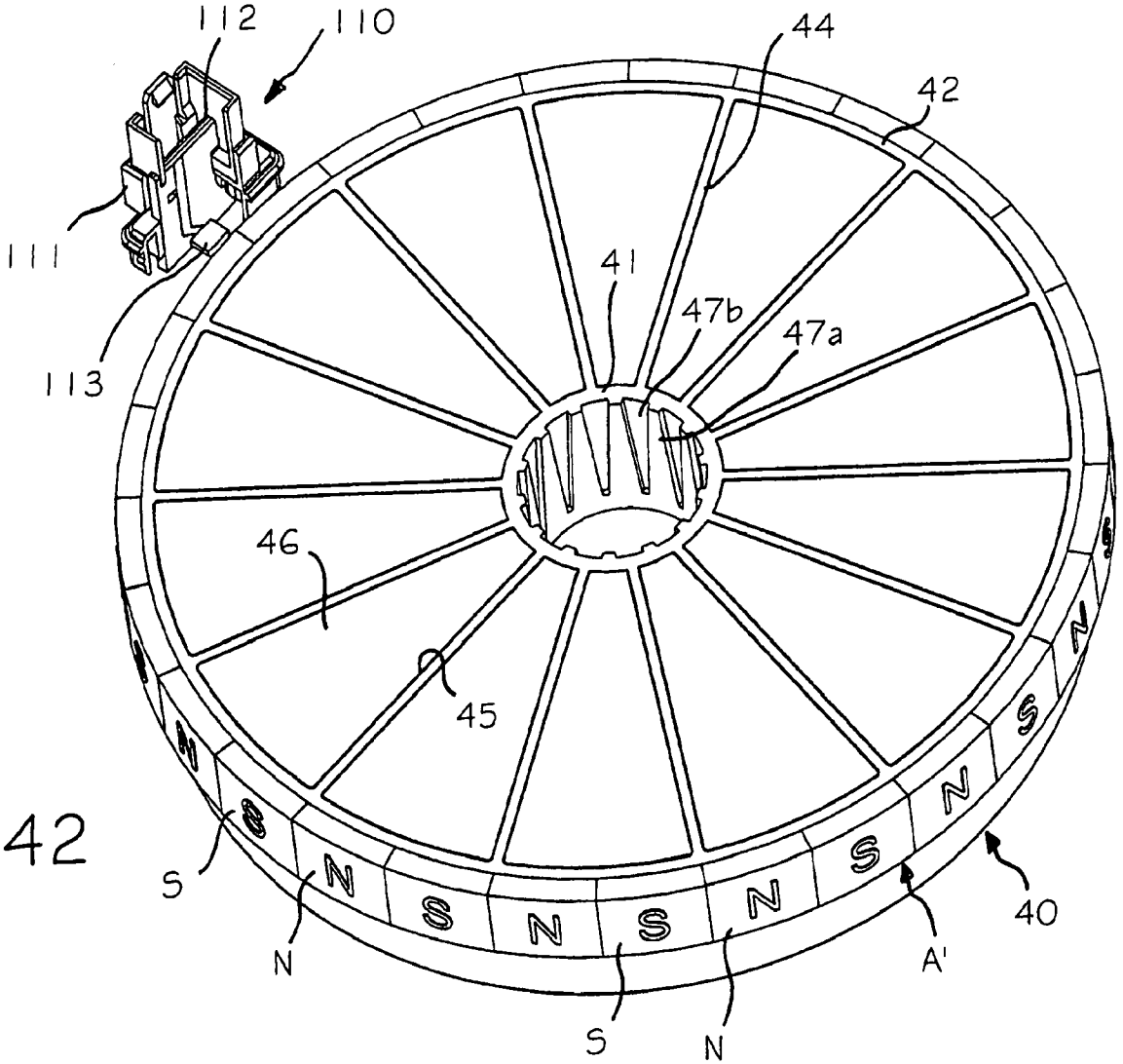
FIG. 42 is a perspective view of a magazine and a corresponding detection system in accordance with a further possible variant embodiment of the dispenser according to the invention.

One possible version of a detection system with an encoder with magnetic sensor is shown in FIG. 42, which represents a magazine 40 which is associated to a peripheral ring A', coded by means of sectors or discrete N and S areas, permanently magnetised to a greater or lesser degree, and a magnetic field sensor or detection unit 110, designed to be associated to the fixed body of the dispenser.

In the case illustrated, ring A' is magnetised in alternate sectors, i.e., with alternated North and South polarities, and the magnetic detector 110 is a Hall effect detector (but it could possibly be of another type, such as a magnetic Reed, an inductive sensor or other type); naturally, ring A' could be of any other type other than the one illustrated, provided always that it has the capacity to induce a signal, such as magnetic or inductive variations, in a suitable sensor. Note that some sensors usable in the application here proposed, for example of inductive or Hall effect type, comprise a permanent magnet inside the sensor itself, which continuously excites the sensing element; the approach or retreat of a mass of metal, for example in the form of iron inserts or teeth in a phonic wheel, thus induces a variation in the permanent magnetic field, which is detected by the sensor. In other words, therefore, in these variant embodiments the excitation ring does not directly generate an excitation field, but is limited to perturbing it; for this purpose, therefore, the functions of ring A, A' could be performed by a suitably profiled metal ring or by inserts made of a non-magnetised ferromagnetic material.

Ring A', or the part of the body of the magazine on which it is mounted or incorporated, can be for example made of plastoferrite, i.e. a thermoplastic material moulded or overmoulded with the desired shape and then magnetised in the preferred manner and direction (number and position of sectors, direction and polarity of the magnetic field of the sectors, etc.), also in a different shape from the one depicted.

Obviously the above-mentioned sectors, arranged to line up with receptacles 45, could be replaced by magnetised or ferromagnetic inserts in ring A' or in the body of the magazine 40.

In the case illustrated, detector 110 comprises an external body 111 (represented partially sectioned), preferably made of an insulating material, such as a thermoplastic material, which also forms part of an electrical connector, into which there is inserted a printed circuit 112 which carries a magnetic Hall effect sensor or chip 113; the printed circuit 112 also forms part of the above-mentioned electrical connector, by means of electrically conductive tracks present on it; detector 110 can possibly include or incorporate an electronic circuit, for example an analog and/or digital circuit for signal transformation or amplification or filtering or control; and the magnetic sensor 113 can be of analog or digital type.

Clearly, also a detector or an encoder of magnetic or inductive type can be operatively associated, rather than the magazine 40, to a member of the dispenser's actuation/transmission system, such as for example member 61", similarly to the case of FIG. 41, or in the case of an independent/removable excitation element, similarly to the case shown in FIG. 32. Also in the case of a detector of magnetic type, the excitation elements could be present in numbers and arrangement such as to form at least part of an encoder of absolute type.

It will furthermore be appreciated that, in the case of the use of a system of detection of the presence and/or movement and/or angular position of the magazine based on inductive or magnetic field sensing means, it is not necessary to provide windows of the type indicated by 21*b*-21*c* in FIG. 5, and that the upper wall 43 of magazine 40 (FIG. 10), if present, does not necessarily have to be transparent (note that magnetised or ferromagnetic inserts could be provided on or in this wall 43, in line with the receptacles, in order to excite a sensor mounted in the upper region of the fixed body of the device).

Ring A or A', when designed for being mounted on magazine 40, is preferably equipped with means, such as hooks or projections, capable of making it integral with the magazine itself, in a predefined position. This solution allows a user, for example, to easily fit this ring A or A' onto the support or magazine 40 and/or to remove it, as in fitting to a new magazine and/or removing from an exhausted magazine, to enable the ring itself to be subsequently reused.

For this purpose, for example, ring A, A' can be fitted with interference on magazine 40, in a unique position determined by seats and/or projections between the parts. The ring can include parts or projections capable of being inserted into, or coupling with, the magazine, to determine the exact mutual positioning. In an example not illustrated, for example, the ring has a part capable of being inserted at least in part into a receptacle, preferably the empty receptacle 45*a*, so as to make this position coincide with the respective notches for zeroing the encoder; the same part preferably extends far enough to make contact with the two dividers 44 which delimit the empty receptacle 45*a*, so as to determine the exact angular positioning.

Figure 43:
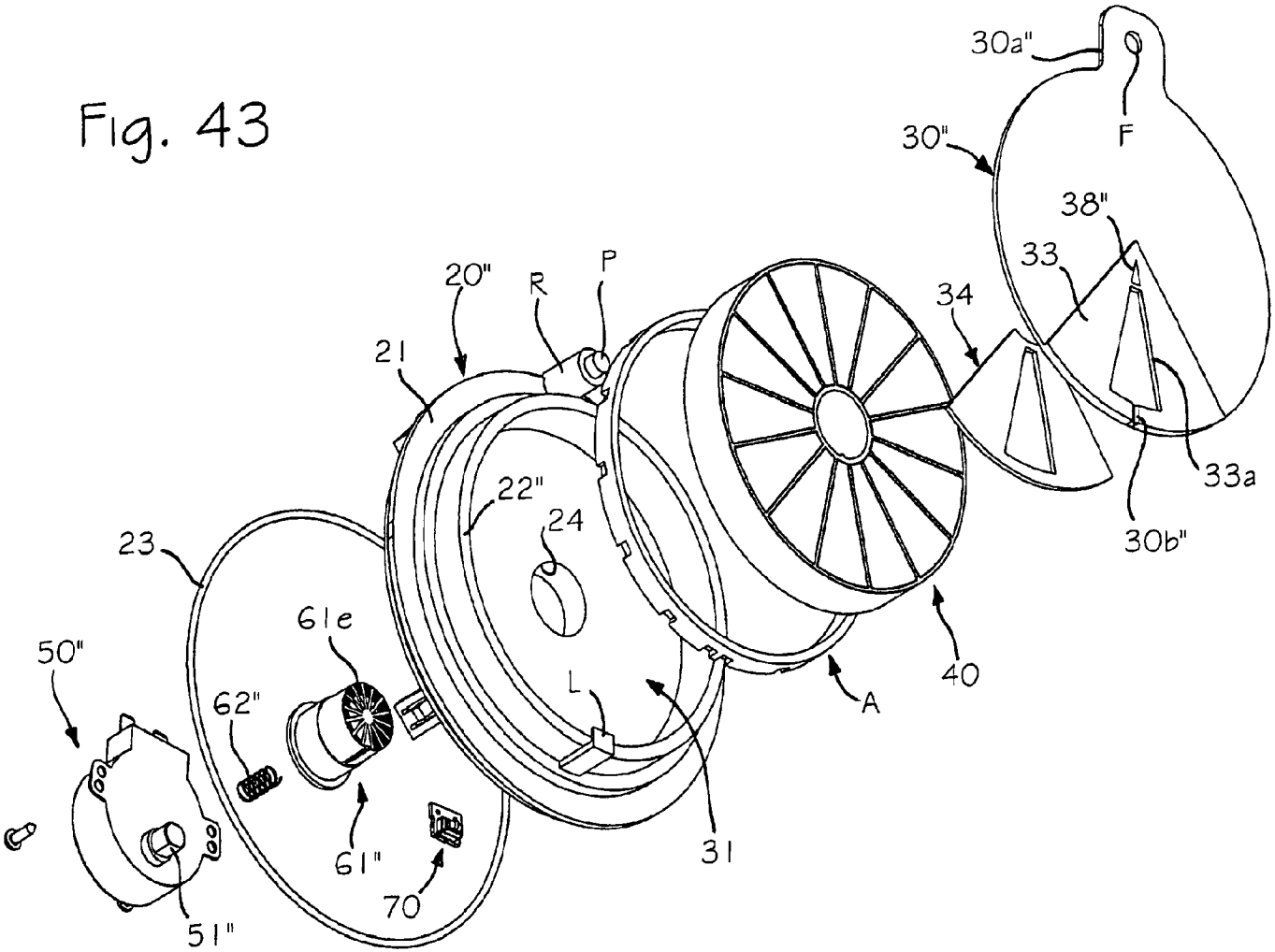
FIG. 43 is an exploded view of a dispenser for washing substances, made in accordance with a sixth inventive embodiment.
Figure 45:
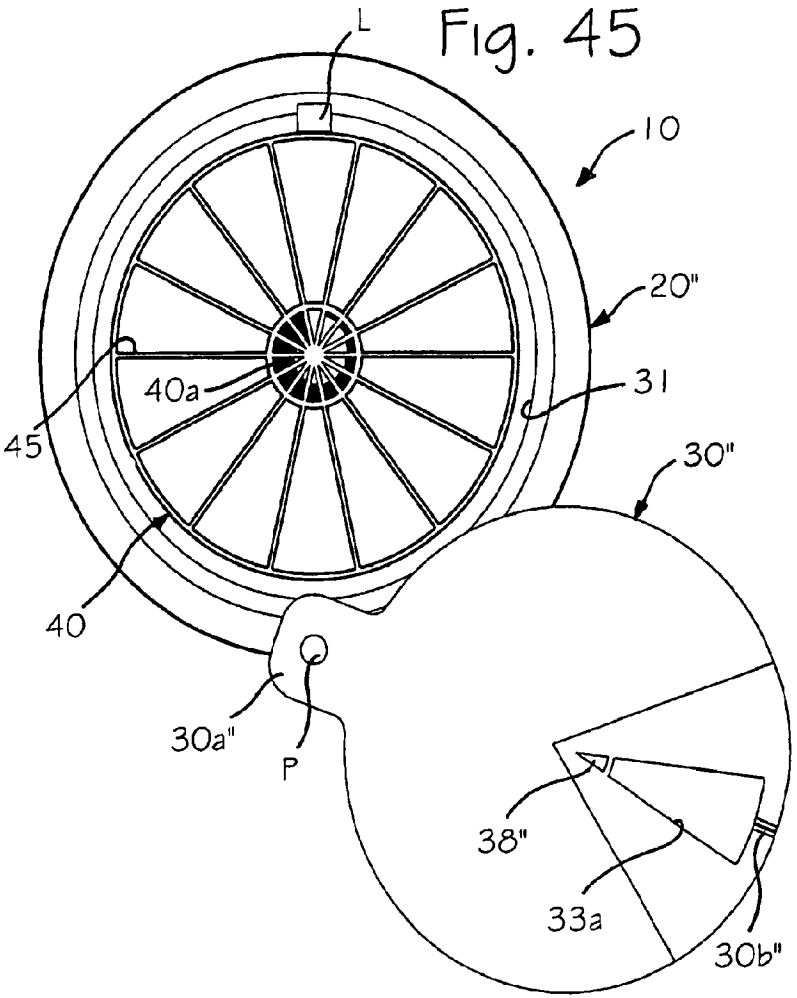
FIG. 45 is a front view of the dispenser of FIG. 43, with a respective movable body in an open position and a respective modified magazine.
Figure 44:
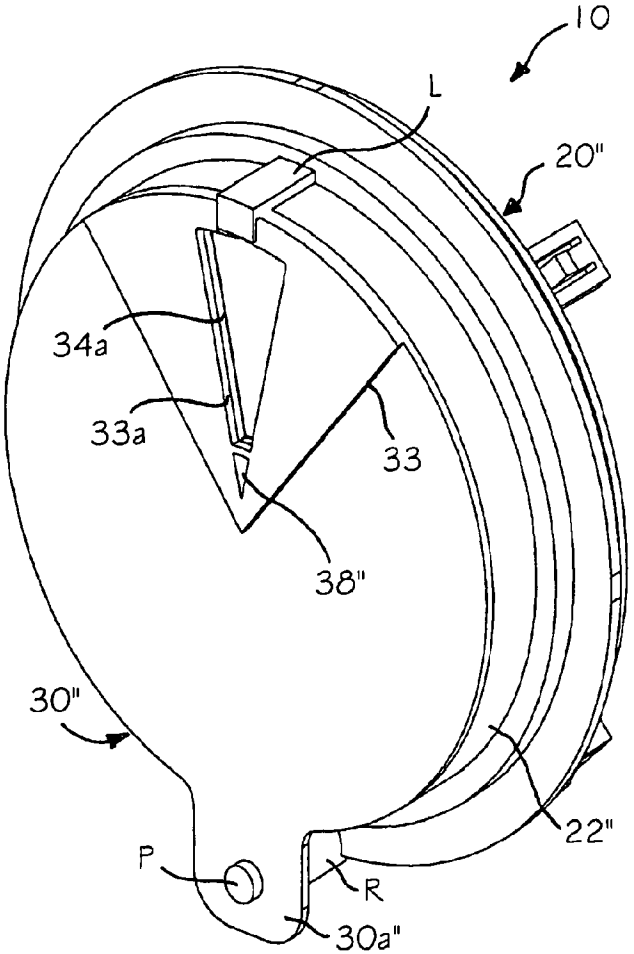
FIG. 44 is a perspective view of the dispenser of FIG. 43, with a respective movable body in a closed position.

FIGS. 43-45 illustrate a sixth inventive embodiment, in which—as can be seen particularly in FIG. 43—housing 31 for magazine 40 is obtained in the fixed body, here indicated by 20", equipped for the purpose with a peripheral wall 22" which projects from the opposite surface of the main wall 21 to the one on which motor 50" is mounted, with the relevant transmission system; in the preferential version, the height of wall 22" is such as to allow the magazine to be received completely.

In this embodiment the movable body, indicated by 30", is configured as a flattened cover, slidable in a plane substantially perpendicular to the axis of rotation of magazine 40, but hinged, or in any way fastened, so as to be capable of angular movements (note that movable body 30" could however be mounted so as to make movements of other types, for example at least partly linear).

In the example, a projection R projects from face 21 of fixed body 30", forming a pivoting pin P, designed for coupling with a respective seat or hole F formed in a radial protuberance 30*a*" of movable body 30". In an area diametrically opposite to projection R, the fixed body has a fastening wing L, while in a region diametrically opposite to housing F, movable body 30" has, on its outer surface, a notch 30*b*"; wing L is provided with a respective tooth or projection, not visible, capable of elastically engaging in notch 30*b*", for the purpose of keeping body 30" in the closure position of the housing for the magazine, as in FIG. 44; by exploiting the possibility of elastic deformation of the fastening wing L, it is possible to move body 30", with an angular sliding movement with respect to fixed body 20", in order to allow access to the housing for magazine 40, as in FIG. 45.

As may be inferred, therefore, body or cover 30", which is angularly movable about a pin, allows complete opening and closure of a circular housing accommodating the reservoir or magazine for the washing agent.

The transmission system of the device according to the sixth embodiment is substantially analogous to that of the fifth embodiment, but has separable coupling means between transmission member 61" and magazine 40 of the type illustrated in FIGS. 38-40. For the remainder, the operating principle of the actuating and transmission system is analogous to what has been described with reference to the fifth embodiment.

In FIGS. 43 and 45, two possible alternative embodiments can also be seen of a warning indicator aimed at allowing visual checks on the number of doses of detergent present in the magazine 40. In the case of FIG. 43, the above-mentioned indicator comprises a transparent window 38" formed in body 30", which extends in substantially radial manner between the central area of the body itself and aperture 33*a* for delivering the detergent; this window faces onto an optical indicator, for example associated to the bottom or end wall 61*e* of transmission member 61", on which a circular outline is depicted, divided into sectors, each of them being aligned with a respective receptacle 45 of magazine 40; similarly to what was described with reference to FIG. 20, two adjacent sectors are entirely of a first and a second color, for example green and red, while the remaining sectors include regions of variable dimensions in the two colors.

The configuration of member 61" and of the central cylindrical part of magazine 40 is such that, in the operative condition of device 10, said member is inserted almost completely into said hollow central part, in such a way that the above-mentioned wall 61*e*" faces onto transparent window 38" formed in body 30"; in the configuration shown in FIG. 43, magazine 40 therefore has preferably a hollow cylindrical central part. When a full magazine 40 is in the starting position (set manually or automatically by means of the control system of motor 50"), the sector visible in window 38" is the entirely green sector of wall 61*e*". Controlled rotation of magazine 40 causes sectors with green and red regions of different sizes to be displayed, one by one, through window 38", so as to visually inform the user about the progressive reduction in usable doses of washing agent; when the last receptacle containing detergent is in line with aperture 33*a*, the entirely red sector will be in line with window 38", so as to warn the user about the need to replace magazine 40.

As can be seen, in this embodiment the optical indicator is entirely associated to the part of the dispenser which is fixed to the domestic appliance, and particularly to a movable component of its transmission/activation mechanism. Note that the above-mentioned movable component could be connected to an optical indicator of the type visible in FIG. 20 (for example on the cylindrical part of member 61") or to another component which performs the same function.

FIG. 45 on the other hand illustrates the case of incorporating an optical indicator, of a similar type to the one shown in FIG. 43, into a magazine 40; in this case the tubular central portion of magazine 40 is equipped with a closing wall 40*a*, which carries the above-mentioned optical indicator. As may be inferred, the type of visual reporting in the variant shown in FIG. 45 is completely analogous to what was described a little previously in relation to FIG. 43.

Clearly, also in the case of the variants shown in FIGS. 43 and 45, the symbolism associated with the various indicator sectors of wall 61*e* or 40*a* can be of any type suitable for the purpose, such as for example a decreasing numbering. Device 10 in accordance with the sixth embodiment is preferably installed on one of the side walls of chamber 3, or on the liner 4*a* of the door 4; in the case represented in FIG. 43, dispenser 10 is also equipped with a position transducer or encoder, with a ring A being designed for fitting on the magazine 40 and with sensor 70 associated to wall 21.

It should also be stated that the indicator or optical warning of FIG. 20 could be made up of a separate or independent element, removably connected to magazine 40, in a similar manner to ring A or A'. Another possibility again is connecting the indicator of FIG. 20 with a transmission member which performs the functions of those previously indicated by 61, 61' or 61", but which envelops or surrounds the magazine; such a member will be equipped with teeth or other means of engagement capable of cooperating with the outer perimeter of the magazine, for example with the ends of the radial dividers 44, instead of the central part as in the embodiments described and illustrated here.

Figure 46:
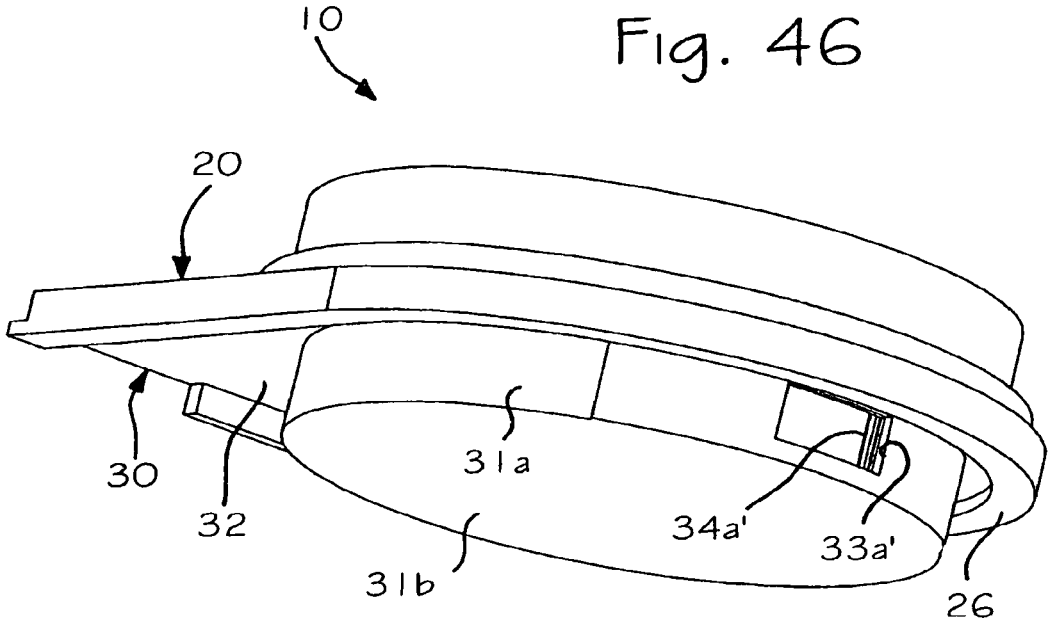
FIG. 46 is a perspective view of a dispenser of washing substances made in accordance with a seventh inventive embodiment.
Figure 47:
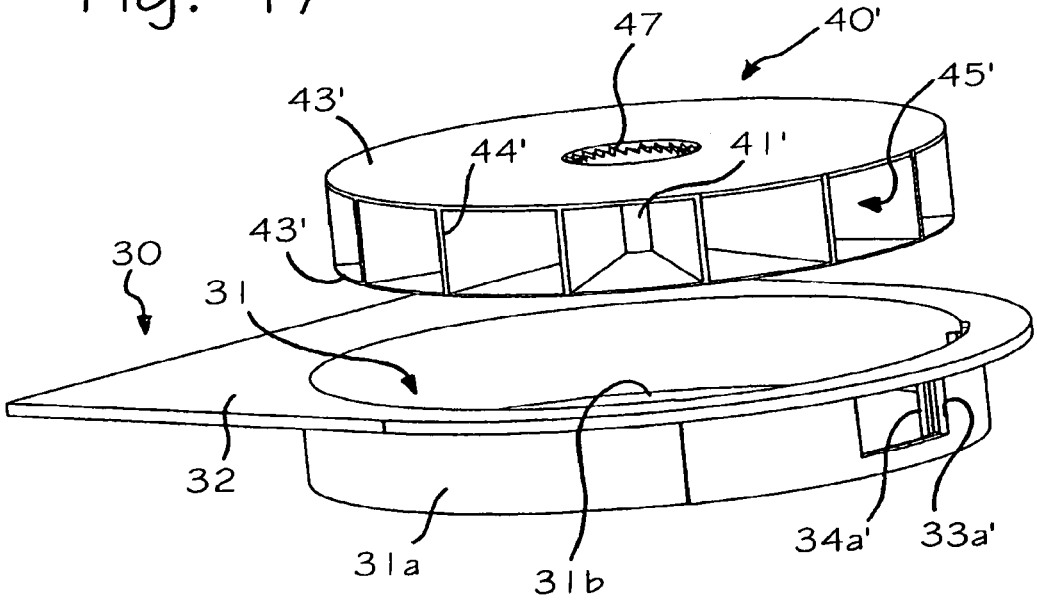
FIG. 47 is a perspective view of a movable body and a magazine for the dispenser of FIG. 46.
Figure 48:
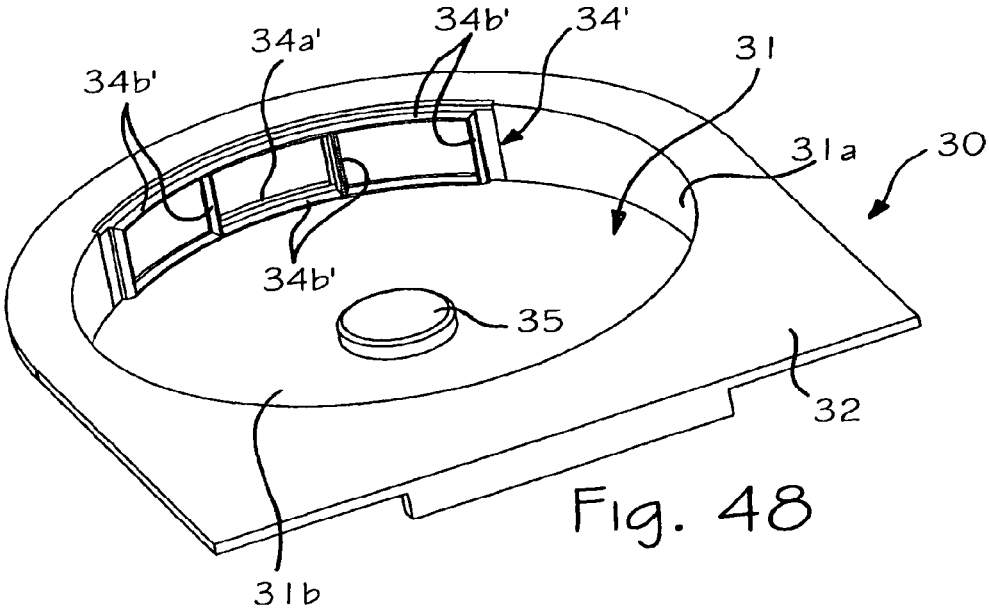
FIG. 48 is a further perspective view of the movable body of FIG. 47.

FIGS. 46-48 illustrate a seventh inventive embodiment, in accordance with which a dispenser 10 is equipped with a magazine, here indicated by 40', having receptacles open only in a radial direction, instead of according to the axis of rotation of the magazine. In this embodiment, the body of the magazine 40' has an upper wall and a lower wall, indicated by 43' and substantially parallel to each other, a tubular central portion 41' carrying teeth 47 and a series of dividers 44' which extend radially from said central portion, as far as the area of the circumference or outer perimeter of wall 43', so as to delimit the receptacles for containing the washing agent, one of which is indicated by 45'.

In this case the delivery aperture of the dispenser, indicated by 33*a*', is located on the circumferential wall 31*a* of movable body part 30, here configured as a sliding drawer. As may be seen in FIG. 48, in the internal part of housing 31 for the magazine 40', the circumferential wall 31*a* has a seat for accommodating a respective sealing gasket, indicated by 34', with relative aperture 34*a*', having the functions of gasket 34 of the earlier embodiments, where apertures 33*a*', 34*a*' have shapes and dimensions substantially coinciding with the section of aperture of receptacles 45'. Apertures 33*a*', 34*a*' and gasket 34' have a substantially rectangular profile, because they are arranged according to an arc of circumference; in this embodiment also, however, gasket 34' has a longitudinal extension markedly larger than (preferably triple) the width of apertures 33*a*', 34*a*' and/or of the mouth of receptacles 45', with aperture 34*a*' being positioned substantially in the centre of the outline of gasket 34'. In this embodiment, furthermore, gasket 34' is preferably equipped with reliefs or lips 34*b*' protruding towards the inside of housing 31, designed to cooperate to form a seal with the body of magazine 40', in proximity with the edges of the apertures of the three receptacles 45' facing towards the gasket itself.

The dispenser 10 according to the seventh embodiment is suitable for fitting either to a horizontal wall of chamber 3, such as the upper wall 3*a*, or to a vertical wall of chamber 3, such as one of its two side wall or the door liner 4*a*. In this case, too, one or more jets of washing liquid are oriented in such a way as to be able to strike the delivery aperture 33*a*'; in the event that the dispenser is mounted on the upper wall 3*a* of the chamber, these jets can come from a sprinkler or a nozzle fixed to this wall, while in the case of fitting to the door liner 4*a*, the jets can come from a sprinkler situated below the upper crockery basket of the dishwasher (in the case of machines with two baskets).

Note that the solution which provides for the use of a magazine with receptacles being open radially towards a delivery aperture formed in the peripheral wall of the housing of the magazine can also be implemented on devices 10 with a movable body not configured as a sliding drawer; in this connection it is also clear that delivery aperture 33*a*' can be formed in an angular position other than that illustrated in FIGS. 46-48, and irrespective of whether the circumferential wall of the housing for the magazine belongs to the movable body (as for example in the first embodiment) or to the fixed body (as in the sixth embodiment).

Figure 49:
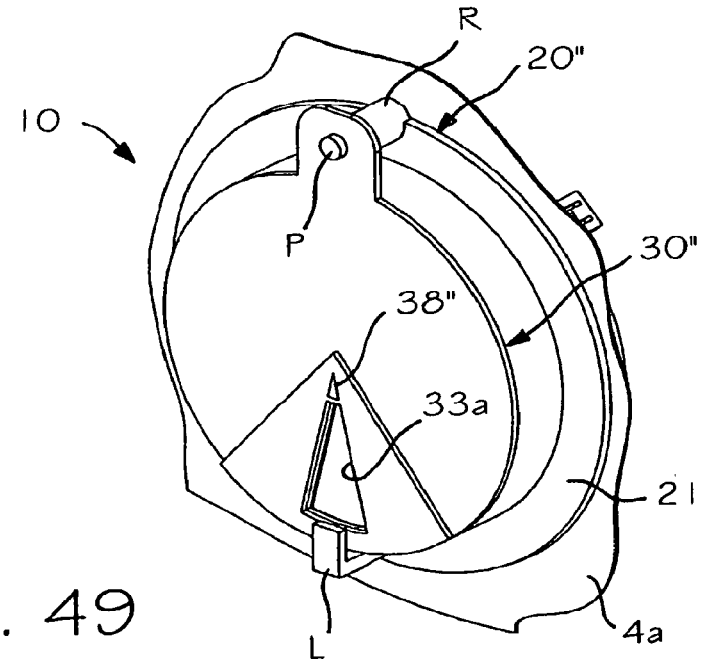
FIG. 49 is a perspective view of a dispenser of washing substances made in accordance with an eighth inventive embodiment, with a respective movable body in a closed position.
Figure 51:
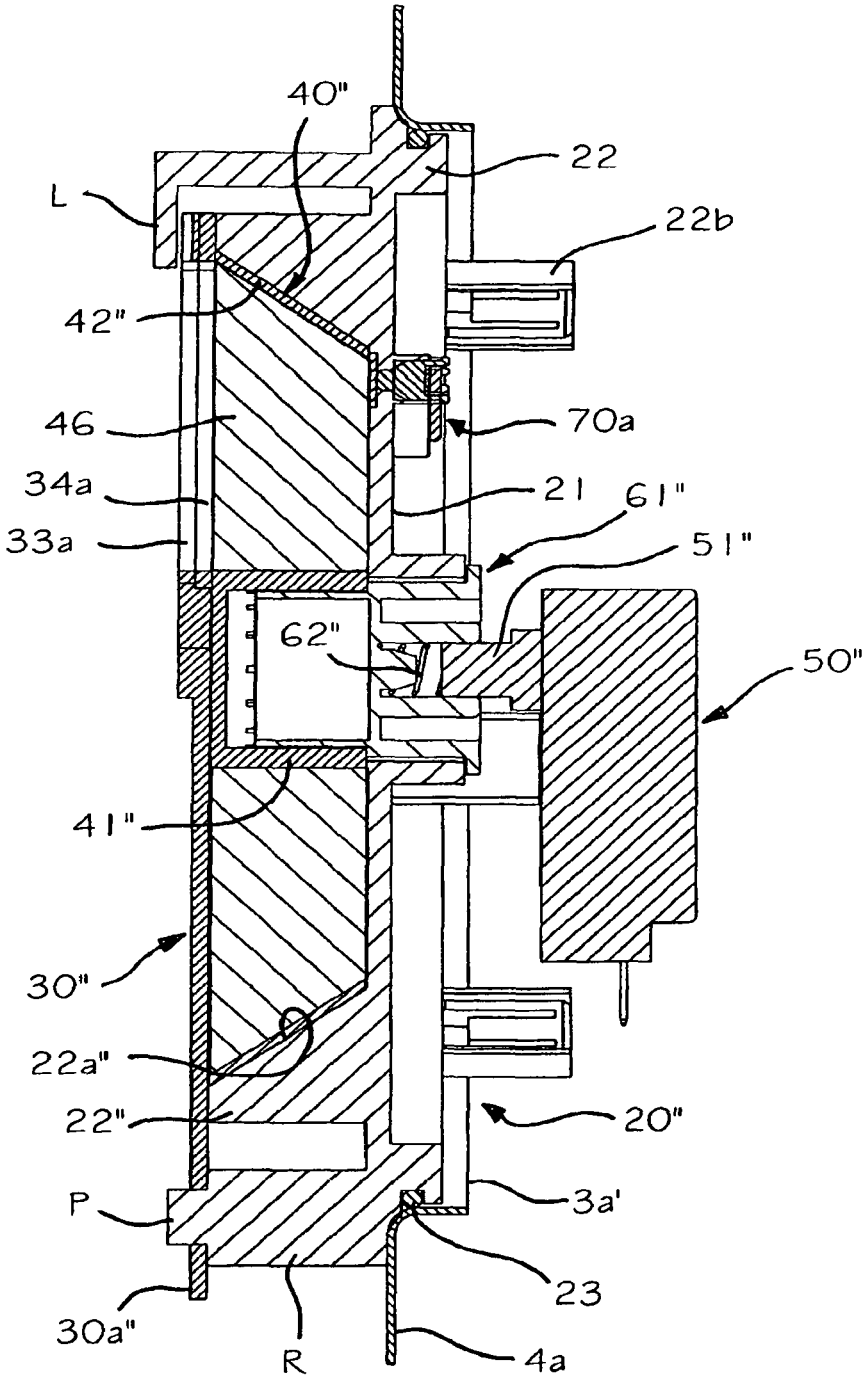
FIG. 51 is a sectional view, on a magnified scale, of the dispenser of FIG. 49.

FIGS. 49-51 illustrate an eighth inventive embodiment, in accordance with which dispenser 10 has a magazine of a generally tapering or truncated-conical shape; the dispenser 10 represented has a structure substantially similar to that of the sixth embodiment, with a transmission system of the type illustrated in FIGS. 35-37, apart from the different conformation of the magazine, here indicated by 40", and possibly the relative housing 31 formed in fixed body-part 20".

The magazine 40" comprises in this case a central portion 41" substantially of the type illustrated in FIG. 35, and a peripheral wall 42" of truncated-conical shape, with a plurality of radial dividers, one of which is indicated by 44", extending between the central portion and the peripheral wall; in the example provided, therefore, the receptacles, one of which is indicated by 45", are open axially, on both faces of magazine 40"; the body of the magazine could in any case also have a transparent rear wall, in the event of an optical detection system, or an opaque rear wall, in the event of a magnetic or inductive detection system, as has already been explained.

On the other hand, housing 31 formed in fixed body part 20" of dispenser 10 can have a shape substantially complementary to magazine 40", i.e. truncated-conical, although this is not strictly mandatory; to this end, as will be noted for example in FIGS. 50 and 51, the annular wall 22" laterally delimiting housing 31 has an internal surface **22*a*" consistently inclined with respect to the peripheral face 42" of the magazine. Note in any case that face 22*a*"** could also not be inclined, i.e., it could define a cylindrical housing of the type described with reference to at least some of the preceding examples of embodiments of the invention.

Dispenser 10 in accordance with the eighth embodiment is particularly indicated for mounting vertically, for example on the door liner **4*a* or on one of the lateral walls of chamber 3, in order to facilitate the discharge and/or downflow of the dose of washing agent contained in the receptacle 45" which is at the delivery aperture 33*a*, as well as the washing of the receptacle itself: the fact that the inner surface of the peripheral wall 42" of magazine 40"** is inclined obviously facilitates the downflow of the washing agent and of the relevant flushing liquid, thus avoiding the risk of stagnation.

In the embodiments previously described, the magazine contains a single detergent, designed to be delivered in the course of a single phase of a washing cycle, or in distinct phases of the same cycle. In a possible alternative implementation, however, the dispenser can be arranged to contain at least two different washing agents, such as for example a detergent in the strict sense and an additive or rinse aid.

Such a case is represented schematically in FIG. 52, in which a dispenser of the type previously described is associated to a magazine 40 equipped with first receptacles, indicated by **45*b*, intercalated with second receptacles, indicated by 45*c*, containing respectively a detergent 46*b* and a rinse aid 46*c*, here in solid form. In the example shown in FIG. 52 the individual sectors 45*b*, 45*c* have an angular extension which corresponds to half the angular extension of the sectors previously indicated by 45. In this way—for example with reference to the device 10 in accordance with the first embodiment—as a result of a first activation of actuator 50, a receptacle 45*b* will be positioned at aperture 33*a*, for the purpose of delivering detergent 46*b* in the course of a washing phase: at a later time, in the course of a rinsing phase specified by the operating cycle of machine 1, the control system thereof will control a second activation of actuator 50, in such a way that a receptacle 45*c* is brought into alignment with aperture 33*a*, for the purpose of delivering the rinse aid 46*c***.

It is clear that the variant illustrated in FIG. 52 is applicable also to the other embodiments described, given the possibility of controlling the angular movement of the magazine with precision, using the sensor or encoder means described; it is equally clear that a magazine of the type represented in FIG. 52 is also usable for delivering various doses of the same washing agent in subsequent phases of an operating cycle of the machine.

In the embodiments of the invention previously described, the individual doses of detergent are dissolved and flushed out by at least one jet of washing liquid produced by a sprinkler on dishwasher 1; for this reason, obviously, both the position of the dispenser (or more accurately, of its delivery aperture), and the conformation and orientation of at least one orifice of the sprinkler concerned, are suitably predefined in the design stage. Attention is also drawn to the possibility of providing, within the washing chamber 3, a suitable static nozzle, appropriately fed with liquid and dedicated to flushing out the washing agent.

In a possible practical implementation of the invention, a phase or step is provided in the course of the washing cycle performed by dishwasher 1, in which a jet 7, designed to dissolve and flush out the detergent, has its force or pressure increased by comparison with normal operation; to this purpose, the machine's control system is configured to control a temporary increase in the number of revolutions per minute of the motor of a recirculation pump which feeds the sprinklers, or to control a diverter or a shut-off valve to temporarily direct the entire flow of washing liquid, produced by said pump, towards the sprinkler having the orifice concerned. This phase with "reinforced" jets preferably occurs in conjunction with the phase in which dispenser 10 is made to move to bring a dose towards the delivery aperture, i.e., in the phase in which the washing agent is exposed to the action of the flushing jet.

The presence of a jet dedicated to flushing out the detergent, even if preferable, is not strictly necessary for the purposes of the implementation of the invention, for example for the cases wherein the magazine is filled manually by a user, for example with detergent tablets inserted loose into the receptacles; delivery is in this case obtainable by simple gravity, through the detergent tablet falling to the bottom of the chamber, when the relevant compartment is brought into line with the delivery aperture; alternatively, it could be arranged for the tablets to be inserted into the magazine with a slight degree of interference, such that after they have dissolved partially or to a predefined extent, they can fall by gravity into the chamber.

The dispenser according to the invention is clearly adapted to be used on dishwashing machines having one or more sprinklers (for example three, one of them being associated to the upper wall of the chamber).

Figure 55:
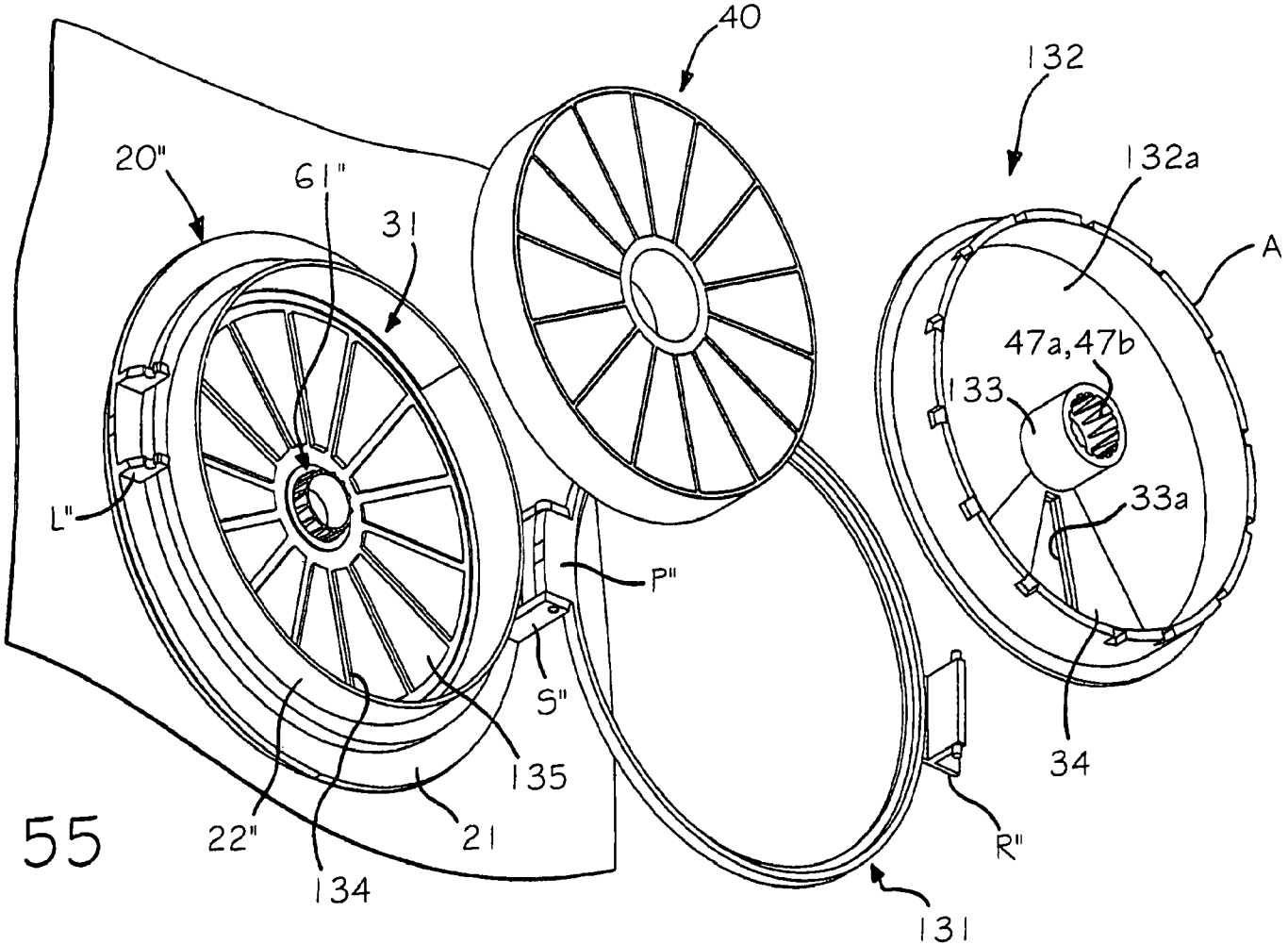
FIG. 55 is an exploded partial view of the dispenser of FIGS. 53-54.

In accordance with a ninth inventive embodiment, illustrated in FIGS. 53-55, the dispenser's actuation/transmission system is arranged to be coupled in a separable manner to a rotatable member carrying the delivery aperture **33*a*, which forms one wall of housing 31**; in this case, the element of the actuation/transmission system which makes the above-mentioned rotatable member to rotate, is preferably configured to extend at least in part into the hollow central portion of the magazine, but without being coupled to it; the magazine and the housing are furthermore configured such that the former remains substantially static in the latter. In accordance with this embodiment, therefore, the magazine remains stationary, whereas it is the rotatable member which moves, in order to bring the delivery aperture selectively into line with each receptacle containing the washing agent to be delivered.

The dispenser shown in FIGS. 53-55 has a fixed body 20" with a shape substantially similar to that illustrated with reference to the sixth embodiment (FIGS. 43-45), i.e., with a housing 31 for the magazine 40 formed in the fixed body and delimited by a peripheral wall 22"; the movable body 30" in this case is configured as a whole as a hinged lid.

As may be seen, particularly in FIG. 55, the movable body 30" comprises a first part or frame, indicated by 131, hinged to the fixed body 20", and a second part, or rotatable delivery member, indicated by 132, mounted on frame 131 so as to be able to rotate freely with respect to it; delivery member 132 can be removably mounted on frame 131, or the two parts can be secured together, with freedom of relative movement, for example by means of a suitable seat or guide.

In the case illustrated, fixed body 20" has a fork projection S", to which a respective projection P" of frame 131 is hinged; on the side opposite to projection S", fixed body 20" has at least one hooking appendage L", capable of cooperating with a hooking member R", preferably elastic and formed on frame 131 on the opposite side with respect to projection P", in order to keep body 30" in the closure position of housing 31. In the example, frame 131 has a predominantly annular shape and delivery member 132 has a disc shaped wall 132*a*, in which the delivery aperture 33*a* is formed, as well as the seat for the sealing gasket 34. Preferably, further sealing means, which are not depicted, are provided between the above-mentioned frame 131 and the delivery member 132, such as for example a gasket made of an elastomer material, possibly an o-ring.

The dispenser's transmission system is of a type similar to the one illustrated in FIG. 32, i.e., with a motor in a direct drive relation with a transmission member 61" which projects into housing 31; in the case illustrated this transmission member 61" is substantially configured as in FIGS. 36-37, i.e., with an alternating series of crests and valleys formed in a peripheral outer surface. From the central part of the base wall 132*a* of delivery member 132, a tubular cylindrical projection 133 projects, on the inner surface of which a ring of crests and valleys 47*a*, 47*b* is formed, similar to those described with reference to FIG. 35 and adapted to cooperate with the crests and valleys on the surface of the transmission member 61", or complementary to them.

In the ninth embodiment the magazine 40 is not equipped with separable coupling means designed to cooperate with the actuation/transmission system, and the dispenser is equipped with an anti-rotation system for the magazine; it can be inferred from FIG. 55 that the bottom wall of housing 31 forms as a whole an outline in negative or with a complementary profile to at least one part of one face of magazine 40; in the example, radial recesses 134 are provided for this purpose, capable of receiving part of the radial dividers of magazine 40, as well as protrusions 135 substantially forming circular sectors, capable of being accommodated in part in the receptacles of magazine 40; in this embodiment, therefore, the receptacles of the magazine have a respective part not occupied by the detergent, in which the above-mentioned protrusions 135 can be received. It will be appreciated that the means for preventing the movement of the magazine within housing 31 or within the dispenser could be of any other type.

In the embodiment illustrated, finally, the dispenser includes a detection or encoder system of the type previously described; for this purpose, delivery member 132 in the example illustrated has integral with it an excitation ring A, capable of cooperating with an optical sensor, not visible, which faces through a respective transparent window onto the inside of housing 31. Obviously the detection or encoder system could be of another type, for example magnetic or inductive, with characteristics analogous to what has been described in reference to the preceding examples.

For use, with movable part 30" open, magazine 40 is positioned in housing 31, with the appropriate face of the magazine coupled to the housings 134 and the protrusions 135 formed in the bottom face of the housing; as a result of this positioning, part of transmission member 61" protrudes into the tubular central portion of magazine 40, as may be seen in FIG. 54.

The movable part 30" can then be closed, as can be seen in FIG. 53; as this closure takes place, the cylindrical projection 133 of delivery member 132 enters the tubular central portion of magazine 40, until its crests and valleys 47*a*, 47*b* couple with those of transmission member 61"; note that precise coupling can be obtained, if necessary, by gently rotating delivery member 132 by hand (or an automatic coupling or centring could be achieved in virtue of the inclined planes of the said crests and valleys, which allow mutual sliding and lateral movement, or rotation of the delivery member 132); in this phase, ring A, if provided, enters the space between the peripheral wall of magazine 40 and the peripheral wall of housing 31 (this space is clearly visible in FIG. 54).

In the course of normal operation, the control system or circuit which manages the operation of the dispenser activates the dispenser's motor, with transmission member 61" then causing delivery member 132 to rotate. In this way the delivery port 33*a* is brought selectively, on occasion as required, in front of a particular receptacle of magazine 40, for the purpose of delivering the detergent; the movements of member 132 are detectable and controllable by means of the detection or encoder system, including ring A, which enables the motor to be stopped when necessary; obviously the detection or encoder system allows the control system or circuit to detect the state of exhaustion of the magazine and, in general, to perform all the detection functions described above, when required. Clearly, in order to replace an exhausted magazine, the user has only to access housing 31 (by opening the movable part 30"), remove the exhausted magazine and position a new magazine in the housing.

The separable coupling means between transmission member 61" and delivery member 132 can naturally be of a different type from the one illustrated, and can consist for example of two sets of simple teeth with predominantly frontal coupling. It will be appreciated furthermore that movable part 30" could also not be hinged or permanently secured to fixed body 20", but could be configured as a completely detachable or removable cover; in this connection, for example, part 30" can have a frame 131 equipped with means arranged for engaging with similar means formed in body 20" (for example a bayonet or threaded connection system between frame 131 and wall 22" of body 20").

The dispenser according to the ninth embodiment can be used both with magazines pre-packed with doses of detergent, and with magazines into whose receptacles the user puts the doses of detergent, for example in the form of tablets, preferably inserted so as not to be able to fall by gravity alone, or so as not to be delivered except as a result of partial dissolution by a fluid.

FIG. 56 illustrates a variant of the device according to the ninth embodiment, in which, instead of housings 134, ridges or radial dividers are provided, capable of forming a different positioning system for a different magazine, and/or forming distinct sectors or receptacles, for example similar to the sectors or receptacles of the magazine previously described, suitable for housing the doses of washing agent.

In this variant, within the region circumscribed by wall 22" of fixed body 20", two tubular or cylindrical walls are provided, and in particular a central wall 141 and an intermediate wall 142, concentric with each other and with wall 22"; between the two walls 141 and 142 there extend radial dividers 144, so as to form a series of receptacles 145, capable of housing respective doses of detergent.

Presence of wall 142 is preferable in cases where the delivery member of the device is equipped with the excitation ring A (see the previous FIGS. 54 and 55), such that the said ring can be positioned between wall 142 and wall 22"; however, in the case of a different detection system (for example of the optical type described with reference to the first embodiment, or with an encoder associated to the transmission system as in FIG. 41), dividers 144 could extend directly between walls 141 and 22".

In this variant, transmission member 61" protrudes constantly into the cylindrical volume defined by wall 141, this volume being also adapted to accommodate projection 133 of the delivery member 132 as shown in FIGS. 54 and 55. As may be inferred, therefore, the operating principle of the dispenser according to the variant shown in FIG. 56 is analogous to what has been described with reference to the ninth embodiment.

The dispenser according to the variant shown in FIG. 56 is particularly indicated for cases in which the doses of detergent are inserted manually into the individual receptacles 145, for example in the form of tablets having a shape substantially complementary to that of the receptacles themselves. In any event, even in the case of the variant under consideration, it is possible to provide for the use of a magazine of a different design from those illustrated so far, having a configuration substantially complementary to at least part of the area defined by walls 141 and 142 and by dividers 144.

In the embodiments illustrated earlier, the magazine is designed to be moved angularly, in order to bring each compartment in line with the delivery aperture: it will be appreciated however that the dispenser according to the invention can be configured for having a magazine with a movement at least partly linear, or a combination of angular and linear movements. An embodiment which is in itself inventive, with a linear movement, is illustrated in FIGS. 57-59, where the fixed body of the dispenser is illustrated partially sectioned, in order to allow it to be completely represented.

Figure 57:
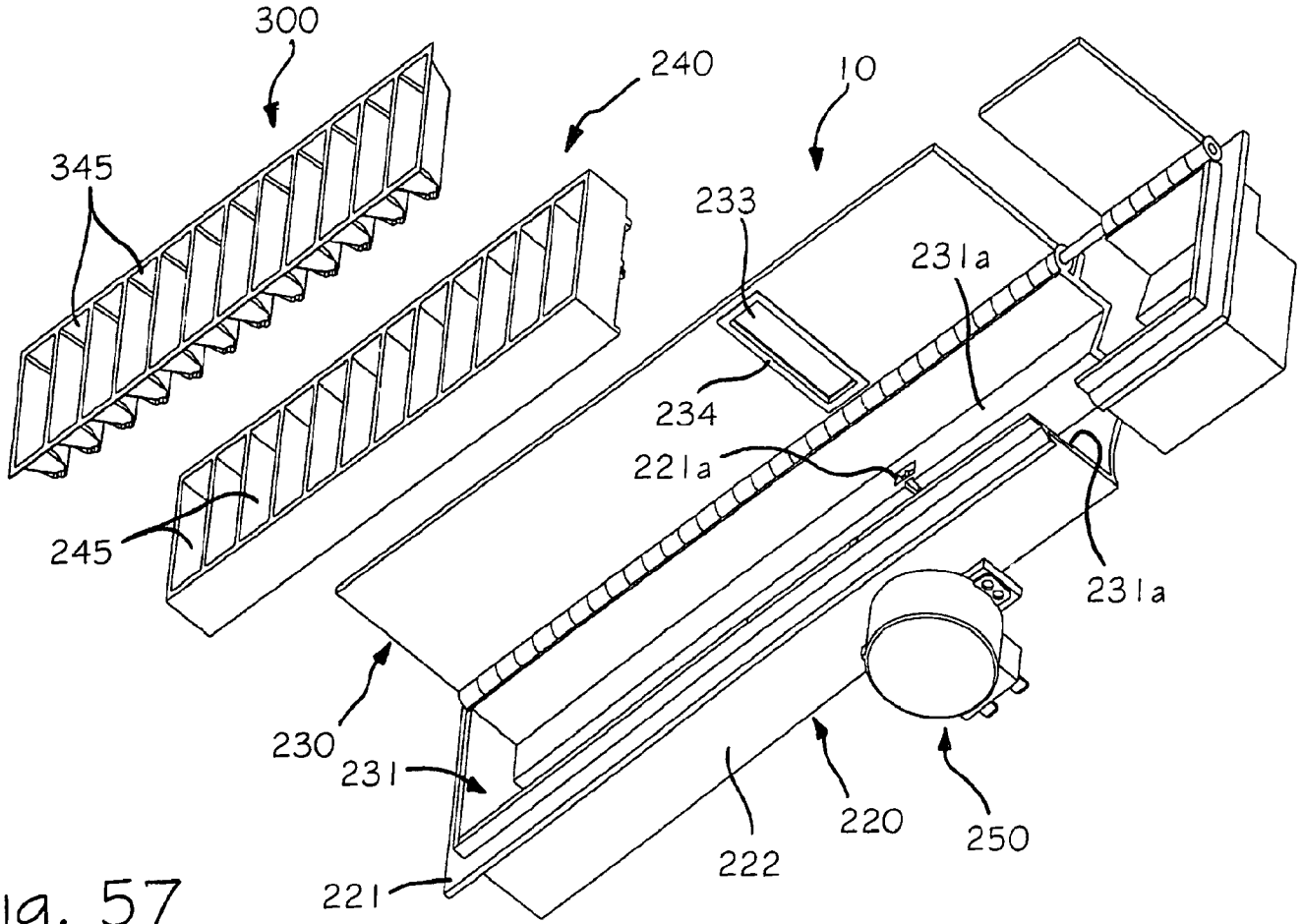
FIG. 57 is an exploded partial schematic view of a dispenser of washing substances, made in accordance with a tenth inventive embodiment.
Figure 58:
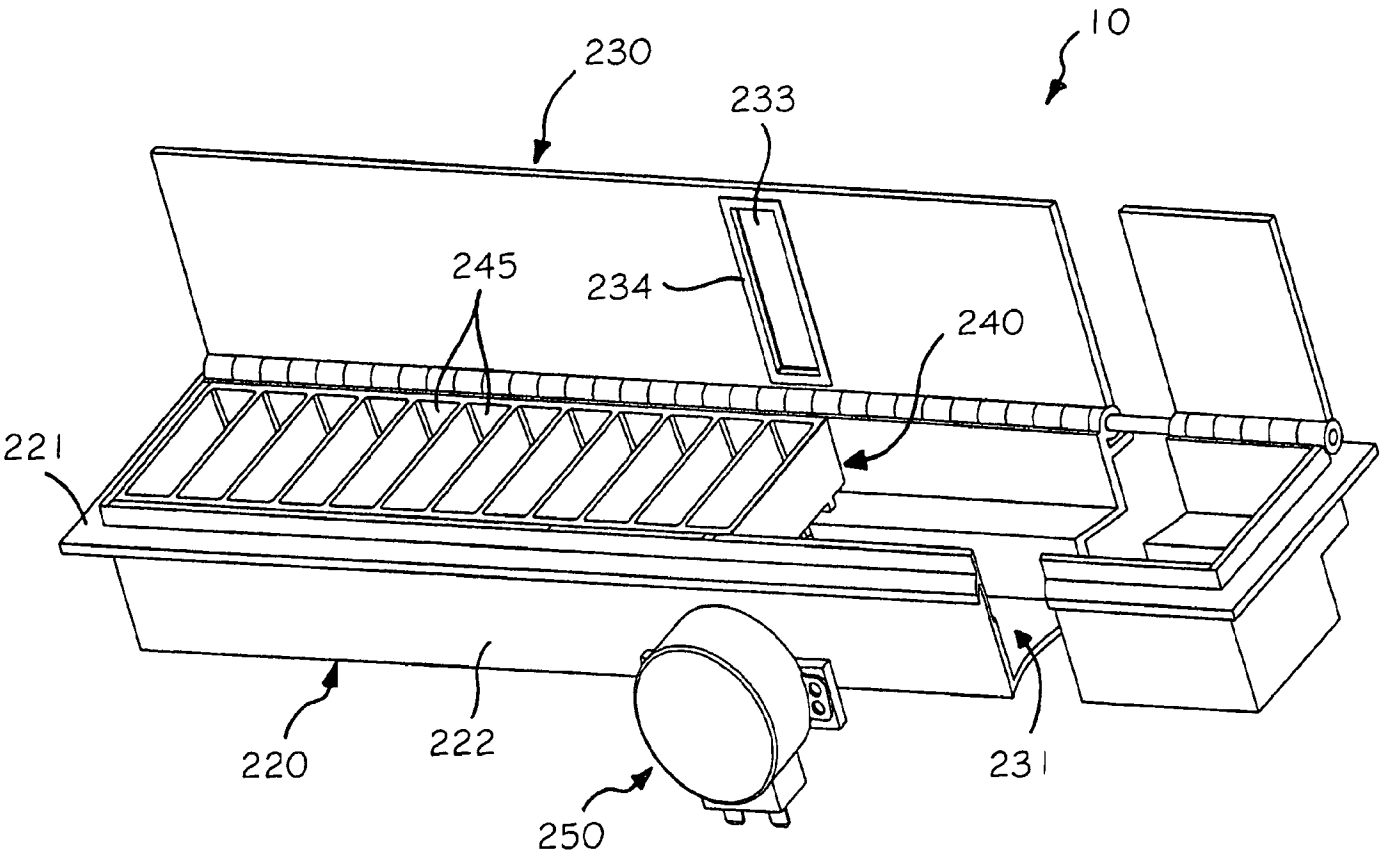
FIGS. 58 and 59 are perspective schematic views, partially sectioned, of the dispenser of FIG. 57.
Figure 59:
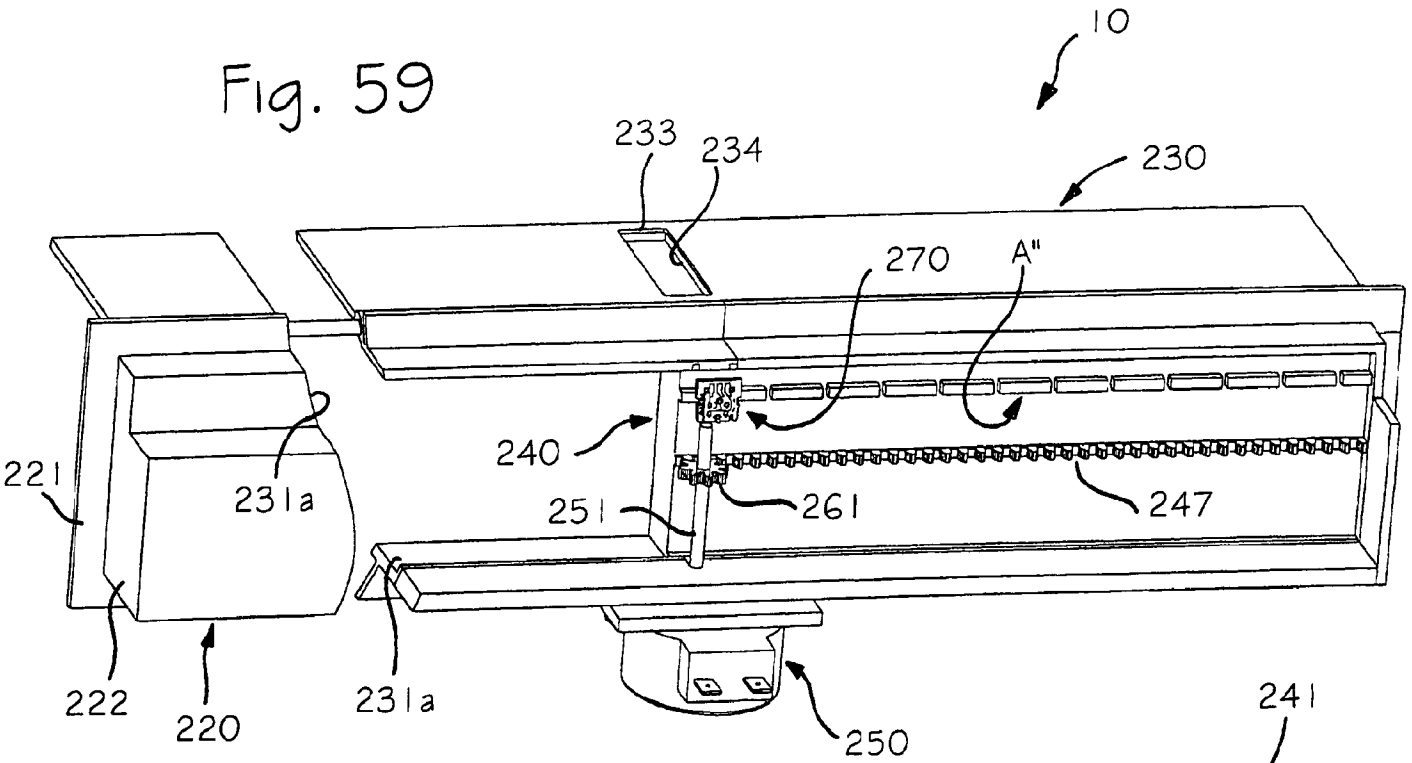

The dispenser 10 illustrated in FIGS. 57-59 comprises a fixed body 220, designed to be sealingly mounted in a respective aperture formed in one of the vertical walls of the machine's washing chamber (including the door liner), in ways similar to those explained earlier. To this purpose, body 220 has a rear portion 222, designed to be predominantly recessed into the said aperture, and a flanged portion 221 designed to rest onto the relevant wall of the chamber, with a suitable gasket being interposed (not represented).

The present solution allows the possibility of implementing the characteristics according to the invention in domestic appliances provided with a limited space in height but with space available widthways, as for example in some versions of door for dishwashing machines.

Body 220 has a generally prismatic or parallelepiped shape, forming a longitudinally extended housing 231. Hinged to body 220 at the top thereof is a movable body part 230, configured as a tilting cover, having a delivery aperture 233 and a corresponding sealing gasket 234. In the case illustrated, movable body 230 is kept in a normal position of closure of housing 231, through the action of elastic means provided in the hinge; alternatively, the door-like part of device 10 can be equipped with a locking/release system of any known type, which is suitable for the purpose. Clearly, suitable sealing means are provided between fixed part 220 and movable part 230, which are not represented in the illustrations.

In the upper part of housing 231 a linearly slidable magazine or support is inserted, indicated as a whole by 240, here of a generally parallelepiped shape, divided into a plurality of receptacles 245 arranged side by side, each receptacle being designed to accommodate a respective dose of washing agent.

As in the previous embodiments, the body of magazine 240 preferably has a generally rigid structure, being formed for example of moulded plastic material, and is removable from the dispenser; in the case illustrated, body 220 is shaped in such a way that opposed supports or steps 231*a* are formed in the housing, which function as longitudinal guides for magazine 240 to slide on.

As is also visible in FIG. 59, in which the bottom part of body 220 is partially sectioned, the device 10 further comprises an electric motor 250, possibly equipped with a reduction gear, to which a transmission system is operatively associated, which comprises a rotating shaft 251 having a toothed wheel or pinion 261 keyed to it or integral with it. This pinion 261 is designed to engage with a rack formation 247 present in the lower wall of magazine 240. In the example, on the lower face of magazine 240 there is also an excitation element indicated as a whole by A", having linear development, which performs similar functions to those previously described with reference to excitation elements A, A'. Also in this embodiment excitation element A" can be made up of an alternation of simple relief portions or crests, or of suitably polarised magnetic elements, or again of ferromagnetic elements or reflective and matt sections, or any other elements suitable for the purpose.

On body 220 is therefore also mounted a detector or sensor 270 which, in combination with excitation element A", forms a position and/or movement detection system of linear type, such as a linear transducer or encoder. In the example illustrated, sensor 270 is operative close to one of the steps 231*a*, which is provided for the purpose with a window 221*a*. Obviously, in the case of use of a linear detection system or linear encoder of magnetic or inductive type, the above-mentioned window does not need to be present. It is equally clear that excitation element A" can be attached to another longitudinal wall of magazine 240, and the mounting position of sensor 270 varied in consequence.

The device according to the considered example can also be equipped with an indicator or signalling system for a user, comprising an optical indicator with suitable symbols and/or colors, associated for example to a longitudinal wall of magazine or support 240, visible through a suitable window of the body 220 or the cover 230 of device 10.

In the example illustrated in FIG. 58, the first receptacle 245—on the right, with reference to the illustration—is in a position in line with that of aperture 233, and the longitudinal development of magazine 240 corresponds to about half of the length of housing 231 (in the case illustrated, the length of the free space in housing 231, on the right in the illustration, must be at least equal to that of the magazine, minus the length of one receptacle). It goes without saying that, in the initial position, magazine 240 could also be in a more retracted position than in the case illustrated, i.e., in a position where the first receptacle 245 on the right comes to face aperture 233 only as a result of a first actuation of motor 250; in this embodiment, the free space in housing 231 will have a length at least equal to that of magazine 240.

The operating principle is conceptually similar to that of the embodiments already described, with the system or circuit in charge of managing the dispenser 10 commanding the motor 250 to cause, through the system comprising shaft 251 and rack-and-pinion 261, 247, the linear displacement of magazine 240 from left to right (again with reference to the figures), so as to selectively bring different receptacles 245 to the delivery aperture 233. Control of the motor 250, for the purpose of correctly positioning magazine 240, is carried out with the aid of the above-mentioned detection or encoder system.

As in the previous embodiments, the dispenser shown in FIGS. 57-59 can use replaceable magazines, pre-packed with doses of substance or detergent, or the user can from time to time put doses of substance or detergent into the receptacles of magazine 240 with which the dispenser is fitted, for example in the form of tablets; in this second case also, the magazine can be removed from dispenser 10 as necessary, for example for the purposes of periodic cleaning.

In accordance with a further possibility of use, magazine 240 can operate as a simple movable support for a package of the so-called "blister" type, i.e., with a semi-rigid wrapping. This wrapping can be for example shaped to form a series of cells or pockets, each capable of containing a respective dose of substance or detergent. In this type of package, the material forming the cells containing the detergent—for example a plastic foil—is positioned in magazine 240, which operates simply as a movable support for the blister.

A blister like this can be seen in FIG. 57, where it is designated with 300: the figure shows only the plastic part which forms the cells for containing the detergent; these are indicated by 345 and represented empty. As may be inferred, blister 300 has a shape such that the cells 345 can be received at least partially in respective receptacles 245 of magazine 240 which, as has been said, operates in this case simply as a movable support.

In a possible variant of the tenth embodiment shown in FIGS. 57-59, the magazine or support is an integral part of the dispenser, being secured to it by suitable guides, and operates simply as a movable housing or support for blisters, or possibly for individual doses of substances or washing agents, preferably pressed or inserted into the cells so as not to be able to fall except as a result of the action of the fluid.

Figure 61:
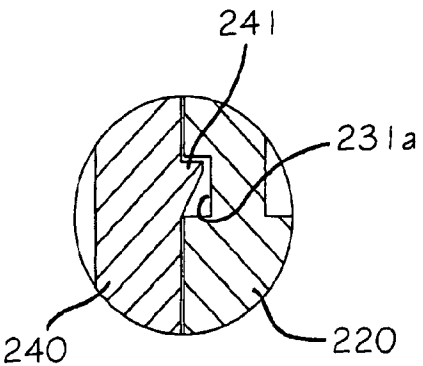
FIG. 61 is a detail of FIG. 60, on a magnified scale.

This variant is illustrated schematically in the section shown in FIG. 60 and in the corresponding enlarged detail in FIG. 61. As will be noted, on the parallel walls of body 220, which longitudinally delimit housing 231, there are guides or grooves formed (one of them is indicated by 231*a* in FIG. 61), into which there are inserted engagement elements 241 which project from the parallel longitudinal walls of the above-mentioned magazine/movable support (here indicated by 240'). As has been said, in this embodiment, movable support 240' is normally secured to the fixed part of dispenser 10, though it is possible to allow occasional removal thereof for reasons of maintenance or periodic cleaning. This maintenance or cleaning can be easily carried out, however, even without removing the movable support 240', by virtue of the shape of dispenser 10, and in particular of the relative cover 230, which preferably can be opened, giving access to the whole of housing 231 and/or the whole of movable support 240'.

In the first nine embodiments, magazine 40 can also operate simply as a movable support for a blister, or be replaced by a movable support for moving this package.

Figure 62:
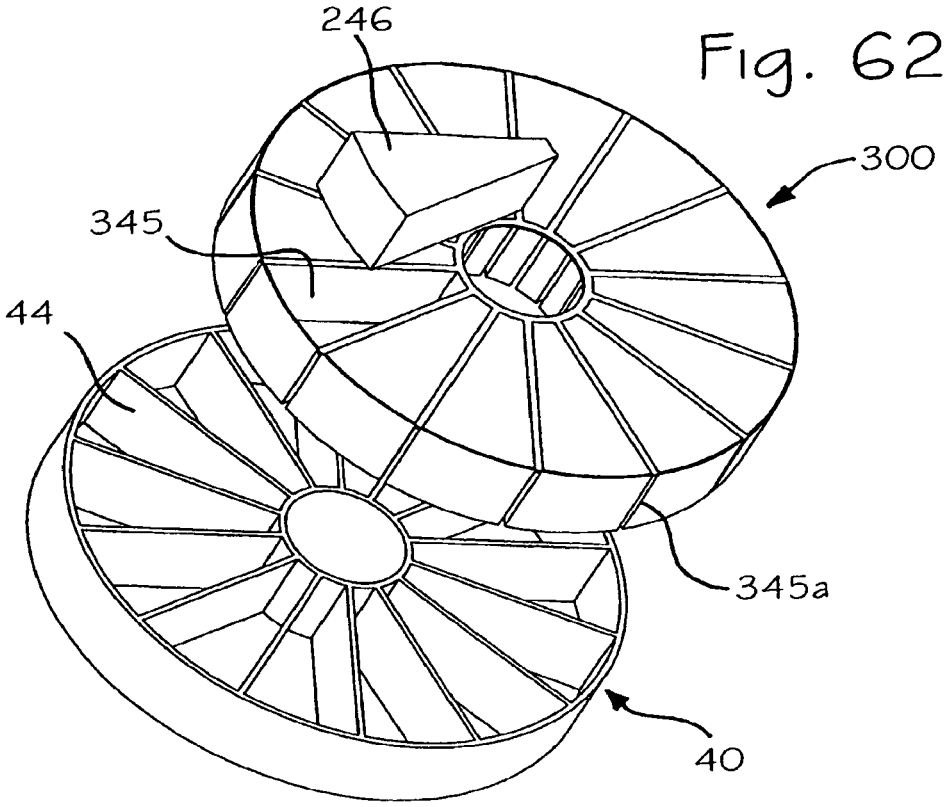
FIGS. 62 and 63 are perspective views, from different angles, of a first "blister" type package of doses of washing agent, usable in conjunction with a magazine of a first type for a dispenser according to the invention.
Figure 63:
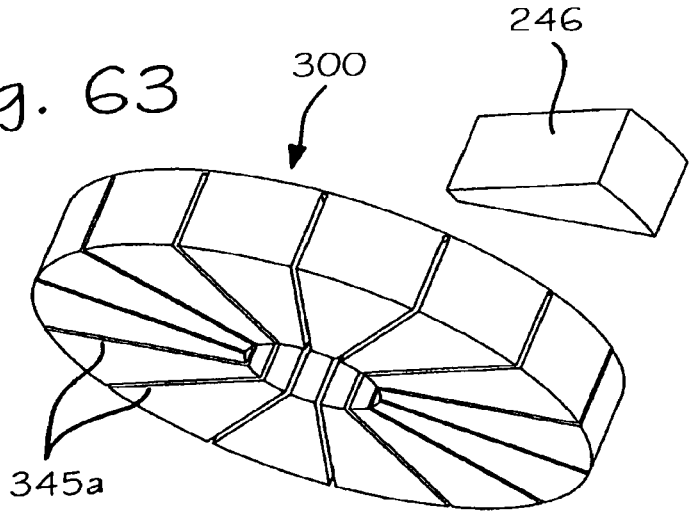

In FIGS. 62 and 63, for example, a blister 300 is shown, which is usable in combination with magazines 40 from the first six embodiments described earlier, as well as the magazine 40 of the ninth embodiment.

Also in these figures only the shaped foil is shown, in which cells 345 are formed, designed to contain the doses of detergent; these doses can be configured as tablets substantially in the shape of a sector of a cylinder, here indicated by 246, being preferably pressed or inserted into cells 345 so as not to be able to fall out except as a result of the action of the fluid.

As may be noted, the above-mentioned shaped foil has a shape essentially complementary or "in negative" with respect to the shape of the magazines used in the above-mentioned embodiments, in order to be able to fit into them. From FIG. 63 one can note particularly how the shaped foil of blister 300 forms a series of radial cavities 345*a*, between one cell and another, suitable for engaging on the radial dividers 44 of the respective magazine 40.

In the case illustrated, cells 345 are open in the direction of the upper face of blister 300, with reference to the figure, but it is clear that the blister could equally be designed for having the opposite cells on the lower face, or even on both faces if desired.

Obviously on the basis of the same concept as is explained above, a blister can also be envisaged of a shape substantially complementary to that of magazine 40" as in the eighth embodiment (FIG. 50). In the case of the ninth embodiment (FIGS. 55 and 56), magazine 40 could possibly be omitted, and a blister 300 could be provided which is arranged to cooperate with the crests and valleys of housing 31, in order to remain in a stable angular position.

Figure 64:
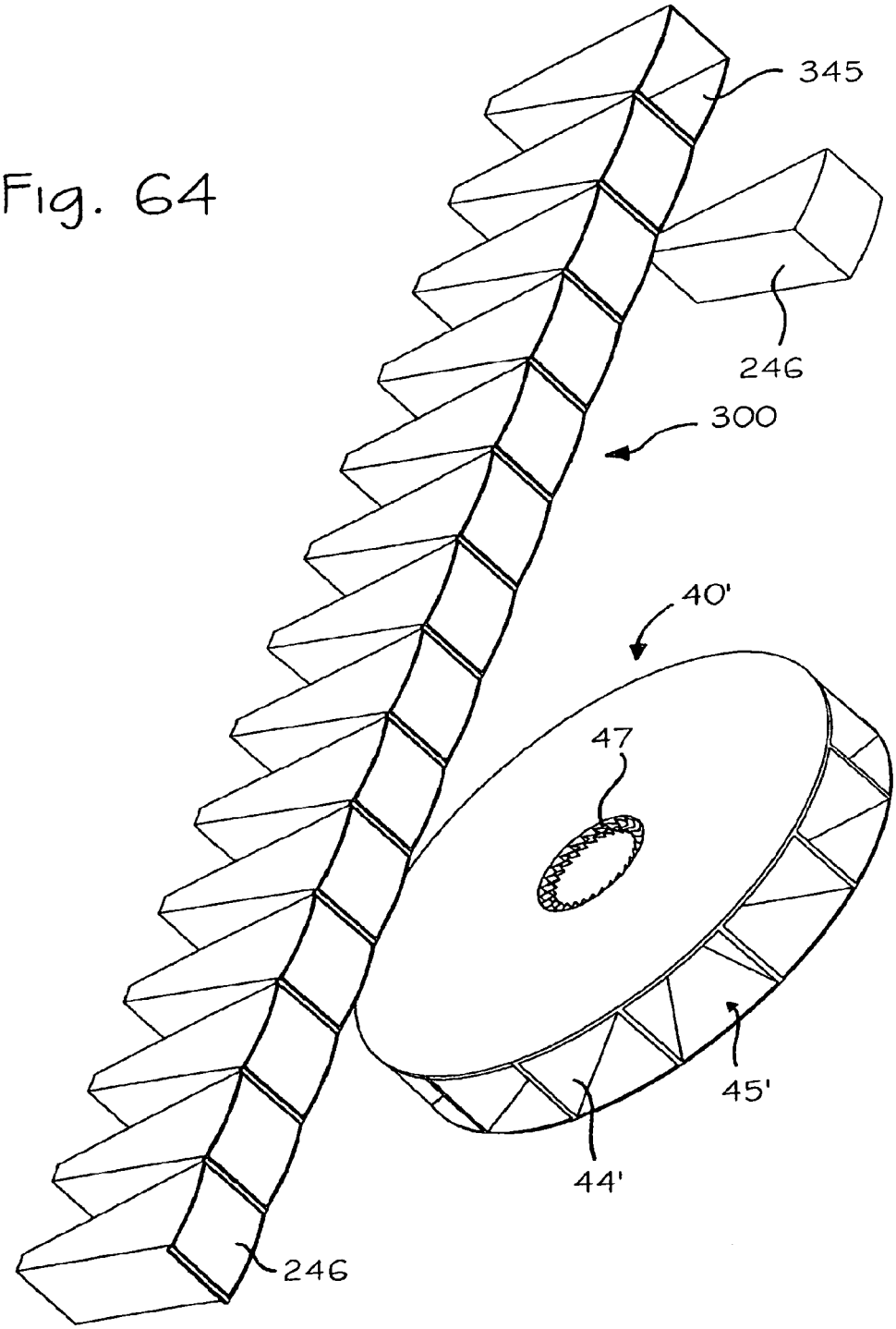
FIG. 64 is a perspective view of a second blister of doses of washing substances, usable in conjunction with a magazine of a second type for a dispenser according to the invention.

FIG. 64, on the other hand, represents a blister 300 usable in combination with magazine 40' of the seventh embodiment (FIG. 47).

In the example, blister 300 has an essentially linear development and the respective shaped foil forms a series of cells 345 having the shape of a sector of a cylinder, for corresponding tablets 246, preferably having the shape of a circular sector. In this embodiment, given the flexibility of the above-mentioned plastic foil forming the cells 345, blister 300 can be given a generally annular or circular configuration when the blister itself is fitted by the user, by inserting the various cells 345 into the receptacles 45' of magazine 40'.

Figure 65:
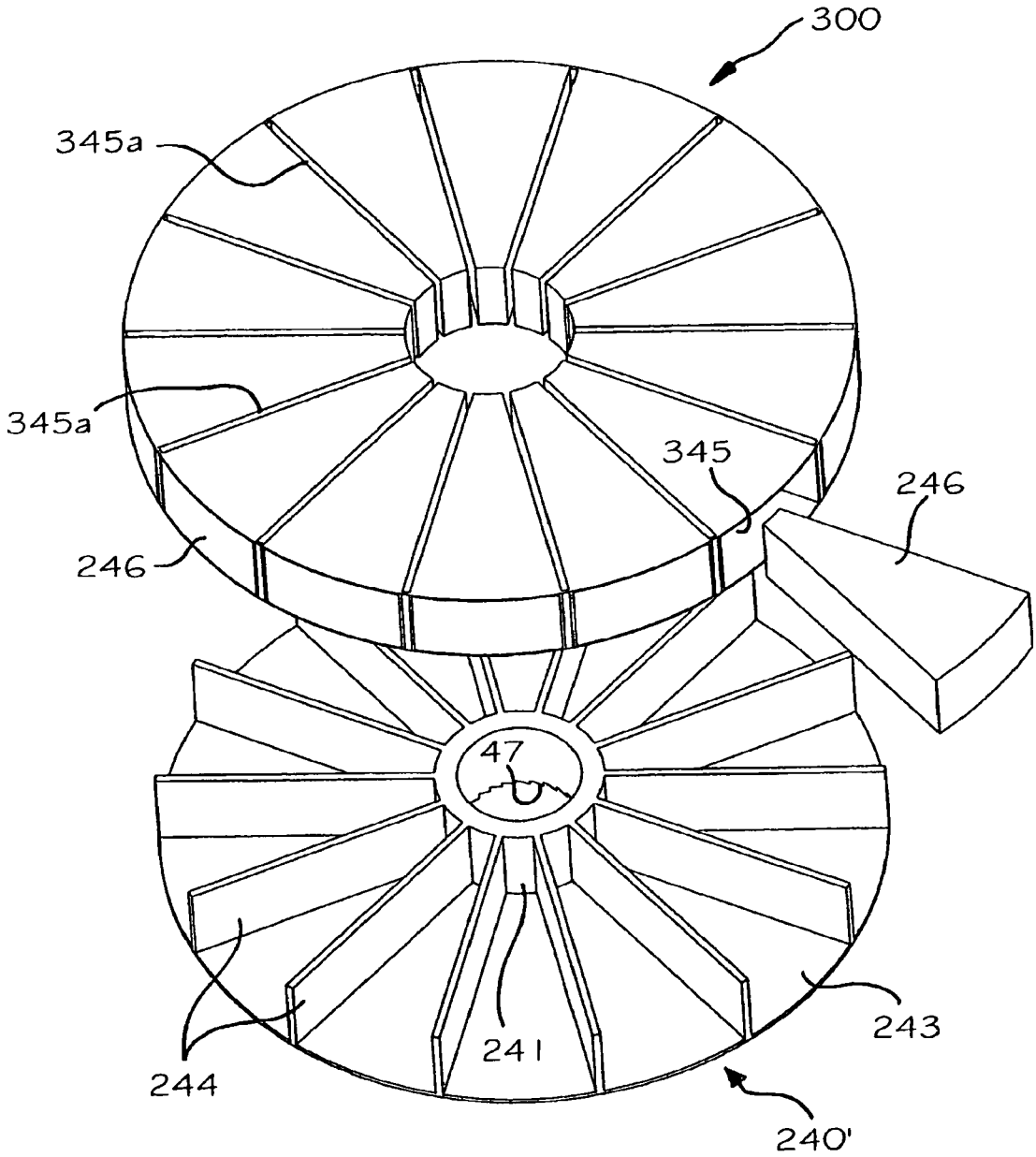
FIG. 65 is a perspective view of a third blister of doses of washing substances, usable in conjunction with a movable support for a dispenser according to the invention.

FIG. 65 illustrates a movable support 240', usable for example as an alternative to the magazine 40' according to the eighth embodiment. In this case the body of support 240', substantially rigid and formed for example of moulded plastic material, essentially has a base wall 243, in the central area of which a tubular part 241 is formed, equipped on its underside with suitable means for coupling to the dispenser's motion transmission system, such as for example a ring of teeth of the type previously indicated by 47. Movable support 240' is designed to receive on its upper side a blister 300, made essentially in accordance with the description given above with reference to FIGS. 62 and 63, but with the difference that, in this case, cells 245 are open in the direction of the circumferential face of the blister. Coupling means are provided between the support and the blister. In particular, in this embodiment the radial cavities 245*b* in blister 300, formed between one cell and another, are suitable for engaging on dividers 244 of movable support 240', which extend radially from the tubular part 244. Note that the presence of the base wall 243, though preferable for the purpose of conferring a certain rigidity to the structure of the movable support 240', must be considered optional. Note also that the above-mentioned movable support 240' is also usable as an alternative to magazines 40 of other embodiments, in combination with the blister 300 shown in FIGS. 62 and 63. Said movable support 240' could advantageously be an integral part of the dispensing device 10, for example being removable only for the purposes of maintenance or cleaning.

Figure 66:
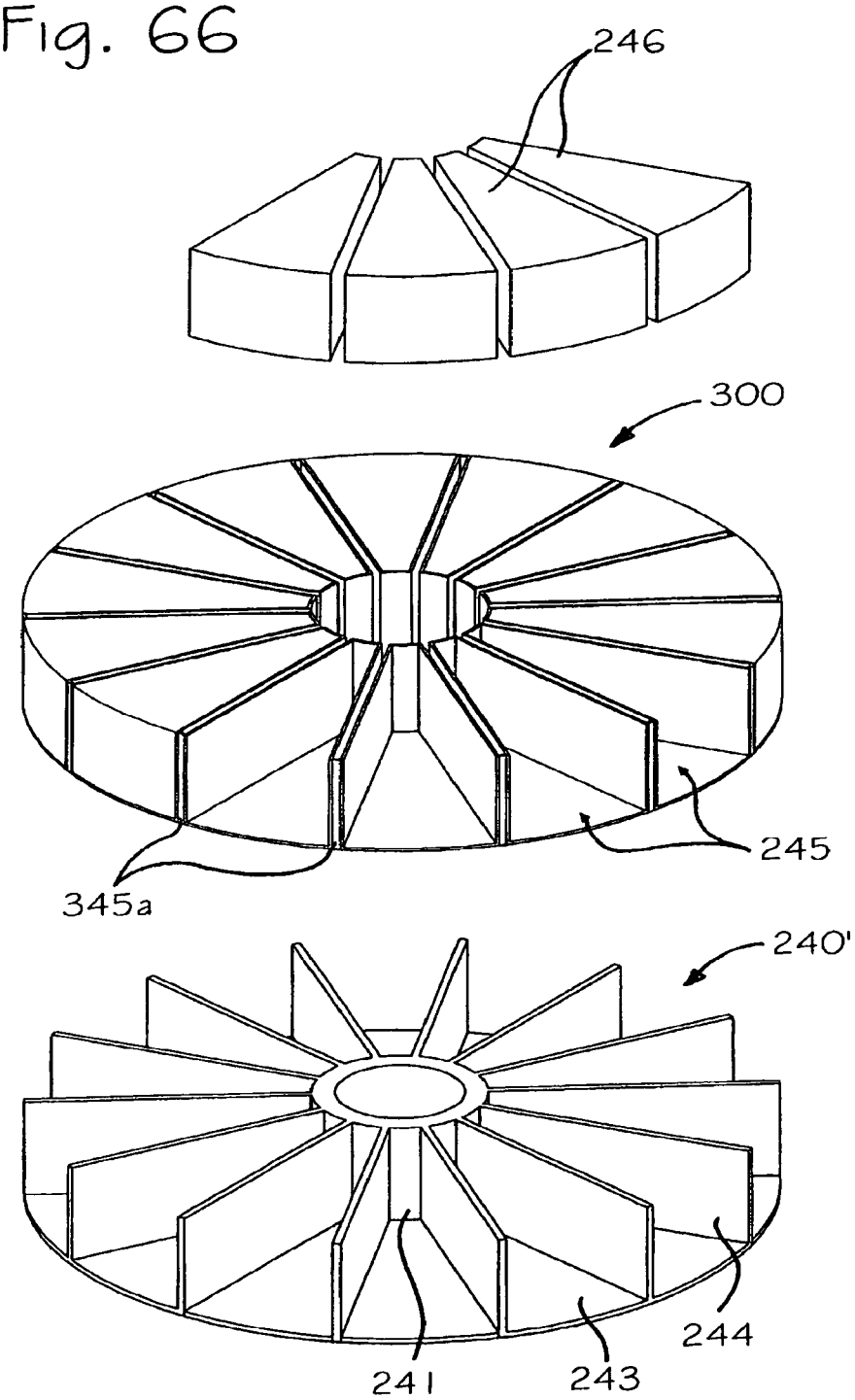
FIG. 66 is a perspective view of a fourth blister of doses of washing substances, usable in conjunction with the above-mentioned movable support.

Finally, FIG. 66 illustrates a further possible embodiment of a blister 300, whose cells 245 are open both in the direction of the upper face, and in the direction of the circumferential face of the blister pack itself. Such a blister 300 is therefore usable indifferently both with dispensers of the first six and the ninth embodiments, and with the dispenser of the seventh embodiment, with the corresponding magazines 40, 40' or with the movable support 240'.

Clearly, the movable supports 240' for blisters 300, which can also have a configuration different from what has been illustrated above, can be equipped with suitable excitation elements of the type previously described with reference to the various embodiments of the invention, for the purposes of use in combination with a detection or encoder system.

Figure 67:
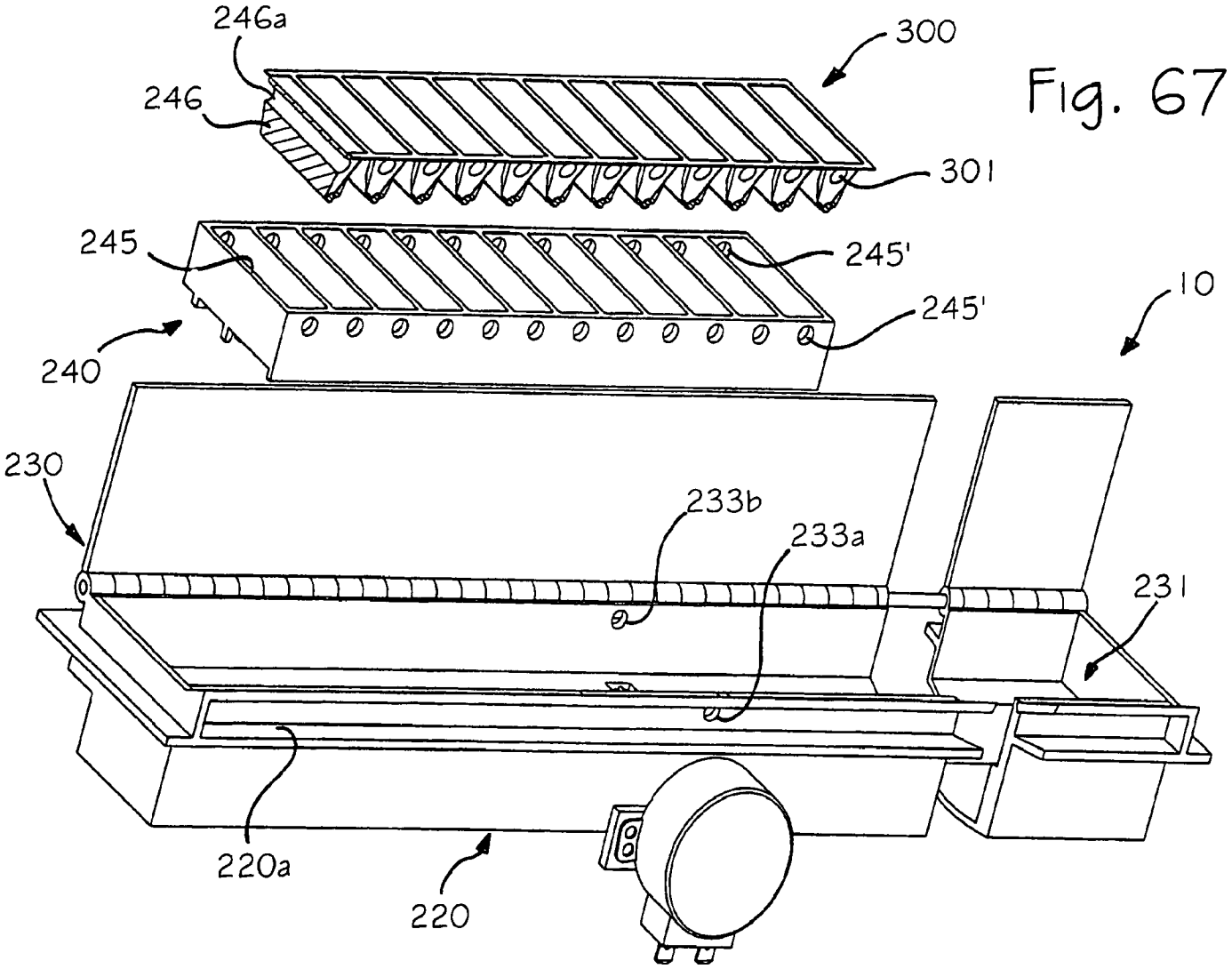
FIG. 67 is an exploded partial schematic view of a dispenser of washing substances made in accordance with an eleventh inventive embodiment.

FIG. 67 illustrates a further inventive embodiment, relating to a dispenser 10 with magazine or support of linear type, or in the form of a linear drawer, substantially similar to the one of the type described with reference to FIGS. 57-59.

In this autonomously inventive solution, on two opposing walls of housing 231 there are provided an inlet aperture 233*a* and an outlet or delivery aperture 233*b*, respectively, substantially aligned with each other or coaxial. Similarly, in line with each receptacle 245, magazine or support 250 is provided with a pair of side passages 245', substantially aligned or coaxial. Passages 245' are formed in the opposing longitudinal walls of the magazine or support 240 in such a way that each pair can be aligned from time to time with apertures 233*a* and 233*b*, as a result of the linear movement of the magazine or support. Suitable sealing gaskets are preferably provided inside housing 231, at apertures 233*a* and 233*b*, having functions similar to those of gaskets 34 in the previous embodiments. Preferably, in the case of magazine or support 240 forming part of the dispenser 10, said magazine or support 240 also can advantageously be fitted with or include further gaskets (not depicted), particularly for the purpose of forming a seal with dispenser 10; dispenser 10 can possibly include further sealing elements, such as gaskets in the cover (not depicted), capable of acting on other open parts of the magazine or support or blister, other than fluid inlet and outlet apertures 233*a* and 233*b*.

FIG. 67 also illustrates a blister 300 usable in combination with dispenser 10; as may be noted, in this example, the plastic body of blister 300 also has respective side holes, one of which is indicated by 301, and each dose of washing agent 246, here in compacted or tablet form, is preferably equipped with at least one passage 246*a*, coaxial or aligned with holes 301. As may be inferred, the arrangement is such that when the blister 300 is inserted into the magazine or support 240, holes 301 are aligned with the respective passages 245'.

In this embodiment, the washing liquid penetrates the inlet aperture 233*a*, and then flows, as a result of the presence of passages 245' and 301, through the dose 246, which is provided for the purpose with the axial passageway 246*a*. In this way, the liquid progressively dissolves and flushes away the dose of washing agent, causing it to be delivered into the washing chamber, through aperture 233*b*.

In the illustrated embodiment, body 220 is configured such that the part thereof designed to be exposed to the inside of the machine's washing chamber forms a sort of basin 220*a*, which acts as a collector and/or conveying member surrounding the inlet aperture 233*a*. This basin 220*a* has the function of collecting some of the liquid sprayed by the machine's sprinklers—for example the liquid which runs down the wall of the chamber in which the dispenser is mounted—and ducting it into the intake aperture 233*a*: in practice, therefore, basin 220*a* operates substantially as a funnel. Clearly, the shape of basin 220*a* can be different from what is illustrated, and in particular can be shaped for the purpose of avoiding stagnation of washing liquid and residues inside it. Basin 220*a* is preferably integrated or made in a single piece with at least one part of the main body of the dispenser, and in particular a body part which faces towards the washing chamber; basin 220*a* is preferably made of thermoplastic material, preferably during a phase of moulding a part of the body of dispenser 10.

The above said basin, when present, has preferably an elongated shape, which for example extends along one side or a perimetral part of the dispenser, such as the upper side or a longest side. By way of indication, the length of the basin can be between 10% and 100%, preferably over 50%, of the length of the above-mentioned side of the dispenser.

The basin can also advantageously be formed at least in part in a front area of the dispenser, such as an area facing towards the inside of the user appliance or of the washing chamber, in a position such as to enable it to convey the flow of liquid by gravity towards the inside of the dispenser and/or towards a relevant delivery outlet.

In an advantageous embodiment, the basin provides for at least one movable part, such as for example a container, a door or a wall which opens towards the washing chamber (for example a linearly or angularly movable drawer), preferably controlled or activated so as to come open during a predetermined phase of the cycle of the user appliance, such as a delivery phase in a washing cycle. This solution makes it possible to have a foldaway basin, i.e., with a limited bulk within the chamber yet with the basin having large dimensions, and/or to maintain the basin in a protected zone when not in use.

The basin can be omitted, in the event that the device according to the invention provides means specifically designed for introducing liquid, such as for example a specific feed duct or a static nozzle, connected to or facing the inlet aperture 233*a*.

The dispenser according to the variant shown in FIG. 67 (and according to the variant shown in FIGS. 57-59) can provide for the use of the magazine 240 alone, without the blister 300, in which case the washing agent, preferably in one-piece or monolithic doses to be delivered, will be inserted and contained directly in the receptacles 245, preferably with a slight interference fit. On the other hand, the dispenser shown in FIG. 67 (and in the version shown in FIGS. 57-59) can be made for operating directly in combination with a respective blister, even in the absence of a relevant movement or dragging support. In this case, it is the body of the blister which represents the support means for the plurality of separate doses of substance, and it is the shaped of the body itself which provides the means for coupling with the dispenser's transmission system and/or cooperating with its detection system.

For example, with reference to the embodiments shown in FIGS. 57-59 and 67, pinion 261 will be capable of cooperating with a succession of valleys and crests formed in the body of blister 300, or it will be of suitable dimensions for cooperating directly with the lower part of blister 300, which is already substantially shaped like a rack (owing to the succession of receptacles 245 having a substantially trapezoidal profile).

The above succession of crests and valleys on the blister, or the "toothed" form of the lower part thereof, can also be conveniently exploited as an excitation element for a detection system with an optical encoder, of the type previously described. Alternatively, the body of the blister can form a suitable succession of excitation elements, such as crests and/or valleys, having the same function as the excitation ring A" shown in FIG. 59.

Clearly also the dispensers of the previous embodiments having a circular housing can be suitable for cooperating directly with a respective blister for angular movement, shaped for the purpose. In this variant, therefore, the body of these blisters will form the respective means for coupling to the dispenser's transmission system (for example with the characteristics described with reference to FIGS. 9, 34, 35 and 40) and/or the excitation means for the detection or encoder system (for example with the characteristics described with reference to FIGS. 42 and 43) and/or the visual indication system (for example with the characteristics described with reference to FIGS. 20 and 45).

Figure 68:
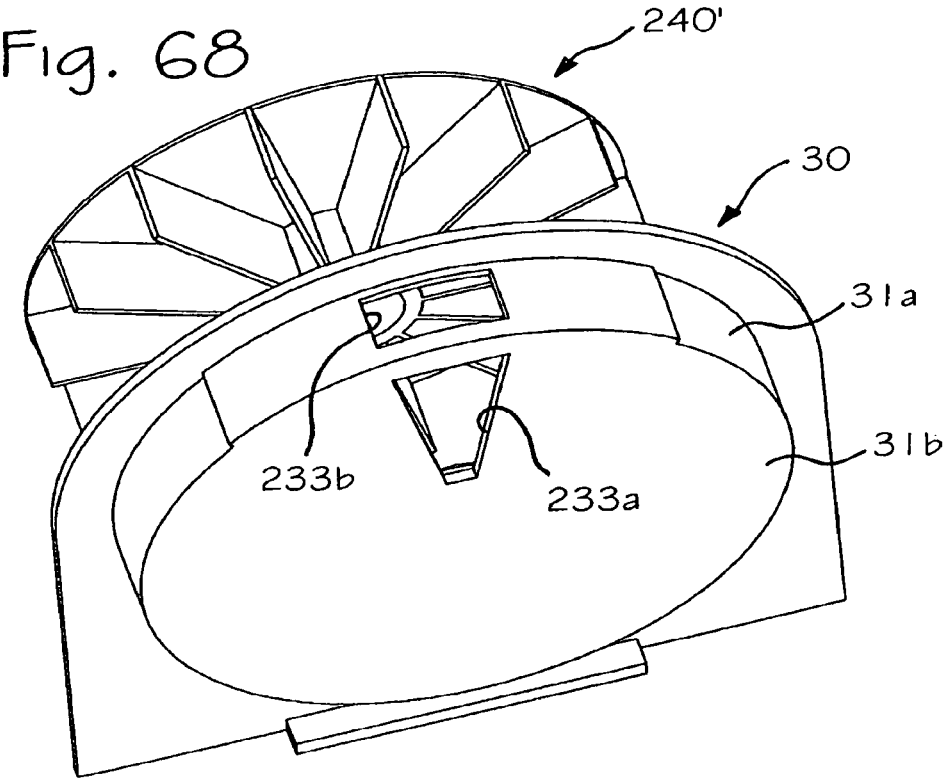
FIG. 68 is a perspective view of a part of a dispenser of washing substances made in accordance with a twelfth inventive embodiment.

The solution, which is in itself inventive, of a dispenser with an inlet aperture and an outlet aperture for the flushing liquid for the washing agent, is clearly also usable in the embodiments previously described. FIG. 68 illustrates for example a generic movable body 30, for a dispenser according to one or more of the preceding embodiments, with rotatable or angularly movable magazine or blister. In this case the body 30 provides two apertures 233*a* and 233*b*, formed on two walls at right angles to each other, specifically the bottom wall 31*b* and the peripheral wall 31*a* of the housing for a respective magazine or blister support; FIG. 68 illustrates the particular case of the use of a magazine/support 240' of the type described above with reference to FIG. 66.

The relative position of apertures 233*a* and 233*b* is such that they both face a same receptacle/cell on the magazine/support contained in the corresponding housing, with the liquid being able to reach the washing agent through one of these apertures, to dissolve it and then draw it out into the washing chamber, through the other aperture.

For example, a dispenser according to the invention, equipped with the movable body 30 of FIG. 68, can be provided for being mounted on the door liner of the machine, similarly to what is illustrated in FIGS. 27 and 28; in this case, aperture 233*a* will be exposed towards the washing jets, for the entry of liquid into the dispenser and into the magazine and/or blister, while aperture 233*b* will be facing downwards, for the liquid to leave the dispenser with the relevant delivery of washing agent. Also in this case apertures 233*a* and 233*b* can be advantageously provided with respective sealing means, particularly with respect to magazine or support 240'; these sealing elements are preferably joined together, to form a single sealing element, and/or moulded or overmoulded directly onto movable body 30.

Figure 69:
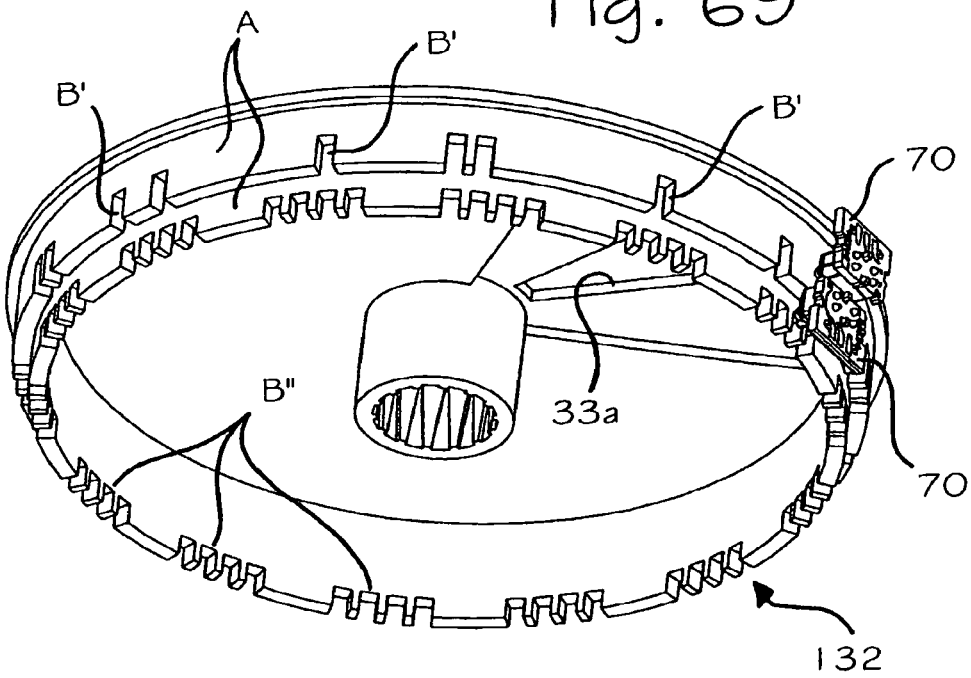
FIG. 69 is a perspective view of a component of a dispenser of washing substances made in accordance with a thirteenth inventive embodiment.

It was mentioned earlier that, in an advantageous embodiment of the invention, which is susceptible of autonomous protection, the position transducer or detection system or encoder with which the dispenser is fitted can be of absolute type. FIG. 69 illustrates in this connection a possible variant of the dispenser shown in FIGS. 54-56, and especially of the rotatable delivery member 132 thereof, which incorporates an excitation element or ring A belonging to the detection or encoder system.

In this embodiment, ring A comprises two distinct successions or series of crests and valleys, designated respectively B' and B". In the example, the series of crests and valleys B' is configured for obtaining a coding of data, particularly of binary type, and therefore forms part of an encoder of absolute type, which identifies the angular position of member 132, and therefore of the respective delivery aperture 33*a* with respect to the magazine contained in the dispenser and/or with respect to the fixed body of the dispenser; the series of crests and valleys B" is configured for generating a clock or synchronisation signal, being useful in order to enable an accurate reading of said binary data or codes obtained by series B', which would otherwise have to be effected on a "time basis", similarly to what was previously described in reference to the example in FIG. 41.

From the figure it will be noted that the coding series B' is formed on the edge of an intermediate step of ring A, while the synchronisation series B" is formed on the lower edge (with reference to the figure) of ring A. This conformation of ring A makes it easy to mould body 132, by the use of a mould that opens in one direction only (i.e. for example made up of two half-moulds which are simply brought together to close the mould and separated to open it). In this way the mould, particularly for injection of thermoplastic material, can be relatively simple, without the need for movable parts, such as carriages or movable cores, which are instead mandatory in the case of series of crests and valleys formed with undercuts (i.e. in a recessed position in the piece, which makes it impossible to extract the piece from a mould which opens only in one direction); obviously, where necessary, conformations can also be provided which require more complex moulds.

Two respective sensors 70 face the two series of crests and valleys B', B" which, in the practical embodiment, are accommodated in a corresponding seat on the fixed body of the dispenser, not represented here, for example located in a side or tangential position relative to the profile of ring A, possibly projecting into the washing chamber. Note that, alternatively, the two series B', B" can both be formed on the upper edge of ring A, in an alternating manner or one on the inner perimeter and one on the outer perimeter of ring A, in which case sensors 70 can be housed in the fixed body part of the dispenser which remains outside the chamber, similarly to the case of the dispenser shown in FIGS. 54-56.

Clearly an absolute encoder of the type described and illustrated can be associated to other movable parts of the dispenser's actuation system, such as the transmission member shown in FIG. 41, as previously mentioned.

Figure 70:
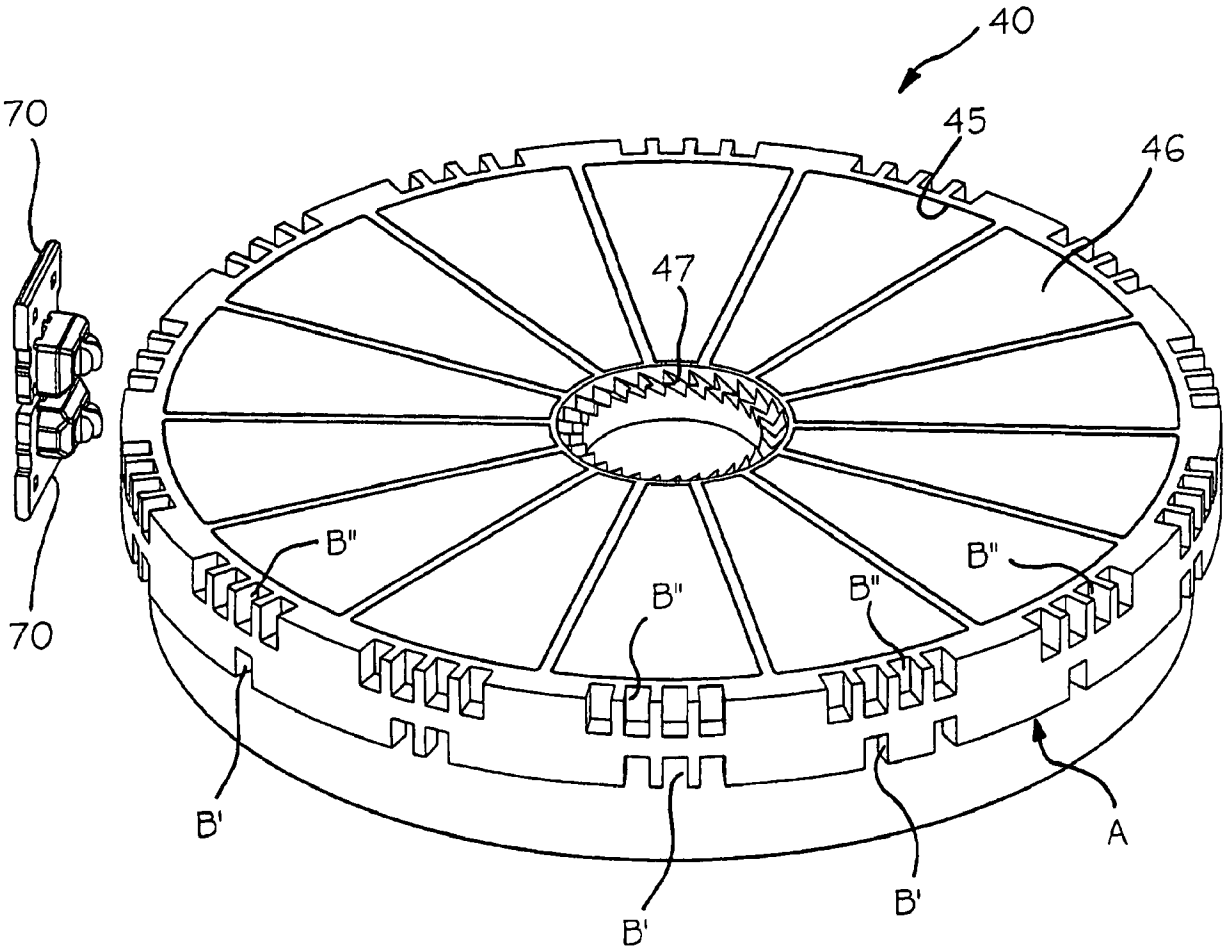
FIG. 70 is a perspective view of a variant embodiment of a magazine for a dispenser of washing substances according to the invention.

FIG. 70 shows the case wherein an excitation ring A for an encoder of absolute type is integrated into a magazine 40. Element A of FIG. 70 has a series B' of crests and valleys configured for obtaining a data coding, particularly a code of Gray type, and therefore making a part of an encoder of absolute type, where a given code identifies/distinguishes a given receptacle of magazine 40; the series of crests and valleys B" is configured for generating a clock or synchronisation signal, as in the previous case. Apart from the different type of coding (binary codes vs. Gray codes), the operating principle of the rings A shown in FIGS. 69 and 70 is the same. Note that the embodiment shown in FIG. 70, in which the two series, B', B" are obtained on opposite edges of ring A, without undercut parts, allows a simplified moulding of the piece, in particular according to the techniques described in reference to the example shown in FIG. 69.

Also in the case of the variant shown in FIG. 70, the encoder system provides for two sensors 70, which will be accommodated in a respective seat in the fixed body of the dispenser, in a lateral or tangential position with respect to the profile of ring A; alternative arrangements for sensors 70 are obviously possible, such as one lateral sensor and one sensor in the internal part of the dispenser, for example at right angles to each other. The two series B', B" shown in FIG. 70 can also both be formed on the same edge of ring A, in alternating manner or with different layouts, in which case sensors 70 can be housed in the fixed body part of the dispenser which remains outside the washing chamber, similarly to the case of the dispenser shown in FIG. 32 or in FIG. 43.

It is evident that coding systems of absolute kind, for example similar to those described with reference to FIGS. 69 and 70, can be formed in excitation rings A which are removable from the respective magazine, as illustrated for example in FIG. 32 or 43. It is equally clear that a coding of absolute type, with a possible series of synchronising crests and valleys, can be provided in the case of dispensers with magazine or support or blister with linear movement (FIGS. 57-60 and 67). It is equally clear that the coding elements for the data and any synchronisation can be formed directly on the blisters, for the versions of dispenser which do not require a magazine or support for pulling/moving the blister.

The dispensers have been described above with particular reference for use in combination with a dishwashing machine, but it is clear that the inventive solutions can also be used for other types of washing machine, such as laundry washing machines and laundry washer-driers, or for driers, in which case the dispenser is for example suitable for delivering a deodorant substance, flushed from the relative magazine by a flow of air.

Figure 71:
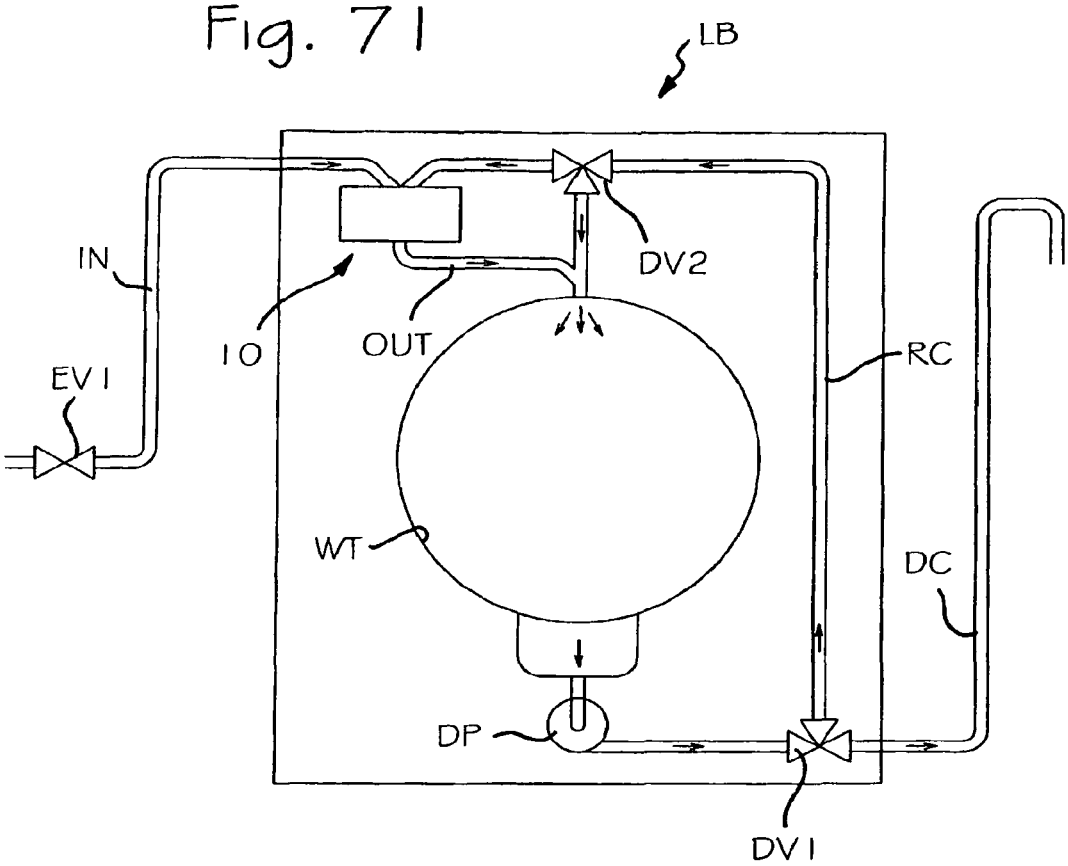
FIG. 71 is a schematic representation of a machine for the treatment of laundry using a dispenser of washing substances according to the invention.

FIG. 71 illustrates schematically a possible example of application of a dispenser according to the invention in a laundry washing machine, designated by LB. Such a machine LB can for example a top loading washing machine, wherein the dispenser can be at least in part mounted or associated to the upper door of the machine: in this case, possibly, the part of the dispenser which integrates the actuation system and the electrical/electronic components of the detection system or encoder can be mounted on the door of the machine, while the housing for the magazine (or for the support with the respective blister, or for the blister alone) can be associated to the fixed structure of the machine. Another possibility is that of using a dispenser having a configuration similar to that of FIGS. 27-29, associated to the door of the machine, in such a position that it faces the opening which gives access to the washing chamber, when the door is closed. In the case of a front loading laundry washing machine, the dispenser can be of the type having a movable body 30 which is slidable like a drawer, accessible for example from the front of the machine, and with the delivery outlet 33*a* in communication with the inside of the washing chamber, for example by means of a respective duct.

In the case of FIG. 71, dispenser 10, represented only schematically, is of the type having an inlet aperture and a delivery aperture (in relation to this concept, see the description given with reference to FIGS. 67-68); alternatively, the dispenser 10 of FIG. 71 can even be equipped with a single aperture, onto which a fluid, such as the washing fluid, is sprayed or made to travel.

The inlet aperture of dispenser 10 is in communication with a duct IN for water intake, connected to a domestic water network, not represented; a known solenoid supply valve EV1 operates on the conduit IN. The delivery outlet of dispenser 10, on the other hand, is in communication by means of a duct designated by OUT with the inside of the washing chamber WT of the machine LB, which houses a customary laundry basket, not represented, rotatable about a respective axis. In the example depicted, furthermore, machine LB is equipped with a system for recirculating the washing liquid, comprising a discharge pump DP, a first diverter valve DV1, a recirculating duct RC and a second diverter valve DV2. Valve DV1 is configured for directing the liquid driven by the pump DP either towards a discharge pipe DC or alternatively along the recirculating duct RC. The latter terminates at a second diverter valve DV2, configured for directing the liquid either towards the washing chamber WT, or alternatively towards the inlet aperture of dispenser 10. The operation of the various valves EV1, DV1, DV2 and of pump DP is suitably managed by the control system of machine LB, in accordance with the phases of the relevant washing cycle, in a way which are be clear to a person skilled in the art.

The control logic of machine LB, and therefore of dispenser 10, can clearly be configured for managing various operating conditions. For example, dissolution and delivery of a first dose of detergent contained in the magazine or blister in dispenser 10 can be brought about by means of a flow of water from the water network, by controlling solenoid valve EV1; the water from the network in this way transports the detergent into the washing chamber, by means of the duct OUT. The dissolution of a second dose of detergent, to be delivered at a later time during the cycle, can however be brought about by recirculating the washing liquid, which is achieved by activating pump DP, with valve DV1 directing the liquid into duct RC and valve DV2 directing the same liquid to the inlet aperture of dispenser 10; in this case it is therefore the recirculating liquid which transports the detergent into the washing chamber, by means of the duct OUT.

In other possible solutions, the water from the network can bring about a partial flushing of a dose, the remainder of the same dose being flushed out at a later stage by the recirculating liquid. Another possibility again is to bring about the flushing of the detergent always by means of the recirculating water or always by means of the network water (in this second case, obviously, the presence of a recirculating circuit for the washing liquid is not mandatory).

In case where an operating cycle of the machine calls for an initial phase without the use of detergent, the duct IN can have associated to it, upstream of the dispenser's inlet aperture, a diverter valve with a bypass duct in communication with the washing chamber WT, such that the water does not necessarily pass through the dispenser 10 every time it is supplied from the water network.

Moreover, in a possible alternative solution, the magazine or blister can be of the type having a respective receptacle or cell empty of detergent from the very start. In this case, thanks to the presence of the detection system or encoder, the control system of machine LB can manage movement of the magazine or blister so as to position between the inlet and delivery apertures of the dispenser the above-mentioned receptacle or cell empty from the very start, or even another empty receptacle or cell, from which the relevant detergent has earlier been removed.

In the embodiments previously described, inventive dispensers have been described with reference to an encoder or position/movement transducer of digital type. Direct or indirect detection of the position and/or movement of the support means for the substance to be delivered (whether it be the magazine, the movable support or the blister) or of a transmission member, can however also be effected obtained using a position transducer substantially of analog type.

Figure 72:
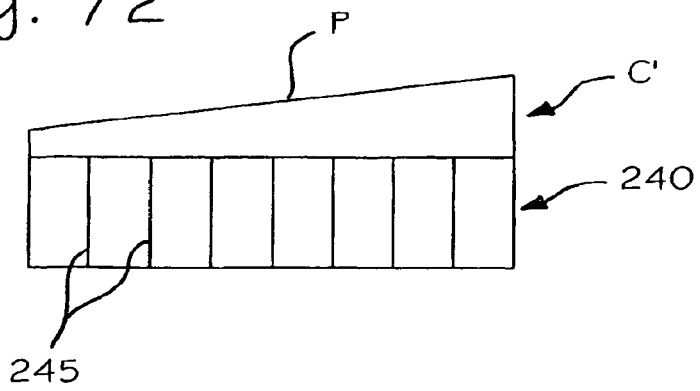
FIG. 72 is a simplified schematic representation of a magazine usable in a dispenser according to the invention, configured for cooperating with a detection or transducer system of analog type.

To this purpose, FIG. 72 represents schematically a generic magazine 240 with linear movement, having respective receptacles 245. Magazine 240 has, on one of its sides parallel to the direction of movement (here one of the longer sides), an excitation element C', defining a legible profile or inclined plane P.

Plane P of excitation element C', which is assumed to be made of magnetic material (for example magnetised plastoferrite) is designed to come more or less close, in function of the linear movement of the magazine 240, to a respective detection unit or magnetic sensor (for example a Hall effect sensor) of analog type, mounted in a static position on the fixed part of the dispenser and capable of providing as output a signal which, is proportional in voltage or in current to its distance from the inclined plane P.

Figure 73:
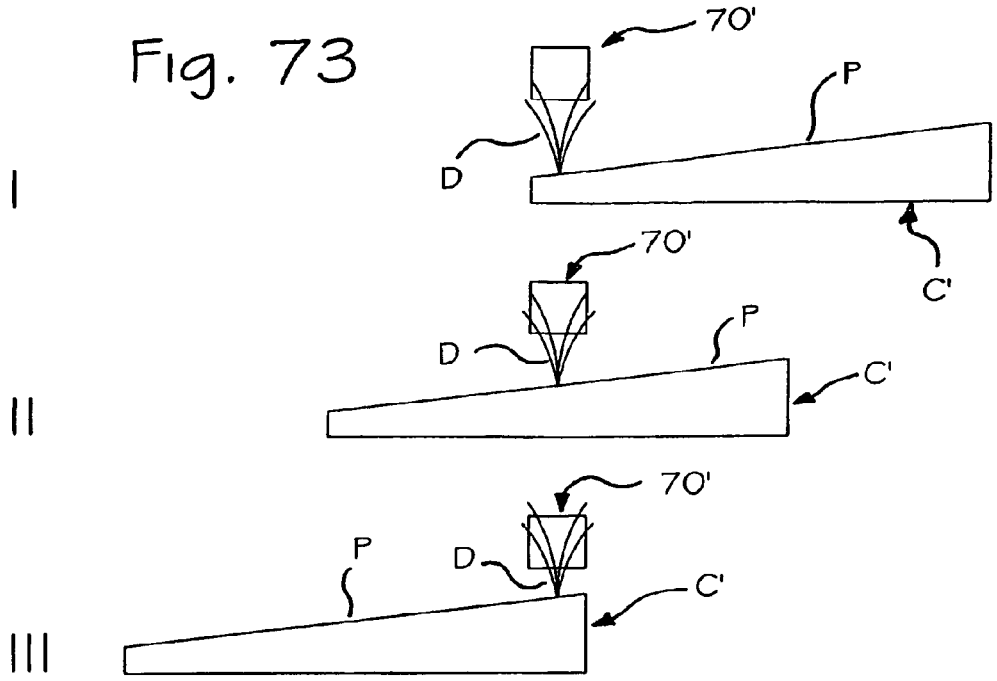
FIGS. 73 and 74 are simplified schematic representations of the operating principle of two detection or transducer systems of analog type.

The operation of the analog position/movement transducer is illustrated in FIG. 73, which shows only the above-mentioned sensor, designated by 70', and the excitation element C' in three different positions, marked I, II and HI, corresponding to three different positions of magazine 240, for example initial, intermediate and final. The intensity of the magnetic field (schematically indicated by D) detected by sensor 70' is proportional to the position of magazine 240: as may be inferred, therefore, the position of each receptacle 245 corresponds to a predefined level or value of the intensity of the magnetic field detected by sensor 70', which consequently generates an analog signal. This signal is interpreted, in ways that are in themselves known, by the circuit which manages the operation of the dispenser, to detect the current position of the magazine 240.

Note that, in another solution, excitation element C', for example again made of magnetic material (such as magnetised plastoferrite) can be configured to remain at a constant distance during the movement of magazine 240 with respect to the analog sensor, for example of magnetic type, fitted to the dispenser. In this case the excitation element is advantageously magnetised with different values of magnetic field at different points along its development, length or perimeter, or is magnetised with sectors of different intensity of magnetic field, in order to induce in the sensor a signal proportional to the intensity of the magnetic field detected, or proportional to the position of the excitation element with respect to the position of the sensor fitted to the dispenser.

Figure 74:
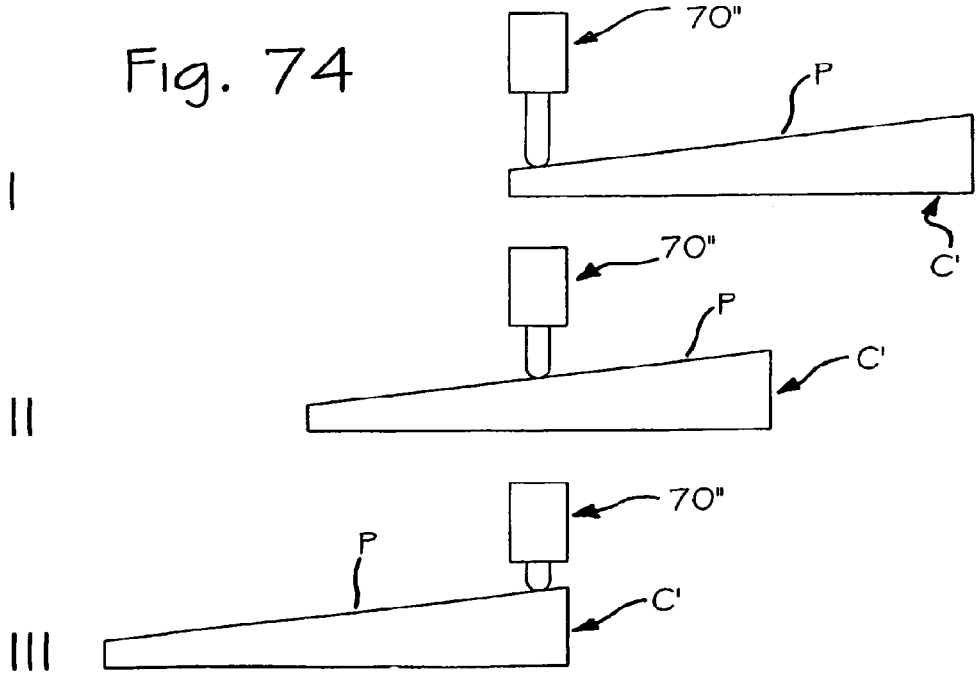

FIG. 74 schematically illustrates another example of an analog position transducer in which the sensing means or detection unit 70" is of the type having a movable slider, for example a potentiometric or resistive sensor of known type, whose resistance value varies in proportion to the movement or path of the relative slider. In this case the excitation element C can be formed in one piece with the body of the magazine 240, for example in thermoplastic material. In this implementation the slider of sensor 70" interacts with plane P to take on a respective more or less advanced or retracted position, depending upon the position of magazine 240 (FIG. 72), with a consequent variation in the resistance value of the sensor in the various positions. In this case the dispenser's control circuit will be capable of recognising the position of magazine 240, depending upon the resistance value of sensor 70".

Obviously the transducers or sensors 70', 70" can be of other type, with or without contact with excitation element C'.

Figure 75:
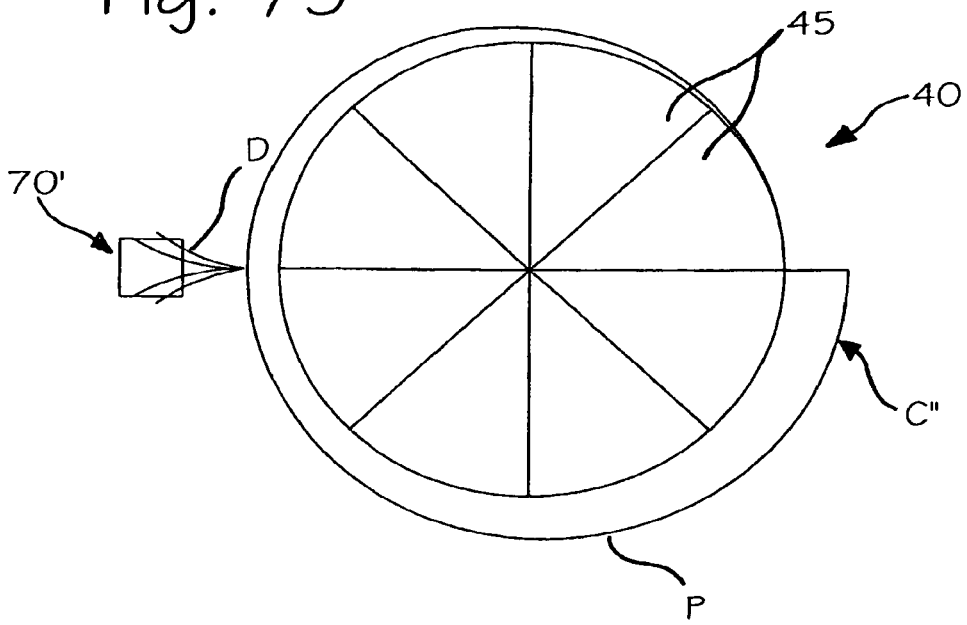
FIGS. 75 and 76 are simplified schematic representations of a magazine usable in a dispenser according to the invention, in conjunction with a first and a second detection or transducer system of analog type, respectively.
Figure 76:
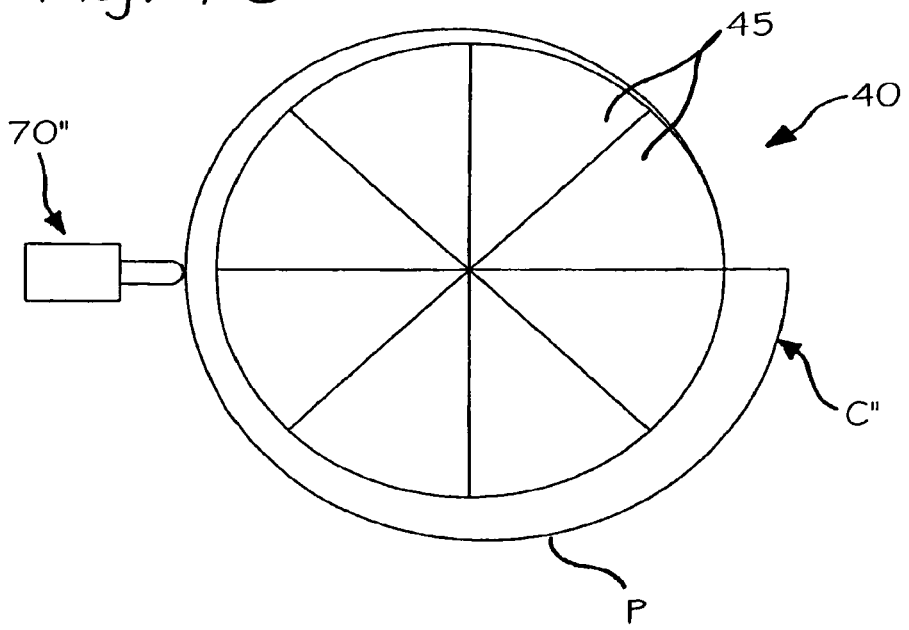

Clearly, an analogue position/movement transducer can also be used in the case of a magazine with angular movement. FIGS. 75 and 76 schematically illustrate a magazine 40 having with an excitation element C", mainly circular and having an eccentric or "spiral"-shaped external profile P, which is associated to or integrated into, for example, the main circumferential wall of the magazine. FIG. 75 illustrates the case of a magnetic transducer, conceptually similar to the one of FIG. 73, with the excitation element C" made of magnetic material, and sensor 70' of magnetic type. FIG. 76 on the other hand illustrates the case of a potentiometer transducer, conceptually similar to the one of FIG. 74, with the excitation element C" in any material and sensor 70" of potentiometric/resistive type.

Note that the development of both elements C', C" illustrated can be considered equivalent to a triangle or a prism with inclined plane (a different development or profile P could moreover be adopted, as long as it is capable of creating a proportional variation in the sensor 70', 70"). Note also that analog transducers as in the non-limiting examples shown in FIGS. 72-76 can be considered equivalent to encoders or transducers of absolute type, since the position detected is univocal (as has been said, the value for voltage, current, resistance or magnetic field detected by sensor 70', 70" always corresponds to a predefined position).

It is evident that a similar transducer system can be used for the purposes of detecting the position of a transmission member in the actuation system, instead of a magazine, or the position of a blister support, or directly of a blister, which will consequently be provided with excitation elements of the type designated by C' and C", and the fixed part of the dispenser will be fitted with the respective sensor 70' or 70". It is equally evident that an excitation element for an analog transducer system, for example of the type designated by C' and C" can be configured as a component removably associated to the support means for the substance to be delivered, or to a transmission member in the dispenser's actuation system, similarly to what has been described above with reference to rings A or A' (see for example FIG. 43). Irrespective of their type or implementation, therefore, the reference or excitation means described (A, A', C' C") can be made in a single piece with the support for the substance or with the component of the actuation system, or applied or associated to this support or component.

As seen above, in the case where the reference means are associated to the support, the dispenser's control logic is capable of identifying these reference means. As a result of this recognition, the logic can estimate the type of support and/or the amount of substance in the support and/or the operating condition of the support and the relative position between support and body of the dispenser. With reference to the latter assessment, the control logic therefore provides for the phase of aligning a part of the support with the dispenser's delivery aperture. This alignment can be controlled by feeding-back the signal arising from the identification, carried out on the reference means, to the dispenser's actuation system. When the part of the support is aligned with the delivery aperture, the part itself is, as a result, exposed or subjected to dissolving means, which can strike the part of the support, or flow into it, and thus dissolve at least part of said substance, for the purpose of delivering it.

Among the advantages of the inventive solutions described it has to be underlined the simplicity of the dispenser, whose components can for the most part be made by simple thermoplastic moulding operations. The device takes up extremely little space compared with known devices intended for fixing to one of the faces of the washing chamber, or to another fixed part of the machine, and it is extremely simple and convenient for the user to use. The fact that in some embodiments the actuation system is capable of assuming—automatically or manually—an inoperative condition of not being coupled with the magazine or movable support or blister, allows the latter to be easily removed for easy replacement or refilling or periodic cleaning. The fact that the device preferably provides for a cover for accessing to the whole magazine or movable support and/or to the relevant housing allows easy maintenance and cleaning, even without removing the magazine or movable support.

The fact that the magazine or movable support or blister is configured for retaining discrete portions of a solid substance in receptacles or cells insulated from each other avoids the risk of clogging which is typical of the devices according to the prior art. The possibility of synchronising the phase of delivering the substance or product with a phase of the operating cycle of the machine in which jets—possibly "reinforced"—of washing liquid or other fluids are active, allows faster and more reliable delivery.

The fact that the dose of substance is "monolithic", for example in tablet form, and preferably made integral with the magazine or movable support or blister, and is removable only by the action of a liquid, enables the substance itself to be maintained in an optimal position for at least a significant part of the cycle of delivery from the dispenser, particularly with precise positioning of the dose of substance with respect to the above-mentioned flow of liquid.

The fact that, preferably, the magazine or blister or movable support remains always completely inside the body of the dispenser—and that anyway, even the part with the receptacles/cells from which the washing agent has already been removed, remains protected—avoids further obstacle in the machine's washing chamber and also the risk of the operation of the dispenser being obstructed and jammed by foreign bodies, such as a crockery basket or contents thereof, as well as risks of breakages of crockery as a result of any interference.

The provision of a device or system for detection of movable components of the dispenser's actuation system, i.e., the presence and/or movement of the support means for the doses (the magazine, or the blister support or the blister itself) guarantees the quality and reliability of the deliveries, and gives the user timely and accurate warning about the state of operability of the device. The availability of a synchronisation signal, generated by exploiting a movement caused by the dispenser's actuation system, increases precision of the said detection system. The provision of this detection system, particularly based on an encoder or position/movement transducer, also means that the number of components in the dispensing device can be reduced, thus allowing a reduction in costs and in bulk, and ensuring greater reliability. Substantially for the same reasons, it is an advantage that a control on the support for the substance can be made by exploiting means comprised in, or associated to, the support itself.

The support means for the doses (i.e., the magazine or blister support or the blister itself) for the dispensers according to the inventive solutions described could clearly have a different shape than those described and/or illustrated earlier, for example, with an outline like a sector of a cylinder (or with development only over an arc of circumference), or a combination of shapes at least in part circular or linear. Similarly, the excitation element for the encoder system could also have shapes other than those above illustrated. For example, this excitation element could have a semicircular outline, in the case of the variant above mentioned in relation to a semicylindrical magazine or support or blister, or a combination of shapes at least in part circular or linear, or at least shapes partly similar or complementary to those of the support means; another possibility is to incorporate or associate the excitation element in an internal or central area of the magazine or support, for example in the form of an annular element of compact diameter, in proximity to the ring of teeth 47.

In the case in which a device according to the invention is equipped with a plurality of sensors, these can all be mounted on a single printed circuit board, suitably shaped. With regard to the encoder detection system (whether it is of optical, magnetic inductive or other type, and whether incremental or absolute, digital or analog), note that a member configured for performing the functions of the coding ring or excitation element previously indicated with A or A', but of smaller dimensions, could possibly be associated directly to the rotating shaft of the motor, or to an element associated to it, in the part of the device designed to remain in the cavity formed between the washing chamber and the cabinet of the machine; as has already been stressed, the ring or other coding or exciting element can therefore not be associated to the magazine or movable support, but to members that move with the dispensing device 1, not necessarily removable members.

An additional sealing element, similar to gasket 34 can be provided also on the surface of the main wall 21 of fixed body 20, facing towards the housing for the magazine or movable support; in this variant, the above-mentioned wall 21 is provided with a seat similar to the one previously indicated by 33, but without a through aperture; the above-mentioned additional sealing element can possibly have one or more passageways, positioned at the windows for the optical sensors or, in case of a magnetic detection system, can be completely without openings. The provision of this additional sealing element is particularly indicated for cases where a dispenser according to the invention is equipped with a container for the washing agent(s) with receptacles open at both ends thereof (i.e., in cases where wall 43 is not provided). Obviously the use of a pair of opposed gaskets is also preferred in the case of a dispenser with inlet aperture and outlet aperture for the liquid for flushing out the washing agent.

As has already been mentioned, the dispenser and the control system which manages operation thereof can possibly be designed to allow the magazine or movable support or blister to move in the direction opposite to that of normal operation, particularly to reposition a dose of detergent in an area protected from jets of washing liquid, after flushing out/delivery. In this way, in practice, in a first phase of the washing cycle it becomes possible to flush out only part of the detergent which constitutes a single dose; in a subsequent phase of the cycle, the receptacle or cell containing the remaining detergent is again positioned at the dispenser's delivery aperture, in order to be struck by the jets. In this variant the control system or circuit is preferably configured to detect the two directions of rotation, by means of an encoder detector of the type described, and process the signals generated by this detector for counting and checking the position of the relevant magazine or support. The control system or circuit could also control the time of delivery, or detect the concentration of dissolved detergent by means of suitable electrodes or sensors, in order to determine when to carry out repositioning of the doses of detergent into the above-mentioned protected area.

The detection means provided in a dispenser according to the invention, and particularly the sensors **70*b*-70*c*** for the presence of detergent could be of a contactless type different from those illustrated above (for example capacitive sensors) or include detectors with physical contact (for example micro-switches or push-buttons).

The motor means of a device according to the invention can be of the type allowing precise positioning of the support means for the substance to be delivered without the use of specific sensing means. One possibility in this sense is for example to use an electric stepper motor, of a design which is in itself known, i.e., of the type capable of controlling precise and controlled displacements, without the need for position sensors or an encoder. Another possibility is to use an electric motor provided with a control circuit configured, in a way which is in itself known, for controlling the angular position of the corresponding rotor through the detection of electrical quantities relating to the motor itself, such as for example variations in inductance or voltage at the ends of the motor windings.

The substance to be delivered can be in a single block, for example configured like a large tablet, from which doses of the substance itself are dissolved little by little in the various operating cycles of the appliance. In this case the support means for the doses to be delivered can be represented directly by the single block of substance itself, suitably shaped to cooperate with the system for movement transmission, and possibly configured as a blister, or a specific movement support for the block can be provided, with the block and the support defining mutual coupling means (see for example the description given with reference to FIG. 65). The block is moved, by means of the actuation system of the device, for the purpose of the various deliveries. For example, at least the deliveries subsequent to the first one can be performed by moving the support means in order to bring a portion of the above-mentioned block at the device's delivery system; in this position, a flow of liquid causes partial dissolution of the block at the portion thereof which is exposed to the said aperture, with a part of the substance being delivered as a result; later—for example after a programmed time, considered sufficient for achieving the delivery of the desired quantity of substance—the support is moved again, to bring the block into a protected position with respect to the delivery aperture. This implementation is also applicable in the case of the embodiment shown in FIGS. 53-56, in which the block of substance remains static and it is the rotatable delivery member 132 instead which is moved for the purposes of delivery.

The detection means provided in a dispenser according to the invention, and particularly the sensors for the washing agent and/or for the magazine (70, 70*b*-70*c*, 110, 270, A, A', A"), could be of a different type from those illustrated above (for example capacitive sensors, or sensors including electronic circuits with components of active and/or passive type, such as integrated circuits, memories, antennae, resonator circuits and/or oscillators, condensers, inductances, resistances, etc.), or include detectors with physical contact (for example micro-switches or push-buttons). On the basis of the principles set forth above, the detection means—together with the corresponding control system—can conveniently be configured to also allow the automatic execution of a phase of identifying the type of magazine or blister (and/or of the relative washing agent(s)), during at least one movement thereof inside the dispenser. In this connection, the control system can also be arranged to automatically set parameters of the washing cycle and/or modes of actuating the dispenser in function of the identification carried out by the detection means, and/or arranged for providing information to the user, for example in the event that the magazine or blister fitted (and/or the corresponding washing agent or agents) are not suitable for the selected function or cycle. In this way it is also possible to avoid confusion on the part of the user or incorrect operations; as already mentioned, the detection means can also be exploited for the purposes of controlling automatic positioning of the cartridge or blister such that it goes to the starting position without the user having to worry about inserting it in the correct position inside the dispenser.

In possible alternative embodiments the magazine or movable support can be configured as a non-removable part of the dispenser (for example hinged to the movable body 30' shown in FIG. 31 or 32), in order to be refilled manually by the user with tablets of washing agent, preferably inserted with an interference fit, and possibly provided with a respective wrapper as in the blister pack versions described above.

The magazine or movable support or blister could be configured to execute displacements resulting from the combination of several movements and/or in several directions and/or along two orthogonal axes (for example movements according to a X-Y matrix or table, i.e., with movements of the magazine both in a first direction and in a second direction transverse to the first, or with movements of the magazine in a first direction and movements of the delivery aperture in a second direction transverse to the first).

Various inventive solutions have been described above with reference to a specific use in the dishwasher field, but it is clear that they also have applications in the case of dispensers for other appliances of domestic type, particularly dispensers of washing agents for other types of washing machine such as laundry washing machines and laundry washer-driers, as exemplified above, or for dispensers of other agents and substances, such as deodorant agents in dishwashers, washing machines and/or driers.

The term "domestic appliance" is intended to embrace all devices or appliances which could be present in a building for civil use, including the relative systems, and in particular sanitary and/or plumbing and/or air conditioning and/or heating systems. A dispenser according to the invention could advantageously have applications in other than the domestic sphere, as for example for the purpose of delivering doses of fertilisers in irrigation systems, particularly in systems where a flow of water is designed to dissolve and flush out the substance dispensed.

The term "washing substances" or "washing agents" is intended furthermore to include not just detergents and rinse aids, but also other substances that can be used in the above-mentioned fields of use, such as softeners, perfumes, anti-discoloring substances, water-softening and anti-limescale substances, disinfectants, fertilisers, etc., as well as all other substances or products destined to be delivered in doses in a domestic environment.

The elements described with reference to a magazine, and in particular elements of the sensing means, as well as of the means and systems for detection and/or control, are applicable in whole or in part also to the solutions described with reference to a blister pack and/or a respective movable support.

Clearly, if the dispenser is intended for use in combination with blister packs, the relevant magazine or movable support can be configured as a non-removable part of the dispenser itself, or could be omitted.

The above-mentioned detection and/or control system, particularly of the encoder type, could advantageously have applications in other types of dispensers for substances, even those not necessarily having removable elements.

In the examples previously described, reference has been made to a control system of the closed loop type, for example adapted to perform at least one detection of the status of the dispenser and consequently controlling the relevant actuation kinematics. However, the dispenser and/or the control system thereof can be configured for a control of the open loop type, for example a control of the actuation kinematics even without a previous detection of the status of the dispenser.

The position/movement transducer or encoder used in a dispenser according to the invention can be of the type comprising a sensing device capable of detecting intensities or different types of color or optical image, where this difference of color or image is indicative of the angular or linear position of the support means of the substance to be delivered, or of a transmission member of the actuation system.

Such a variant can be clarified with reference to a magazine with perimetral or central optical indicator being visible by user (see for example FIGS. 20 and 45). An indicator of this type can have a suitable sensor operatively associated to it, in such a way that the above-mentioned intensity and type of color of the optical indicator in the various positions is converted or associated with a relative value, such as a value of voltage, current, resistance, etc.

The sensor device used for this purpose can advantageously be of the type referred to as "array", i.e., comprising a multitude of individual sensor or optical elements arranged side by side, which make it possible to detect the optical differences or the different intensities or types of color along a stretch equal to the length or size of the sensor itself (sensors of this type are for example used in customary scanners or photocopiers). For example, with reference to a magazine having an optical indicator of the same type as the one of FIG. 20, an array sensor can be oriented in the direction of the height of the magazine and mounted in a protected position in the area of the perimetral edge of the relevant housing, with the possibility of discriminating between the different heights or layouts of the colored elements of the indicator (for example, red and green), so as to deduce not only the number of doses remaining in the magazine, but also their angular position.

The optical device could also be of another known type, such as for example a sensor capable of converting a color to a voltage value or a frequency signal, or other kind of electrical signal. There is also the possibility of using an optical sensor capable of recognising a relatively complex image (for example an optical sensor of CCD type), with the resultant possibility of also recognising graphic signals or numbers associated with the element whose position it is desired to control.

For reasons of practicality, this optical device or sensor can be mounted in the dispenser in a position which is offset relative to the position of the optical indicator visible to the user, i.e., located in a position corresponding to a different sector of the support. In such a configuration, the detection and/or control circuit or system is advantageously configured for the purpose of taking this difference into account, such that the relative detection is interpreted correctly. If, for example, the sensor is positioned offset by two positions in advance of the optical indicator or of the delivery position (i.e., offset forwards by two receptacles or doses in the support), the electronic control circuit can detect the actual position of the support with respect to the sensor and then "add" two positions to the detected value, in order to determine the real position of the support with respect to the discharge aperture.

In a further variant, the doses of the substance to be delivered are configured to form part of the detection or encoder system. In this variant, for example, the doses can be variably colored or shaded within the range of colors, these various colors or shades of color being detectable by means of a suitable color sensor, of the type mentioned earlier; similarly, the doses shaped into tablets can have different shapes from each other, for example by having different heights in increasing order, adapted to be detected by a suitable sensor, such as a height position transducer. Differences in color and shape can possibly be used also for detecting different types of refill for the dispenser (for example, a white magazine or dose for a detergent, a blue magazine or dose for a rinse aid, a pink magazine or dose for a deodorant agent, and so forth).

In another solution which is inventive per se, the support for the substance to be delivered, or a component which can be associated to it (such as ring A of FIG. 43) can include non-volatile memory means, preferably a solid-state memory, adapted to retain information concerning the position of the support in the dispenser and/or the type of support and/or the substance or substances to deliver and/or the position of the substance in the support; preferably, identifying information about the position can also be used to identify the type of support and/or substance. In such an implementation, the dispenser or the control system which manages operation thereof has electronic means for the reading and/or the writing of said memory means, positioned, for example, so as to be operative when the support is in a predefined position within the corresponding housing (for example the position assumed by the support following a refill of the substance). This functionality can be implemented so as to provide for only reading of the content or the data of the memory means, or both reading and writing, or updating of the content or the data of the memory means (for example rewriting the value for the position or the remaining amount of substance). The functionality in question can be advantageously implemented using communication or transmission means, particularly wireless or radio frequency (RF) means, such as for example the known technology of "transponders" or "RFID" or "Tags", of read-only or rewritable (read/write) type, by integrating or associating to the support a suitable electronic circuit or chip or transponder, having memory and/or communication means, and providing the control system which manages the operation of the dispenser with a corresponding control and/or communications circuit, such as a wireless circuit for reading and/or writing transponders or tags. The transponder or the like is hermetically sealed into the support or into the component associated to the support.

Figure 77:
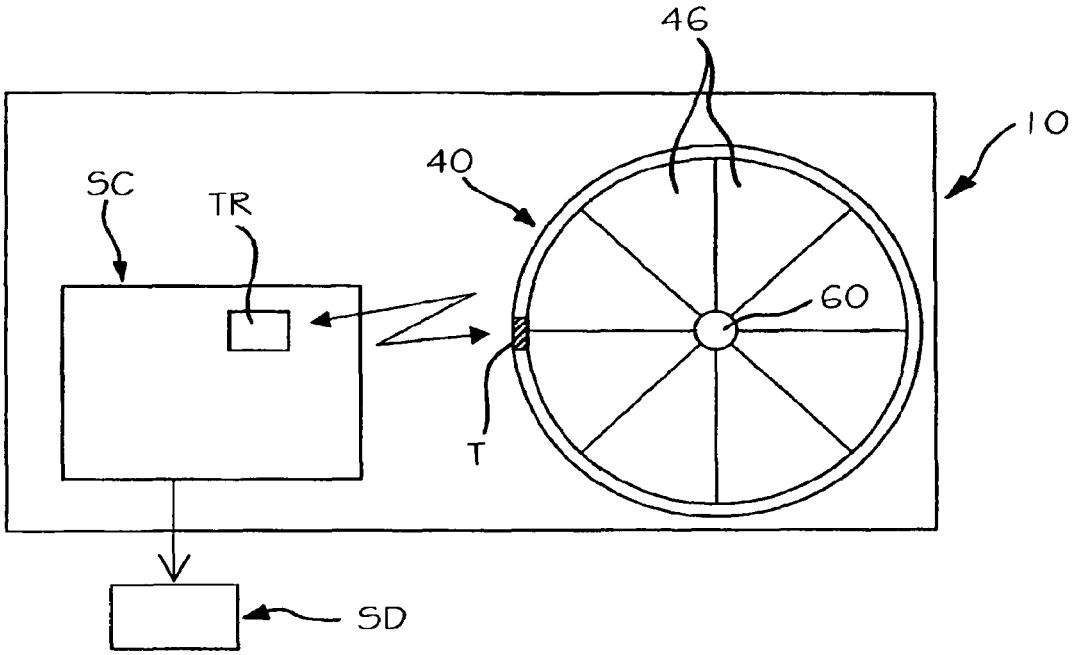
FIG. 77 is a simplified block diagram of a further inventive solution.

An implementation of this type is illustrated in FIG. 77, wherein support 40 is provided with a transponder T or similar circuit or chip, and the control system SC which manages operation of the dispenser or of the user appliance or machine includes a respective control and/or communications circuit TR for the transponder T, hereinafter referred to for simplicity as "reader" (even though, as it will be clear, it is also adapted to write information into the memory means of the transponder or chip or circuit T).

In such an application, with RF read/write technology, the memory means of transponder T associated with the new magazine 40 contain data indicating the total number of doses 46 of substance available, this figure being updated (in a decreasing manner) on the occasion of each activation of the support and/or of the dispenser, i.e., each time the support moves and a dose is consequently delivered. The management logic of such a functionality can provide at least the following steps, executed on the dispenser's control system SC:

i) reading the data/value contained in the memory means of the transponder T in the support 40 (for example 8 doses), carried out by the control system SC by means of reader TR;

ii) activating or moving the support 40, i.e., delivering a dose of the substance;

iii) writing new data/value to the memory means in the transponder T, or updating/replacing the data/value read in step i) (for example 7 doses), carried out by the control system SC by means of reader TR;

When the data/value read in step i) is equal to zero or close to zero, the control system SC generates a suitable signal for the user, for example by means of a warning lamp or a display SD on the machine; in order to indicate that support 40 is empty and in a "low load" condition. In addition, or alternatively, the availability of said updated data in the memory can make it possible to have a displaying of the exact number of doses present at any time in the magazine or support 40, for example by means of a numerical display on the dispenser or on the user appliance or washing machine.

The described solution also makes it possible to remove a support which is not yet exhausted from the dispenser, without losing the information concerning how much washing agent or other substance has been consumed, or is still available. Consider the case of different types of support alternated by the user in the dispenser, for example for the purpose of performing different types of washing, or because the support has been removed from the dispenser in view of a long period when the machine is out of use, or because it is being replaced.

What has been described by way of example corresponds essentially to an operation of "marking" of the support by the dispenser according to the invention, and specifically of marking the support each time the dispenser delivers a dose (such as marking each dose of substance delivered). As may be seen, the marking of the support can advantageously be performed electronically, but it is intended equally to include within the scope of the invention other possible types of marking obtainable with any known technology suitable for the purpose. Among these we note particularly the possibility of providing marking of a mechanical type, including for example a step of piercing or deforming at least part of the support of the substance to be delivered, or a component or element associated or associable with the support itself. Purely by way of example, in one such variant, the support includes a relatively thin plastic part, which extends along the various receptacles for the doses of substance, and the dispenser is equipped with a circuit or a unit managed by the control system for producing a hole or a deformation in said plastic part, in line with each receptacle, after the delivery of the corresponding contents; the said plastic part thus forms a "mechanical memory", while the said piercing or deforming unit or circuit forms a "writing means" of the mechanical memory.

Mechanical marking can obviously also be part of a system of detecting and/or signalling for the dispenser, and/or a system suitable for notifying a user of the number of doses of substance remaining in the support means.

As already mentioned, certain characteristics and components described in relation to some embodiments are easily interchangeable or combinable, by a person skilled in the art, with those of at least some of the other embodiments and variants described above, or they can be at least in part combined with each other for the purpose of obtaining solutions or devices which may be different from those illustrated and described by way of example.

Naturally, without prejudice to the principle of the invention, the construction details and the embodiments can vary widely with respect to what has been described and illustrated purely by way of example, without for this reason departing from the scope of the present invention. Embodiments, solutions and aspects defined above as inventive, in themselves inventive or autonomously inventive must be understood as being susceptible of independent protection.

There now follows a series of statements further defining the invention. The reference numerals are as stated above and as used in the drawings but are given in these statements only for the purpose of illustration and assistance, not limitation:

1. A long-life substance dispensing device a domestic electrical appliance, particularly a washing machine, comprising:

a main body (20, 30; 20', 30'; 20", 30"; 220, 230), arranged for being fixed in a stationary position relative to a structure (2, 3) of the appliance (1; LB) and having a positioning region (31) for a support means (40; 40'; 40"; 240; 240') of a plurality of doses of a substance (46; 46*b*, 46*c*; 246), such as a washing agent, sufficient for carrying out a plurality of deliveries or operating cycles of the appliance, such as washing cycles, an actuation system (50, 60) which is electrically controllable for causing a relative movement between the support means (40; 40'; 40"; 240; 240') and at least one part of the main body (20, 30; 20', 30'; 20", 30"; 220, 230), for the purpose of selectively delivering at least one dose (46; 46*b*, 46*c*; 246) of the substance contained in the support means (40; 40'; 40"; 240; 240'), wherein the actuation system (50, 60) comprises at least one drive element (61; 61'; 61") and one driven element (40; 40; 40"; 132; 240), the driven element being capable of cooperating with the drive element to allow said delivery, characterised in that the actuation system (40, 50, 60) is arranged such that it can take on an operative condition, in which the drive element (61; 61'; 61") is operatively coupled to the driven element (40; 40'; 40"; 132; 240), and an inoperative condition, in which the drive element (61; 61'; 61") is decoupled from the driven element (40; 40'; 40"; 132; 240).

2. The device of item 1, further comprising a detection device, particularly a codifier or encoder (70, A; 110, A'; 270, A"; 70', C'; 70", C"), for controlling the operative position or the movement of at least one of the driven element (40; 40'; 40"; 132; 240) and the drive element (61; 61; 61"), the detection device having a detection unit (70; 110; 70'; 70") excitable through excitation means (A; A'; A"; C'; C"), wherein the detection unit (70; 110; 70'; 70") is associated to the main body (20, 30; 20', 30'; 20", 30"; 220, 230) and the excitation means (A; A'; C'; C") are operatively associated to, or integrated in, at least one of the drive element (61; 61'; 61") and the driven element (40; 40; 40"; 132; 240).

3. The device of item 1 or 2, wherein the main body (20, 30; 20', 30'; 20", 30"; 220, 230) has a positioning region (31) for the support means (40; 40'; 40"; 240; 240') and the actuation system (40, 50, 60) is arranged for allowing, when in the respective inoperative condition, removal of the support means (40; 40'; 40"; 240; 240') from said region (31).

4. The device of one of items 1 to 3, wherein in the support means (40;

40'; 40"; 240; 240') a plurality of receptacles is defined (45; 45*b*, 45*c*; 45'; 45"; 245; 345), each configured for accommodating at least partially a dose (46; 46*b*, 46*c*; 246) of the substance.

5. The device of at least one of the preceding items, wherein the actuation system (40, 50, 60) is operative for selectively bringing portions or receptacles (45; 45*b*, 45*c*; 45'; 45"; 245; 345) of the support means (40; 40'; 40"; 240; 240') into a substantially predefined position, in order to expose a corresponding amount or dose of substance (46; 46*b*, 46*c*; 246) to a fluid flow, such as a jet of liquid (7).

6. The device of item 1 and/or 4, wherein the main body (20, 30; 20', 30';

20", 30"; 220, 230) has at least one delivery aperture (33*a*; 33*a'*) and the actuation system (40, 50, 60) is arranged to cause a relative movement between the support means (40; 40'; 40"; 240; 240') and the delivery aperture (33*a*; 33*a'*).

7. The device of item 1 and/or 4, wherein the main body (20, 30; 20', 30'; 20", 30"; 220, 230) has at least one inlet aperture (233*a*) and at least one outlet aperture (33*a*; 33*a'*; 233*b*) for a fluid flow, particularly a liquid, and the actuation system (40, 50, 60) is controllable for causing a relative movement between the support means (40; 40'; 40"; 240; 240') and said inlet and outlet apertures (233*a*, 233*b*), in particular for positioning at said apertures (233*a*, 233*b*), or between said apertures (233*a*, 233*b*), a dose of the substance (46; 46*b*, 46*c*; 246) for the purpose of delivering it by means of a flow of a fluid, where preferably said fluid passes through said dose.

8. The device of item 1, wherein the actuation system (40, 50, 60) comprises electrically supplied actuating means (50; 50'; 50") and a transmission arrangement (60) operatively interposed between the actuating means (50; 50'; 50") and the driven element (40; 40'; 40"; 132), in said operative and inoperative conditions of the actuation system (40, 50, 60) the arrangement being coupled or decoupled with respect to the driven element (40; 40; 40"; 132), respectively.

9. The device of item 1, further comprising detection or control means (70*a*, 70*b*, 70*c*; 70, A; 110, A'; 38, 49, 49*a*, 49*b*; 38"; 270, A"; 70', C'; 70", C") of at least one status or operational condition of the device.

10. The device of item 9, wherein the detection or control means (70*a*, 70*b*, 70*e*; 70, A; 110, A'; 38, 49, 49*a*, 49*b*; 38"; 270, A" ; 70', C'; 70", C") comprise sensing means (70*a*, 70*b*, 70*c*; 70; 110; 270; 70'; 70").

11. The device of item 9, wherein the detection or control means (70*a*, 70*b*, 70*c*; 70, A; 110, A'; 38, 49, 49*a*, 49*b*; 38"; 270, A" ; 70', C'; 70", C") comprise a signalling system (38, 49, 49*a*, 49*b*; 38") to indicate to a user at least one of a condition of presence of the support means (40; 40'; 40"; 240; 240') in a respective substantially closed housing (31) of the main body (20, 30; 20', 30'; 20", 30"; 220, 230), and a residual quantity of doses of substance (46; 46*b*, 46*c*) in the support means (40; 40'; 40"; 240; 240').

12. The device of item 1, wherein, between the main body (20, 30; 20', 30'; 20", 30"; 220, 230) and the support means (40; 40'; 40"; 240; 240') first sealing means (34; 34') are operative.

13. The device of item 3, wherein the main body (20, 30; 20', 30'; 20", 30"; 220, 230) comprises a first static part (20; 20'; 20") and a second part (30; 30'; 30") displaceable relative to the first part (20).

14. The device of item 8, wherein in the main body (20, 30; 20', 30'; 20", 30"; 220, 230) a positioning housing (24) is defined for a member (61; 61'; 61") belonging to the transmission arrangement (60).

15. The device of item 8, wherein the transmission arrangement (60) comprises first transmission means (67; 67'; 67"; 67*a*, 67*b*) adapted to couple in a separable manner with second transmission means (47; 47'; 47"; 47*a*, 47*b*) of the support means (40; 40'; 40"; 240; 240').

16. The device of item 10, wherein the sensing means (70*a*, 70*b*, 70*c*; 70; 110; 270; 70'; 70") are arranged for detecting one or more of the following operational or status conditions:

a condition of presence/absence of the support means (40; 40'; 40"; 240; 240') in the device;

a condition of incorrect positioning of a movable part (30; 30'; 30") of the main body (20, 30; 20', 30'; 20", 30"; 220, 230) relative to a fixed part (30; 30'; 30") of the main body;

a condition of absence of doses of substance (46; 46*b*, 46*c*) in the support means (40; 40'; 40"; 240; 240');

a residual quantity of doses of substance (46; 46*b*, 46*c*) in the support means (40; 40'; 40"; 240; 240');

a movement of the support means (40; 40'; 40"; 240; 240');

a direction of movement of the support means (40; 40'; 40"; 240; 240');

a determined operative position of the support means (40; 40'; 40"; 240; 240');

a speed of movement of the support means (40; 40'; 40"; 240; 240').

17. The device of item 16, wherein the sensing means (70*a*, 70*b*, 70*c*; 70; 110; 270; 70'; 70") comprise at least one sensor selected from among optical sensors, magnetic sensors, inductive sensors, resistive sensors, potentiometer sensors.

18. The device of item 16, wherein the sensing means (70*a*, 70*b*, 70*c*; 70; 110; 270; 70'; 70") comprise a position transducer or encoder (70, A; 110, A'; 270, A"; 70', C'; 70", C"), preferably of an incremental type or of an absolute type and selected in the group consisting of optical transducers or encoders, magnetic transducers or encoders, inductive/capacitive transducers or encoders and potentiometer or resistive transducers or encoders.

19. The device of item 17, wherein the sensor of optical type (70*a*, 70*b*, 70*c*; 70) comprises an emitter (E) and a receiver (R) of electromagnetic radiation, where in particular the emitter (E) and the receiver (R) are placed substantially side by side and oriented at such a mutual angle that the radiation emitted by the emitter (E) is reflected towards the receiver (R) when in front of said emitter (E) and receiver (R) there is a substantially opaque surface, at a substantially predefined distance.

20. The device of item 2 or 18, wherein the transducer or the encoder (70, A; 110, A'; 270, A"; 70', C'; 70", C") comprises a detection unit (70; 110; 7'; 70") excitable by excitation means (A; A'; A"; C'; C").

21. The device of item 2 or 20, wherein the excitation means (A; A'; A") comprise a series or a succession of excitation elements (B; N, S), where in particular the series or succession of excitation elements (B; N, S) is substantially rectilinear or is arranged of a circumference or an arc of circumference.

22. The device of item 2 or 20, wherein the excitation means (A; A'; A"; C'; C") are configured to obtain or generate a coding or a signal of digital type, such as a binary coding or a Gray coding, or else for the purposes of generating signals or values of analog type.

23. The device of item 2 or 18, further comprising synchronising means (70, B") for generating a synchronisation signal.

24. The device of item 23, wherein the synchronising means comprise a detection unit (70) excitable by respective excitation means (B"), in which the detection unit (70) is associated to the main body (20, 30; 20', 30'; 20", 30"; 220, 230) and the excitation means (A") are operatively associated to, or integrated in, at least one of the drive element (61; 61; 61") and the driven element (40; 40'; 40"; 132; 240).

25. The device of item 2 or 20 or 24, wherein the excitation means (A; A'; C'; C") are operatively associated to, or integrated in, at least one of a movable member (61") of the actuation system (40, 50, 60) and the support means (40; 40'; 40"; 240; 240').

26. The device of item 25, wherein the excitation means are integrated in, or obtained by, a component (A; A'; C'; C") fixed to at least one of said movable organ (61") and said support means (40; 40'; 40"; 240; 240'), where in particular said component (A; A'; C'; C") comprises means for fixing thereof to the support means (40; 40'; 40"; 240; 240') in a predefined position.

27. The device of item 11, wherein the signalling system (38, 49, 49*a*, 49*b*; 38") comprises at least one of a window (38; 38") present in at least one of a fixed part (20) of the main body (20, 30) and a movable part (30") of the main body (20", 30"), a movable optical indicator (49, 49*a*, 49*b*;) adapted to pointing out an operative position of the support means (40; 40'; 40"; 240; 240').

28. The device of item 27, wherein the optical indicator (49, 49*a*, 49*b*) is operatively associated with at least one of a movable member (61") of the actuation system (40, 50, 60) and the support means (40; 40'; 40"; 240; 240'), where in particular:

the optical indicator (49, 49*a*, 49*b*;) is integrated in one of said movable member (61") and support means (40; 40'; 40"; 240; 240'), or the optical indicator (49, 49*a*, 49*b*;) is integrated in a component fixed to one of said movable member (61") and support means (40; 40'; 40"; 240; 240'), said component comprising preferably means for the fixing thereof to the support means (40; 40'; 40"; 240; 240') in a predefined position.

29. The device of item 27, wherein the window (38; 38") is obtained in at least one of a peripheral wall (31*a*) and a bottom wall (30") of a housing (31) for the support means (40; 40'; 40"; 240; 240'), where in particular the window (38") extends in substantially radial manner between a central area of said bottom wall and a delivery aperture (33*a*') for the substance.

30. The device of item 27, wherein the optical indicator (49, 49*a*, 49*b*)

comprises a succession of graphic and/or alphabetical and/or numerical symbols or at least one inscription, and/or is associated with an end wall (61*e*) of a transmission member (61") adapted of being inserted into a central seat (40*a*) of the support means (40; 40'; 40"; 240; 240').

31. The device of item 8, wherein the transmission arrangement (60) comprises elastic means (62, 68; 62'; 62").

32. The device of item 15, wherein the first transmission means comprise a plurality of teeth (67; 67'; 67"), the teeth being in particular arranged as saw-teeth and/or having a front profile which is not flat.

33. The device of items 15 and 31, wherein the elastic means (62, 68; 62'; 62") are arranged to bias the first transmission means (67; 67'; 67") towards the second transmission means (47; 47'; 47").

34. The device of item 15, wherein the first transmission means (67; 67'; 67") are adapted to perform axial displacements in a direction parallel to, or coinciding with, an axis of movement of the support means (40; 40'; 40"; 240; 240'), or the first transmission means (67; 67'; 67"; 67*a*, 67*b*) are arranged for performing angular movements around an axis parallel to, or coinciding with, an axis of rotation of the support means (40; 40'; 40"; 240; 240').

35. The device of items 8 and 13, wherein the transmission arrangement (60) comprises a transmission member (61; 61'; 61") rotatably mounted on said first body part (20; 20'; 20").

36. The device of items 15 and 35, wherein the first transmission means (67'; 67"; 67*a*, 67*b*) are part of said transmission member (61") or are part of a coupling element (66; 66') carried by said transmission member (61; 6l'), where in particular the coupling element (66; 66') is linearly or angularly movable within said transmission member (61; 61').

37. The device of items 32 and 36, wherein the coupling element (66; 66') comprises lugs (66*c*) having said teeth (67), where in particular the lugs (66*c*) are slidingly inserted into respective guides (63) formed in said transmission member (61; 61').

38. The device of item 36, wherein between the coupling element (66) and the transmission member (61) elastic means (62) are operatively interposed.

39. The device of item 36, wherein an upper element (69; 100) is at least partially inserted into the coupling element (66; 66'), where in particular the upper element (69) is adapted to axially slide into the coupling element (66), and/or the upper element (100) is angularly rotatable relative to the coupling element (66), and/or between the upper element (69) and the coupling element (66) elastic means (68) are operatively interposed, and/or the coupling element (66') has a wall, preferably a cylindrical wall, on which there are formed one or more grooves (66*f*), preferably helical grooves, and the upper element (100) has a portion (105), inserted in a cavity delimited by said wall, having protrusions (105*a*) operatively inserted in said groove or grooves (66*f*).

40. The device of item 15, wherein the first and second transmission means (67"; 47") are arranged for coupling in a unique relative position, where in particular the first transmission means comprise at least one of a groove (67") and a protrusion, which preferably extends in an axial direction of a rotatable member (61") of said transmission arrangement (60), said groove or protrusion (67") being preferably formed on the outer surface of a part (61*b*"), preferably a cylindrical part, of a transmission member (617).

41. The device of item 15, wherein in said operative condition the first transmission means (67) project within a housing (31) for the support means (40; 40'; 40"; 240; 240') and in said inoperative condition the first transmission means (67) do not project within said housing (31).

42. The device of items 15 and 41, wherein the first transmission means (67'; 67") are integrated in said transmission member (61; 61"), and/or the first transmission means (67; 67'; 67"; 67*a*, 67*b*) comprise an alternated series of crests (67*a*) and valleys (67*b*) formed in a part (61*b*") of said transmission member (61").

43. The device of item 8, wherein the transmission arrangement (60) is switchable in an automated way between two respective conditions, and in particular is arranged to carry out:

an actuation step, in the course of which a transmission member (61') rotates or moves in a first direction, in order to cause an axial movement in a first direction of first transmission means (67), and a reset step, in the course of which said transmission member (61') rotates or moves in a second direction, in order to cause an axial movement in a second direction of first transmission means (67).

44. The device of item 3, wherein the positioning region comprises a housing (31) formed in the main body (20, 30; 20', 30'; 20", 30"; 220, 230), where in particular the housing (31) has a generally truncated-conical or a generally cylindrical shape.

45. The device of items 3 and 13, wherein the housing (31) is delimited between said first and second body part (20, 30; 20', 30'; 20", 30"; 220, 230).

46. The device of item 13, wherein the second body part (30; 30") is mounted slidably with respect to the first body part (20; 20") or is constrained to the first body part (20'; 20") to carry out movements with respect to it, preferably angular or linear movements, and/or in one of said body parts (20, 30; 20', 30'; 20", 30"; 220, 230) at least one aperture is formed, in particular a delivery aperture (33*a*; 33*a*') of the substance, and/or the first body part (20; 20'; 20") is arranged for fixing at a respective passage formed in a wall (3*a*, 4*a*) of a treatment chamber (3) of the appliance (1) and has a first portion designed to project, through said passage, to the outside of said chamber (3), and a second portion designed to be exposed or housed inside said chamber (3), and/or at least one of said first and second body parts (20, 30; 20', 30'; 20", 30"; 220, 230) has a wall (21*a*) equipped with at least one window (21*b*, 21*c*; 38; 38"), consisting of a respective through aperture (21*b*) and a closure element (21*c*) made of transparent material, and/or at least one of said first and second body parts (20, 30; 20', 30'; 20", 30"; 220, 230) has one wall (21*b*) formed at least in part of a transparent material and/or at least one of said first and second body parts (20, 30; 20', 30'; 20", 30"; 220, 230) has associated thereto at least one sealing means (34; 34') cooperating with the support means (40; 40'; 40"; 240; 240'), and/or the second body part (30") is adapted for sliding with respect to the first body part (20") according to a plane substantially perpendicular to an axis of movement of the support means (40; 40'; 40"; 240; 240'), and/or the second body part (30; 30'; 30") is configured substantially as a drawer, or is hinged to the first body part (20).

47. The device of items 14 and 44, wherein said housing (24) has a hollow cylindrical shape and has a respective end that faces in said housing (31).

48. The device of item 44, wherein the housing (31) has a prevailing portion of a substantially cylindrical or a substantially truncated-conical or a substantially prismatic shape, where in particular said portion is formed in one of said first or second body parts (30; 30').

49. The device of item 13, wherein the first body part (20) is arranged for fixing to a door (4) of the appliance (1) so as to allow extraction of the second body part (30) from the upper edge of the door.

50. The device of item 3, wherein the main body (20, 30; 20', 30'; 20", 30"; 220, 230) is arranged to be fixed to at least one of a top wall (3*a*) of a treatment chamber (3) of the appliance (1), a side wall (4*a*) of said chamber (4), a part (4*a*) of a door (4) of the appliance (1).

51. The device of item 13, further comprising switchable retaining means (29, 37; L, 30*b*"), operative for keeping the second body part (30'; 30") in a closed position relative to the first body part (20'; 20").

52. The device of items 5, 6 and 44, wherein the delivery aperture (33*a*) is an end wall (31*b*) of the housing (31) and the receptacles (45; 45*b*, 45*c*; 45") extend axially in a direction parallel to an axis of movement of the support means (40; 40'; 40"; 240; 240') and are open at least one respective end designed to face towards said aperture (33*a*), or the delivery aperture (33*a*) is in a perimetral or circumferential wall (31*a*) of the housing (31) and the receptacles (45') extend axially in a perpendicular or radial direction relative to an axis of rotation or movement of the support means (40; 40'; 40"; 240; 240') and are open at one end designed to face towards said aperture (33*a*).

53. The device of item 12, wherein the first sealing means comprise a gasket (34; 34') which extends in a region which surrounds a delivery aperture (33*a*; 33*a'*) of the substance, where in particular the gasket has a surface sealing with respect to the support means (40; 40'; 40"; 240; 240'), which surface is considerably larger than the through-section of said delivery aperture (33*a*; 33*a'*). 54. The device of item 53, wherein the gasket (34; 34') has a respective through aperture (34*a*; 34*a'*) having a through section substantially corresponding to that of said delivery aperture (33*a*; 33*a'*), said through aperture (34*a*; 34*a'*) being preferably positioned substantially in the centre of the gasket (34; 34'), and/or the gasket (34) has a plan profile substantially shaped as a circular sector or rectangular, with a length development which is at least double, preferably at least triple that of the delivery aperture.

55. The device of items 44 and 53, wherein the gasket (34') has sealing protrusions or lips (34*b'*), preferably protruding towards the inside of the housing (31).

56. The device of item 5 or 6, wherein the actuation system (60) is configured for moving the support means (40; 40'; 40"; 240; 240') with respect to the principal body (20, 30; 20', 30'; 20", 30"; 220, 230).

57. The device of item 5, wherein the actuation arrangement (60) 'is arranged for displacing a movable wall (132) of a housing (31) of the support means (40; 40'; 40"; 240; 240'), formed in the main body (20).

58. The device of item 56, wherein the actuation system is arranged such that a displacement of the support means (40; 40'; 40"; 240; 240') required for causing delivery of one said dose of substance (46) is obtained by means of two successive actuation of the arrangement.

59. The device of item 8, wherein the actuating means (50; 50'; 50") comprise at least one of a thermoelectric actuator (50) and a motor (50', 50"), preferably a reversible electric motor (50') or a unidirectional electric motor (50").

60. The device of item 59, wherein the thermoelectric actuator (50) has a shaft (51), linearly movable in a direction substantially perpendicular to, or coinciding with, an axis of movement of the support means (40; 40'; 40"; 240; 240').

61. The device of item 59, wherein the electric motor (50'; 50"):

has a rotating shaft (51') substantially perpendicular to an axis of movement of the support means (40; 40'; 40"; 240; 240'), or has a rotating shaft (51") substantially coaxial with an axis of movement of the support means (40; 40'; 40"; 240; 240').

62. The device of item 61, wherein the rotating shaft (51', 251) is connected directly to a transmission member (61", 261) capable of cooperating with the support means (40; 40'; 40"; 240; 240'), where in particular the rotating shaft (51',251) is associated with a transmission element (52; 261), preferably an endless screw (52) or pinion (261).

63. The device of one or more of items 5 to 10, further comprising at least part of a control circuit or system, arranged for controlling, preferably autonomously, an actuating means (50") for the purpose of positioning the support means (40; 40'; 40"; 240; 240') in a predefined position within a respective housing (31).

64. The device of item 63, wherein the control system or circuit is arranged for controlling the actuation system (40; 50; 60; 250) for the purposes of:

delivering an individual dose of substance (46) in a single phase of a cycle of operation of the appliance, and/or performing separate deliveries starting from a single dose of substance (46) in several phases of a cycle of operation of the appliance, and/or delivering several doses of substance (46) in the course of a same phase of operation of the appliance or a same cycle of operation of the appliance, and/or delivering at least one dose of a first substance (46*b*) and at least one dose of a second substance (46*c*) in the course of a same phase of operation of the appliance or a same cycle of operation of the appliance, and/or delivering at least one dose of substance (46) in conjunction with execution of a specific operative phase of the appliance (1).

65. The device of item 5, further comprising means (5) for directing said jet of liquid (7) towards at least one delivery aperture (33*a*; 33*a'*) of the main body (20, 30; 20', 30'; 20", 30"; 220, 230), where in particular said means comprise at least one of a rotating sprinkling organ (5) of the appliance (1) and a static nozzle.

66. The device of items 64 and 65, wherein said specific operative phase comprises an emission of said jet (7) with increased power or pressure.

67. The device of item 8, further comprising a control device (80), for selectively switching the transmission arrangement (60) between an operative position and an inoperative position, where in particular:

the control device (80) is manually operable, and/or a bistable kinematic mechanism (82, 85, 86) is associated to the control device (80), and/or the control device (80) comprises a slider element (83), linearly slidable in respective guide means (27) in the main body (20, 30; 20', 30'; 20", 30"; 220, 230), where preferably the slider element (83) has associated thereto a pushing member (84), adapted to cause axial displacement of a movable member (69) of the transmission arrangement (60).

68. The device of item 8, wherein the transmission arrangement (60) is switchable between an operative position and an inoperative position by exploiting a movement of a movable part (30') of the main body (20'; 30').

69. The device of item 44, further comprising a mechanism (37*a*, 37*b*, 37*c*, 48) arranged for easing manual positioning of the support means (40; 40'; 40"; 240; 240') in a predefined angular position within said housing (31), where in particular said mechanism (37*a*, 37*b*, 37*c*, 48) comprises a recess or notch (48) formed in a peripheral wall (42) of the support means (40; 40'; 40"; 240; 240') and a slider (37*a*) biased by a spring (37*b*) against said peripheral wall (42).

70. The device of item 8, wherein the transmission arrangement (60) comprises an angularly rotatable member (61") having a part which projects constantly into a central zone of said housing (31).

71. The device of item 4, wherein the support means (40; 40'; 40"; 240; 240') are arranged for retaining a plurality of doses of a first substance (46*b*) and a plurality of doses of a second substance (46*c*).

72. A dispensing device for substances, particularly washing agents, for a domestic appliance, particularly a washing machine, comprising:

a main body (20, 30; 20', 30'; 20", 30"; 220, 230), arranged for being fixed in a stationary position with respect to a structure (2, 3) of the appliance (1; LB), a support means (40; 40'; 40"; 240; 240') of a substance which is to be delivered, an actuation system (50, 60) which is electrically controllable for causing delivery of the substance (46; 46*b*, 46*c*; 246), wherein the actuation system (50, 60) comprises at least one drive element (61; 61'; 61") and one driven element (40; 40; 40"; 132), the driven element being adapted to cooperate with the drive element to allow said delivery, characterised in that it further comprises a position or movement transducer (70, A; 110, A'; 270, A"; 70', C'; 70", C") having a detection unit (70; 110; 70'; 70") excitable by excitation means (A; A'; A"; C'; C"), wherein the detection unit is associated with, or carried by, the main body (20, 30; 20', 30'; 20", 30"; 220, 230) and the excitation means are operatively associated to, or incorporated in, at least one of the drive element and the driven element, where in particular the transducer (70, A; 110, A'; 270, A"; 70', C'; 70", C") is arranged for detecting a relative movement between the drive element or the driven element with respect to at least one part of the main body (20, 30; 20', 30'; 20", 30"; 220, 230).

73. The device of item 72, further comprising means (70, B") for generating a synchronisation signal on the basis of a movement performed by at least one of the drive element and the driven element.

74. The device of item 72, wherein the excitation means (A; A'; A"; C'; C") are mounted or associated, particularly in removable manner, to the support means (40; 40'; 40"; 240; 240') of the substance.

75. The device of at least one of the preceding items, wherein the support means comprises a single block of the substance to be delivered.

76. The device of at least one of the preceding items, further comprising means (TR)for reading and/or writing to, or communicating with, memory means (T) integrated in or associated to the support means (40).

77. An excitation means for a detection system belonging to a dispensing device, particularly but not exclusively of any of the preceding items, wherein the excitation means (A; A'; C'; C") are arranged for being attached to a support or container (40; 40'; 40"; 240; 240') of at least one dose of a deliverable substance (46; 46*b*, 46*c*; 246), the excitation means being configured for exciting a detection unit (70; 110; 70'; 70") associated to the dispenser.

78. The excitation means of item 77, configured for cooperating with the detection unit (70; 110; 70'; 70") for the purposes of controlling the operative position and/or the movement of the support or container (40; 40; 40"; 132; 240).

79. The excitation means of item 77, wherein the detection system comprises at least one of an analog transducer, a digital transducer, an angular transducer, a linear transducer, an encoder, a detection circuit, a magnetic transducer, a resistive transducer, a capacitive transducer, an optical transducer.

80. The excitation means of item 77, configured as a distinct part of the dispenser.

81. The excitation means of item 77, configured to be associated in a separable manner to the support or container (40; 40'; 40"; 240; 240').

82. The excitation means of item 81, comprising means for fixing and/or hooking thereof to the support or container (40; 40'; 40"; 240; 240').

83. The excitation means of at least one of the preceding items, comprising excitation elements selected from among excitation elements of optical type, magnetic type, inductive type, resistive type, mechanical type.

84. The excitation means of item 83, wherein the excitation elements comprise at least one series or succession of excitation elements (B; N, S), where in particular the series or succession of excitation elements (B; N, S) is at least in part rectilinear or is arranged of a circumference or an arc of circumference or is at least in part curved.

85. The excitation means of at least one of the preceding items, wherein the excitation means (A; A'; A"; C'; C") is configured to obtain or generate a coding or a signal of digital type, such as a binary coding or a Gray coding, or for the purpose of generating signals or values of analog type.

86. The excitation means of at least one of the preceding items, comprising furthermore synchronisation means (B") for generating a synchronisation signal.

87. The excitation means of item 83 and/or 84, wherein the excitation elements (B; N, S) comprise, or are obtained by, at least one of:

a series of crests and valleys, a series of transparent sectors and/or opaque sectors and/or reflective sectors of a body of the support, a series of colored sectors and/or graphic elements, a series of magnetised inserts, a series of inserts of metal or of non-magnetised ferromagnetic material, an inclined plane, an element of eccentric or spiral shape, an element forming a profile or a height of non-uniform dimensions.

88. The excitation means of items 83 and/or 84, wherein at least one of the excitation means and the excitation elements are formed at least in part of a mouldable or injectable material or by means of a mould.

89. The excitation means of at least one of items 83, 84 and 88, wherein the excitation elements (N, S) are formed at least in part of a magnetisable thermoplastic-based material, such as plastoferrite or the like.

90. A circuit or memory or communications means for a control system for a dispensing device, particularly but not exclusively of any of the preceding items, wherein the circuit or memory or communications means (T) is arranged for being associated to a support or container (40) of at least one dose of a deliverable substance (46), the circuit or memory or communications means (T) being configured for being in communication with and/or controlled by said control system (SC).

91. The circuit or memory means of item 90, arranged for being electronically legible and/or writable by means of a corresponding communications and/or reading and/or writing unit (TR) belonging or connected to said control system (SC).

92. A domestic washing machine, in particular a dishwasher or a laundry washing machine, comprising a dispensing device for substances, made of one or more of the preceding items.

93. Method for controlling the operation of a substance dispensing device of the type having a main body (20, 30; 20', 30'; 20", 30"; 220, 230), arranged to be fixed to a structure (3) of a domestic electrical appliance (1; LB), such as a washing machine, an actuation system (50, 60) carried by the main body (20, 30; 20', 30'; 20", 30"; 220, 230), a support or container (40; 40'; 40"; 240; 240') of at least one dose of a deliverable substance (46; 46*b*, 46*c*; 246), wherein the actuation system (50, 60) is electrically controllable to cause, in the course of an operation cycle of the appliance, delivery of said at least one dose (46; 46*b*, 46*c*; 246) of the substance, the method comprising the steps of:

i) activating the actuation system, ii) detecting, as a function of operation of the actuation system, the movement of at least one of a movable component of the actuation system and the support, in particular for the purpose of controlling the position thereof, iii) deactivating the actuation system when it is detected the achievement of a predetermined position by a predefined part of at least one of said movable components of the actuation system and support.

94. The method of item 93, wherein detection is performed by a position transducer, in particular a digital transducer or an analog transducer, preferably of incremental type or of absolute type.

95. The method of item 93, wherein in the support a plurality of receptacles is formed (45; 45*b*, 45*c*; 45'; 45"; 245; 345), each receptacle being arranged for accommodating at least partially a respective dose (46; 46*b*, 46*c*; 246) of the deliverable substance, and step ii) comprises the operation of:

reading, or generating, by means of a sensor means (70; 110, A'; 270, A"; 70', C'; 70", C") in the course of operation of the actuation system, a code or a digital value identifying a respective receptacle, where in particular, the code or the value is associated with, or carried by, at least one of said movable component of the actuation system and said support, or reading, or generating, by means of a sensor means in the course of operation of the actuation system, an analog signal or an analogue value identifying a respective receptacle, where in particular, the signal or the value is generated by means of an element associated with, or carried by, at least one of said movable component of the actuation system and said support.

96. The method of item 93, further comprising the operation of generating and/or detecting, on the basis of operation of the actuation system, a synchronisation signal.

97. The method of item 96, wherein at least one of said movable component of the actuation system and support generates, or carries, an element adapted to generate a synchronisation code or value which is read or detected by a sensor means during operation of the actuation system.

98. The method of item 93, wherein the detection is used for the purposes of the evaluation of the amount of substance present in the support and/or of the operative condition of the support.

99. The method of at least one of the preceding items, wherein the detection is used for the purposes of positioning a given region of the support with respect to a delivery aperture in the dispenser.

100. The method of at least one of the preceding items, wherein the detection is used for the purposes of an at least partial exposure of a given region of the support to a flow of fluid for flushing the dose of substance.

101. Method for managing a support means of a deliverable substance in a dispensing device for a domestic electrical appliance, the dispensing device having an actuation system arranged for moving the support means, the method comprising the steps of:

providing the support means (40; 40'; 40"; 240; 240') with reference means (A; A'; A"; C'; C"), providing the dispenser with detection means (70; 110; 70'; 70") for the reference means (A; A'; A"; C'; C"), performing a detection through the detection means (70; 110; 70'; 70") in function of a movement imparted to the support means (40; 40'; 40"; 240; 240') through the actuation system.

102. The method of item 101, wherein following said reading an evaluation is made of at least one of a condition of presence/absence of the support means (40; 40'; 40"; 240; 240') in the dispensing device;

an operative condition of the support (40; 40'; 40"; 240; 240');

a quantity of substance present in the support means (40; 40'; 40"; 240; 240');

a condition of absence of substance in the support means (40; 40'; 40"; 240; 240');

a movement of the support means (40; 40'; 40"; 240; 240');

a direction of movement of the support means (40; 40'; 40"; 240; 240');

a particular operative position of the support means (40; 40'; 40"; 240;

240');

a speed of movement of the support means (40; 40'; 40"; 240; 240');

a relative position of the support means (40; 40'; 40"; 240; 240') within the dispensing device.

103. The method of item 102, wherein the further step is provided of aligning a region of the support means (40; 40'; 40"; 240; 240') with a delivery aperture of the dispenser.

104. The method of item 103, wherein the region of the support means (40; 40'; 40"; 240; 240') is aligned in a controlled manner with the delivery aperture by feeding-back to the actuation system a signal generated following said detection.

105. A method for using a support means for a deliverable substance in a device of one or more of items 1 to 76, the method comprising the steps of:

providing the support means (40; 40'; 40"; 240; 240') with respective transmission means (47; 47'; 47"; 47*a*, 47*b*);

positioning the support means (40; 40'; 40"; 240; 240') in a corresponding positioning region (31) of the dispensing device;

selectively coupling the actuation system (50, 60) of the dispenser to the transmission means (47; 47'; 47"; 47*a*, 47*b*) of the support means.

106. The method of item 105, wherein the further step is provided of aligning a region of the support means (40; 40'; 40"; 240; 240') with a delivery aperture of the dispenser.

107. The method of item 106, wherein the region of the support means (40; 40'; 40"; 240; 240') is aligned in a controlled manner with the delivery aperture by feeding-back to the actuation system a signal generated following a detection performed through detection means (70; 110; 70'; 70") of the dispensing device, such detection means being arranged for cooperating with reference means (A; A'; A"; C'; C") on the support means (40; 40'; 40"; 240; 240') on the basis of a movement imparted to the support means through the actuation system.

108. Method for managing a support of at least one dose of a deliverable substance operatively coupled to a dispenser, wherein the following steps are provided:

providing a said support for a dispenser of any of items 1 to 76;

recognising said reference means (A; A'; A"; 49, 49*a*, 49*b*; C'; C").

109. The method of item 108, wherein following recognition of the reference means (A; A'; A"; 49, 49*a*, 49*b*; C'; C") the quantity of dose (46; 246) of substance present in the support (40; 40'; 40"; 240; 240') is evaluated.

110. The method of item 108, wherein following recognition of the reference means (A; A'; A"; 49, 49*a*, 49*b*; C'; C") the operative condition of the support (40; 40'; 40"; 240; 240') is evaluated.

111. The method of item 108, wherein following recognition of the reference means (A; A'; A"; 49, 49*a*, 49*b*; C'; C") the relative position between said support (40; 40'; 40"; 240; 240') and dispenser (10) is evaluated.

112. The method of any of items 109 to 111, wherein the further step is provided of aligning at least one portion of one said dose with the delivery aperture (33*a*; 33*a'*; 233) of the dispenser.

113. The method of any of items 109 to 112, wherein the further step is provided of aligning in a controlled manner at least one portion of one said dose with the delivery aperture (33*a*; 33*a'*; 233) of the dispenser, by feeding-back the recognition signal to an actuation system on the dispenser.

114. The method for using a support of at least one dose of a deliverable substance which is operatively couplable to a dispenser, wherein the following steps are provided:

providing a said support for a dispenser of any of items 1 to 76;

inserting said support in the positioning region (31; 231) of the dispenser (10);

selectively coupling the actuation system (66, 67; 250) of the dispenser (10) to the transmission means (47; 47'; 47*a*, 47*b*; 247) of the support.

115. The method of item 114, wherein the further step is provided of aligning at least one portion of one said dose with the delivery aperture (33*a*; 33*a'*; 233) of the dispenser.

116. The method of item 114 and/or 115, wherein the further step is provided of aligning in a controlled manner at least one portion of one said dose with the delivery aperture (33*a*; 33*a'*; 233) of the dispenser, by feeding-back a recognition signal to an actuation system on the dispenser.

117. Method for using at least one dose of deliverable substance, comprising the following steps:

providing one said support for a dispenser of any of items 1 to 76;

exposing at least one portion of said at least one dose through said delivery aperture of the dispenser to dissolving means, such that said dissolving means can flow in said support and dissolve said dose at least in part and subsequently flow out together with the dissolved part of the dose from said delivery aperture (33*a*; 33*a'*; 233) of the dispenser.

118. Method for controlling operation of a substance dispensing device for a domestic electrical appliance, in particular a washing machine, of the type which comprises:

a main body (20, 30; 20', 30'; 20", 30"; 220, 230), an actuation system (50, 60), a support or container (40) of at least one dose of a deliverable substance (46), wherein the actuation system (50, 60) is electrically controllable for causing, during a cycle of operation of the appliance, a relative movement between the support means (40) and at least one part of the main body (20, 30; 20', 30'; 20", 30"; 220, 230), for the purpose of delivering at least one dose (46) of the substance contained in the support means (40; 40'; 40"; 240; 240'), the method comprising the steps of:

a) providing the support or container (40) with a circuit or a memory means (T);

b) operatively coupling the support or container (40) to the actuation system (50, 60), c) reading and/or writing information or data to the memory means (T), under the control of a control system (SC) which manages operation of the dispenser.

119. The method of item 118, further comprising the steps of:

d) causing said relative movement for the purpose of the delivery of a dose (46) of the substance contained in the support means (40; 40'; 40"; 240; 240');

e) writing new information or data in the memory means (T), or updating or replacing the information read in step a), through said control system (SC).

120. The method of item 119, wherein said information is representative of the type and/or quantity of doses of the substance present in the support or container (40), and wherein there is further provided at least one of the following steps:

generating a signal when the information read of step a) indicates that the quantity of doses still present in the support or container (40) equals zero or is less than a determined value;

generating a signal of the type or quantity of doses still present in the support or container (40).

121. A long-life dispensing device, particularly for an hydraulic appliance or system, comprising:

a support body (20, 30; 20', 30'; 20", 30"; 220, 230), a support means (40; 40'; 40"; 240; 240') for a plurality of doses of a product or substance to be delivered (46; 46*b*, 46*c*; 246), the doses of said plurality being in sufficient quantity to perform a plurality of deliveries, an actuation system (50, 60) which is electrically controllable for causing movement of the support means (40; 40'; 40"; 240; 240') for the purpose of the delivery of at least one dose of said product (46; 46*b*, 46*c*; 246), wherein the actuation system (50, 60) comprises at least one drive element (61; 61'; 61") and one driven element (40; 40; 40"; 132), the driven element being capable of cooperating with the drive element to allow said movement and delivery, characterised in that the actuating system (40, 50, 60) is arranged for taking on an operative condition, in which the drive element (61; 61'; 61") is operatively coupled to the driven element (40; 40'; 40"; 132), and an inoperative condition, in which the drive element (61; 61; 61") is decoupled from the driven element (40; 40'; 40"; 132).

122. A dispensing device, preferably a long-life dispenser, comprising:

a main body (20, 30; 20', 30'; 20", 30"; 220, 230), support or container means (40; 40'; 40"; 240; 240') for a deliverable product or substance, an actuation system (50, 60) which is electrically controllable for causing delivery of at least one dose of the product or substance (46; 46*b*, 46*c*; 246), wherein the actuating system (50, 60) comprises at least one drive element (61; 61'; 61") and one driven element (40; 40'; 40"; 132), the driven element being capable of cooperating with the drive element to obtain said delivery, characterised in that it further comprises a position/movement transducer or an encoder (70, A; 110, A'; 270, A"; 70', C'; 70", C") having a detection unit (70; 110) excitable by excitation means (A; A'; A"; C'; C"), wherein the detection unit (70; 110) is carried by the main body (20, 30; 20', 30'; 20", 30"; 220, 230) and the excitation means (A; A') are operatively associated to, or integrated in, at least one of the drive element and the driven element.

123. A device of item 121 and/or 122, and having one or more of the characteristics referred to in items 1 to 76.

124. A device of item 121 and/or 122, for the implementation of the method of one or more of items 93 to 120.

The invention claimed is:

1. A long-life substance dispensing device for a domestic electrical appliance, comprising:

a main body, arranged for being fixed in a stationary position relative to a structure of the appliance and having a positioning region for a support means of a plurality of doses of a substance, sufficient for carrying out a plurality of deliveries or operating cycles of the appliance, an actuation system which is electrically controllable for causing a relative movement between the support means and at least one part of the main body, for the purpose of selectively delivering in a treatment chamber of the domestic electrical appliance at least one dose of the substance contained in the support means, wherein the main body comprises a first body portion prearranged to extend, or to be exposed, inside said treatment chamber and a second body portion prearranged to extend outside said treatment chamber, said positioning region being defined at said first body portion, wherein the actuation system comprises at least one drive element and one driven element, the driven element being capable of cooperating with the drive element to allow said delivery, wherein the actuation system is prearranged to take on an operative condition, in which the drive element is operatively coupled to the driven element, and an inoperative condition, in which the drive element is decoupled from the driven element.

2. The device according to claim 1, further comprising a detection device, particularly a codifier or encoder for controlling an operative position or a movement of at least one of the driven element and the drive element, the detection device comprising a detection unit excitable through excitation means, wherein the detection unit is provided on the main body and the excitation means are provide on least one of the drive element and the driven element and movable therewith, at least one excitation means cooperating or interacting with said detection unit for detecting or controlling said operative position or movement.

3. The device according to claim 2, wherein the excitation means comprise a series or a succession of excitation elements, provided on said at least one of the drive element and the driven element, where in particular the series or succession of excitation elements is substantially rectilinear or is arranged according to a circumference or an arc of circumference.

4. The device according to claim 2, wherein the excitation means are obtained on, or integrated in, or mounted on at least one of a movable member of the actuation system and the support means.

5. The device according to claim 1, wherein the actuation system is arranged for allowing, when in the respective inoperative condition, removal of the support means from said positioning region.

6. The device according to claim 5, wherein the main body comprises a first static part fixed in a stationary position relative to said structure of the appliance and a second part displaceable relative to the first part, where in particular the second body part is mounted slidably with respect to the first body part or is constrained to the first body part to carry out movements with respect to it, and/or the first body part is arranged for fixing at a respective passage formed in a wall of said treatment chamber and has a first portion designed to project, through said passage, to the outside of said chamber, and a second portion designed to be exposed or housed inside said treatment chamber, and/or at least one of said first and second body parts has a wall equipped with at least one window, consisting of a respective through aperture and a closure element made of transparent material, and/or at least one of said first and second body parts has one wall formed at least in part of a transparent material, and/or at least one of said first and second body parts has associated thereto at least one sealing means cooperating with the support means, and/or the second body part is adapted for sliding with respect to the first body part according to a plane substantially perpendicular to an axis of movement of the support means, and/or the second body part is configured substantially as a drawer, or is hinged to the first body part.

7. The device according to claim 1, wherein the actuation system is operative for selectively bringing portions or receptacles of the support means into a substantially predefined position, in order to expose a corresponding amount or dose of substance to a fluid flow.

8. The device according to claim 1, wherein the main body has at least one inlet aperture and at least one outlet apertures for a fluid flow, and the actuation system is controllable for causing a relative movement between the support means and said inlet and outlet apertures, for positioning at said apertures, or between said apertures, a dose of the substance, for the purpose of delivering it by means of a flow of a fluid.

9. The device according to claim 1, wherein the actuation system comprises electrically supplied actuating means and a transmission arrangement operatively interposed between the actuating means and the driven element, in said operative and inoperative conditions of the actuation system the transmission arrangement being coupled or decoupled with respect to the driven element, respectively.

10. The device according to claim 9, wherein the electrically supplied actuating means comprise at least one of a thermoelectric actuator and an electric motor.

11. The device according to claim 1, further comprising detection or control means of at least one status or operational condition of the device.

12. The device according to claim 11, wherein the detection or control means comprise sensing means including a detection unit provided on said main body and at least one excitation means provided on at least one of said drive element and driven element and movable therewith, the at least one excitation means interacting with said detection unit to obtain at least one of the following information:

information representative of a condition of either presence or absence of the support means in the positioning region;

information representative of a condition of incorrect positioning of a movable part of the main body relative to a fixed part of the main body;

information representative of a condition of absence of doses of in the support means;

information representative of a residual amount of doses of substance in the support means;

information representative of an operative position, among a plurality of possible operative positions, of the support means within the positioning region;

information representative of a direction of movement of the support means within the positioning region;

information representative of a speed of movement of the support means within the positioning region.

13. The device according claim 1, further comprising at least part of a control circuit or system arranged for controlling an actuating means for positioning the support means in a predefined operative position among a plurality of possible operative positions within a respective housing, wherein the control system or circuit is arranged for controlling the actuation system for the purposes of:

delivering an individual dose of substance in a single phase of a cycle of operation of the appliance, and/or performing separate deliveries starting from a single dose of substance in several phases of a cycle of operation of the appliance, and/or delivering several doses of substance in the course of a same phase of operation of the appliance or a same cycle of operation of the appliance, and/or delivering at least one dose of a first substance and at least one dose of a second substance in the course of a same phase of operation of the appliance or a same cycle of operation of the appliance, and/or delivering at least one dose of substance in conjunction with execution of a specific operative phase of the appliance.

14. A domestic washing machine, in particular a dishwasher or a laundry washing machine, comprising a dispensing device for substances, made according to claim 1.

15. A method for using a support means for a deliverable substance in a device according to claim 1, the method comprising the steps of:

providing the support means with respective transmission means;

positioning the support means in the corresponding positioning region of the dispensing device;

selectively coupling the actuation system of the dispenser to the transmission means of the support means.

16. A method for using a support means of at least one dose of a deliverable substance which is operatively coupleable to a dispenser, wherein the following steps are provided:

providing one said support means for a dispenser according claim 1 with respective transmission means adapted to mesh in a separable manner with transmission means of the actuation system of the dispenser;

inserting said support means in said positioning region of the dispenser;

selectively coupling the transmission means of the actuation system to the transmission means of the support means.

17. A dispensing device for substances for a domestic appliance, comprising:

a main body, arranged for being fixed in a stationary position with respect to a structure of the appliance, a support means of a substance which is to be delivered, an actuation system which is electrically controllable for causing delivery of the substance, wherein the actuation system comprises at least one drive element and one driven element, the driven element being adapted to cooperate with the drive element to allow said delivery, wherein the actuation system is prearranged to take on an operative condition, in which the drive element is operatively coupled to the driven element, and an inoperative condition, in which the drive element is decoupled from the driven element, wherein the dispensing device further comprises a position or movement transducer comprising a detection unit excitable by at least one excitation means, wherein the detection unit is provided in a fixed position on the main body and the at least one excitation means is provided on at least one of the drive element and the driven element and movable therewith, the at least one excitation means cooperating or interacting with the detection unit for detecting or controlling a relative movement between the drive element or the driven element with respect to at least one part of the main body.

18. A method for managing a support means of at least one dose of a deliverable substance operatively coupled to a dispenser, wherein the following steps are provided:

providing one said support means for a dispenser according to claim 17;

recognising said at least one excitation means via said detection unit.

19. The dispensing device according to claim 17, wherein at least one excitation means is configured to excite said detection unit to obtain at least one of the following information:

information representative of a condition of either presence or absence of the support means in the dispensing device;

information representative of a condition of incorrect positioning of a movable part of the main body relative to a fixed part of the main body;

information representative of a condition of absence of doses of substance in the support means;

information representative of a residual amount of doses of substance in the support means;

information representative of an operative position, among a plurality of possible operative positions, of the support means within the dispensing device;

information representative of a direction of movement of the support means in the dispensing device;

information representative of a speed of movement of the support means within the dispensing device.

20. The dispensing device according to claim 17, wherein said at least one excitation means is in a predefined position relative to least one dose of substance in the support means.

21. A dispensing device for substances for a domestic appliance, comprising:

a main body, arranged for being fixed in a stationary position relative to a structure of the appliance and having a positioning region for a support means of a plurality of doses of a substance, sufficient for carrying out a plurality of deliveries or operating cycles of the appliance, an actuation system which is electrically controllable for causing a relative movement between the support means and at least one part of the main body, for the purpose of selectively delivering at least one dose of the substance contained in the support means in a treatment chamber of the domestic electrical appliance, wherein the actuation system comprises at least one drive element and one driven element, the driven element being adapted to cooperate with the drive element to allow said delivery, wherein the actuation system is prearranged to take on an operative condition, in which the drive element is operatively coupled to the driven element, and an inoperative condition, in which the drive element is decoupled from the driven element, wherein the dispensing device further comprises a visual signaling system comprising a window provided on the main body and a movable optical indicator adapted to pointing out an operative position of the support means among a plurality of possible operative positions within the positioning region, wherein the optical indicator is provided on at least one of a movable member of the actuation system and the support means, wherein the window is defined in at least one of a peripheral wall and a bottom wall of said positioning region, and wherein the optical indicator comprises one or more graphic and/or alphabetical and/or numerical symbols viewable through said window.

* * * * *